US012734394B2

(12) United States Patent
Xu et al.

(10) Patent No.: US 12,734,394 B2
(45) Date of Patent: Sep. 15, 2026

(54) SWITCHING DEVICES, FITNESS EQUIPMENT, AND CONTROL METHODS FOR FITNESS EQUIPMENT

(71) Applicant: SHENZHEN THOUSANDSHORES TECHNOLOGY CO., LTD., Shenzhen (CN)

(72) Inventors: Hui Xu, Shenzhen (CN); Jing Luo, Shenzhen (CN); Haoxuan Zeng, Shenzhen (CN)

(73) Assignee: SHENZHEN THOUSANDSHORES TECHNOLOGY CO., LTD., Shenzhen (CN)

( * ) Notice: Subject to any disclaimer, the term of this patent is extended or adjusted under 35 U.S.C. 154(b) by 163 days.

(21) Appl. No.: 18/788,050

(22) Filed: Jul. 29, 2024

(65) Prior Publication Data

US 2025/0082982 A1 Mar. 13, 2025

Related U.S. Application Data

(63) Continuation-in-part of application No. 18/477,524, filed on Sep. 28, 2023, now Pat. No. 12,048,859.

(30) Foreign Application Priority Data

| | | |
|---|---|---|
| Sep. 11, 2023 | (CN) | 202311169097.4 |
| Sep. 11, 2023 | (CN) | 202311171082.1 |
| Jul. 19, 2024 | (CN) | 202410982939.6 |

(51) Int. Cl.

| | |
|---|---|
| ***A63B 21/22*** | (2006.01) |
| ***A63B 21/00*** | (2006.01) |
| ***A63B 21/16*** | (2006.01) |

(52) U.S. Cl.

CPC ..... *A63B 21/22* (2013.01); *A63B 21/00192* (2013.01); *A63B 21/151* (2013.01);

(Continued)

(58) Field of Classification Search

CPC . A63B 21/153; A63B 21/025; A63B 21/0058; A63B 21/00069; A63B 21/015;

(Continued)

(56) References Cited

U.S. PATENT DOCUMENTS 3,610,617 A * 10/1971 Hepburn ..... A63B 21/015 482/116
3,690,654 A * 9/1972 Hepburn ..... A63B 21/153 482/909

(Continued)

FOREIGN PATENT DOCUMENTS

CN 109173163 A 1/2019
CN 212090746 U 12/2020

(Continued)

OTHER PUBLICATIONS

First Office Action in Chinese Application No. 202311171082.1 mailed on Jul. 29, 2025, 14 pages.

(Continued)

*Primary Examiner* — Andrew M Kobylarz
(74) *Attorney, Agent, or Firm* — PORUS IP LLC

(57) ABSTRACT

Some embodiments of the present disclosure provide a switching device for a fitness device, a fitness device and a control method thereof. The switching device may include a first rotating shaft, a second rotating shaft, and a switching member. The second rotating shaft may sleeve outside the first rotating shaft, and the first rotating shaft and the second rotating shaft may be detachably connected through a first connecting assembly of the switching device. The switching member may be configured to switch between a first state and a second state by driving the first rotating shaft to connect or separate from the second rotating shaft through a movement of the first connecting assembly.

16 Claims, 44 Drawing Sheets

(52) U.S. Cl.
CPC ..... *A63B 21/16* (2013.01); *A63B 2220/16* (2013.01); *A63B 2220/34* (2013.01)

(58) Field of Classification Search
CPC ..... A63B 21/225; A63B 2022/0079; A63B 2023/0411; A63B 23/0476; A63B 2071/027; A63B 2022/0652; B64G 1/60
See application file for complete search history.

(56) References Cited

U.S. PATENT DOCUMENTS

| | | | | |
|---|---|---|---|---|
| 3,764,132 | A * | 10/1973 | Hepburn | A63B 21/00069 482/123 |
| 5,133,545 | A * | 7/1992 | Moschetti | A63B 21/153 482/110 |
| 6,299,566 | B1 * | 10/2001 | Wu | A63B 22/205 482/52 |
| 10,307,631 | B2 | 6/2019 | Jeremic et al. | |
| 10,350,446 | B2 | 7/2019 | Simonetti | |
| 11,745,040 | B1 * | 9/2023 | Krull | A63B 21/4029 482/118 |
| 12,280,306 | B1 | 4/2025 | Wang | |
| 12,318,657 | B1 | 6/2025 | Nolan et al. | |
| 2020/0406097 | A1 | 12/2020 | Otsuki et al. | |
| 2022/0062691 | A1 * | 3/2022 | Kao | A63B 21/157 |
| 2022/0111241 | A1 * | 4/2022 | Moyer | A63B 21/0455 |
| 2022/0161088 | A1 * | 5/2022 | Wilson | A63B 21/157 |
| 2023/0338771 | A1 * | 10/2023 | Hansen | A63B 21/153 |
| 2025/0325878 | A1 | 10/2025 | Ezran et al. | |
| 2025/0387660 | A1 * | 12/2025 | Zheng | A63B 21/153 |

FOREIGN PATENT DOCUMENTS

| | | | | |
|---|---|---|---|---|
| CN | 212141295 | | 12/2020 | |
| CN | 214286640 | | 9/2021 | |
| CN | 114191771 | A * | 3/2022 | B65H 75/4405 |
| CN | 217448819 | | 9/2022 | |
| CN | 217745519 | | 11/2022 | |
| CN | 217908755 | | 11/2022 | |
| CN | 115920322 | | 4/2023 | |
| CN | 116115962 | A | 5/2023 | |
| CN | 116370896 | A | 7/2023 | |
| CN | 120586345 | A * | 9/2025 | A63B 71/0054 |
| DE | 202024100673 | U1 | 2/2024 | |
| WO | WO-2012165945 | A1 * | 12/2012 | A63B 21/154 |
| WO | 2022166460 | A1 | 8/2022 | |

OTHER PUBLICATIONS

First Office Action in Chinese Application No. 202311169097.4 mailed on Jul. 31, 2025, 13 pages.

"FitTransformer: All-In-One Modular Home Gym", Web page <https://www.kickstarter.com/projects/2484918/fittransformer-one-stop-modular-home-gym-of-the-future?ref=discovery&term=sportneer>, Jul. 13, 2023.

* cited by examiner

SWITCHING DEVICES, FITNESS EQUIPMENT, AND CONTROL METHODS FOR FITNESS EQUIPMENT

CROSS-REFERENCE TO RELATED APPLICATIONS

This application is a Continuation in part of U.S. patent application Ser. No. 18/477,524, filed on Sep. 28, 2023, which claims priority of Chinese Patent Application No. 202311171082.1, filed on Sep. 11, 2023, and Chinese Patent Application No. 202311169097.4, filed on Sep. 11, 2023, and this application claims priority of Chinese Patent Application No. 202410982939.6, filed on Jul. 19, 2024, the contents of each of which are entirely incorporated herein by reference.

TECHNICAL FIELD

The present disclosure relates to the field of fitness equipment, and in particular, to a switching device for a fitness device, a switching device and a control method thereof.

BACKGROUND

Fitness devices continue to evolve and innovate when meeting people's needs for health and fitness enhancement. The fitness devices based on strength training are mainly powered by a slewing system of a motor system to achieve the intensity of strength training. The fitness devices based on aerobic training mainly adopt in the rebound of trace through an elastic rope, and power systems of the fitness devices continue to generate inertia to achieve inertia feeling of aerobic training. At present, if a user switches between strength training and aerobic training, the corresponding fitness equipment is often switched, and it is impossible to achieve two different professional training modes in one equipment.

Therefore, it is desirable to provide a switching device for a fitness device, a fitness device and a control method thereof, which can switch different professional training modes as needed by the user.

SUMMARY

One or more embodiments of the present disclosure provide a switching device for a fitness device. The switching device may comprise a first rotating shaft, a second rotating shaft, and an operable switching member. The second rotating shaft may sleeve outside the first rotating shaft. The first rotating shaft and the second rotating shaft may be detachably connected through a first connecting assembly of the switching device. The switching member is configured to switch between a first state and a second state by driving the first rotating shaft to connect or separate from the second rotating shaft through a movement of the first connecting assembly.

One or more embodiments of the present disclosure provide a fitness device. The fitness device may comprise a switching device for the fitness device. The fitness device may be configured to be in a first mode when the switching device is in the first state, or in a second mode when the switching device is in the second state.

One or more embodiments of the present disclosure provide a control method for a fitness device including resistance module including a power device electrically connected with a power system, a control system, and a switching device, implemented by the control system. The control method may comprise: in response to determining that the fitness device is in a first mode, controlling a first output and a first rotation direction of the power device; in response to determining that the fitness device is in a second mode, controlling a second output and a second rotation direction of the power device.

BRIEF DESCRIPTION OF THE DRAWINGS

The present disclosure is further illustrated in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1A:
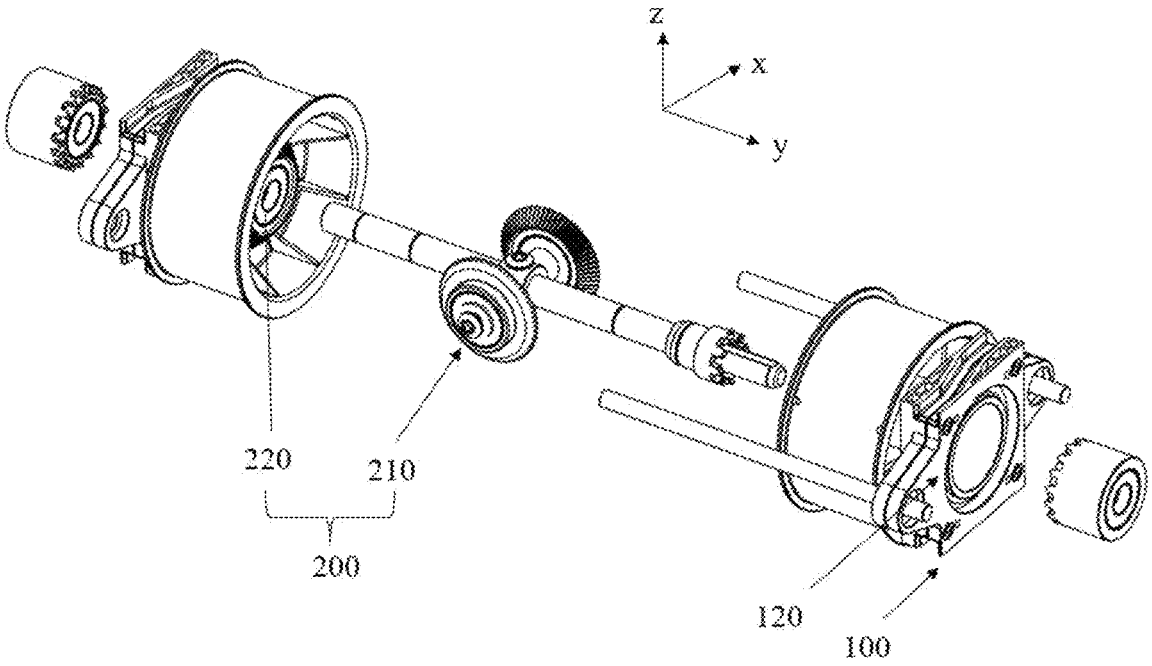
FIG. 1A is an explosion structural diagram illustrating an exemplary switching device according to some embodiments of the present disclosure.

In order to more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

It should be understood that the "system," "device," "unit," and/or "module" used herein are one method to distinguish different components, elements, parts, sections, or assemblies of different levels. However, if other words can achieve the same purpose, the words can be replaced by other expressions.

As used in the disclosure and the appended claims, the singular forms "a," "an," and "the" include plural referents unless the content clearly dictates otherwise; the plural forms may be intended to include singular forms as well. In general, the terms "comprise," "comprises," and/or "comprising," "include," "includes," and/or "including," merely prompt to include steps and elements that have been clearly identified, and these steps and elements do not constitute an exclusive listing.

Flowcharts are used in the present disclosure to illustrate the operations performed by a system according to embodiments of the present disclosure, and the related descriptions are provided to aid in a better understanding of the magnetic resonance imaging method and/or system. It should be appreciated that the preceding or following operations are not necessarily performed in an exact sequence. Instead, steps can be processed in reverse order or simultaneously. Also, it is possible to add other operations to these processes or to remove a step or steps from these processes.

A main goal of a strength training mode is to build muscle strength and muscle mass, and weight training equipment (e.g., a barbell, a dumbbell, or a strength-training station) is usually used for the strength training mode with high-intensity, low-repetition training. A main goal of an aerobic training mode is to enhance a cardio-pulmonary function and endurance, and aerobic equipment (e.g., a treadmill, a rowing machine, or a bicycle) is usually used for the aerobic training mode with low-intensity, high-repetition training to improve the cardio-pulmonary function and endurance. The strength training mode and the aerobic training mode correspond to different intensity requirements.

Some embodiments of the present disclosure provide a fitness device. The fitness device may include a resistance module and at least one type of fitness equipment. In some embodiments, the at least one type of fitness equipment may include a plurality of types of fitness equipment. The plurality of types of fitness equipment may include various fitness equipment (e.g., a strength training station or a rowing machine) belonging to different training modes, or may include various different fitness equipment (e.g., a treadmill or a rowing machine) belonging to the same training mode. In some embodiments, the resistance module may be detachably connected with the at least one type of fitness equipment, and the resistance module may provide resistance to the at least one type of fitness equipment. In some embodiments, the plurality of types of fitness equipment may be connected with a same resistance module. More descriptions regarding the resistance module may be found in the present disclosure below. In some embodiments, the at least one type of fitness equipment may include a switching device configured to switch a training mode of the at least one type of fitness equipment.

In some embodiments, the switching device may realize quick switching between two professional training modes on the at least one type of fitness equipment. In some embodiments, the resistance module may provide resistance for the at least one type of fitness equipment. In some embodiments, the control system may control the output of the resistance module according to a current mode of the fitness equipment.

Figure 1B:
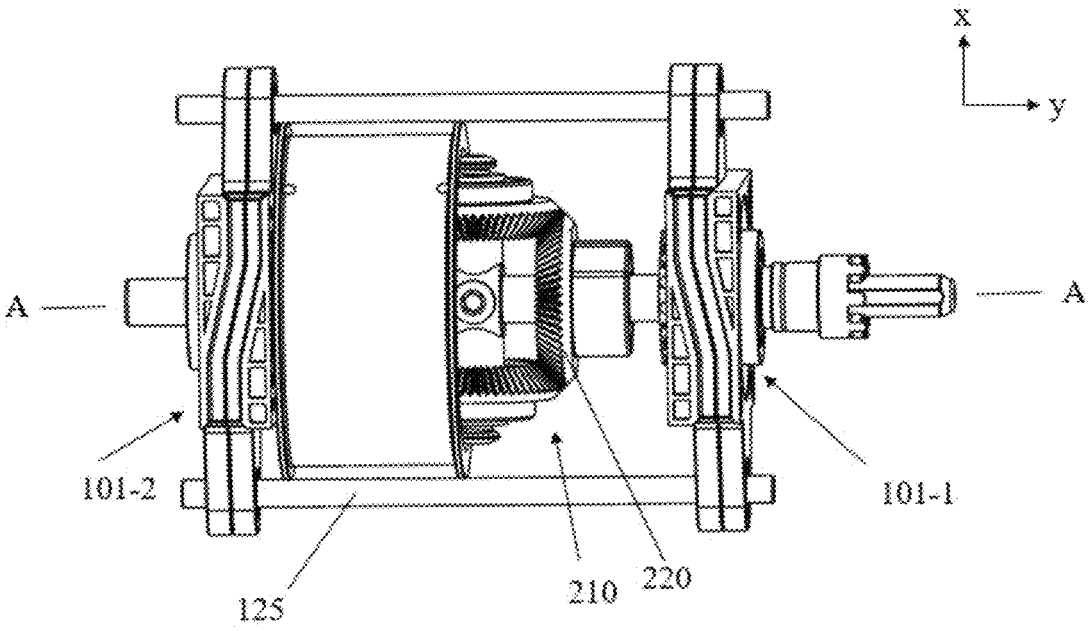
FIG. 1B is a structural diagram illustrating a top view of an exemplary switching device according to some embodiments of the present disclosure.
Figure 1C:
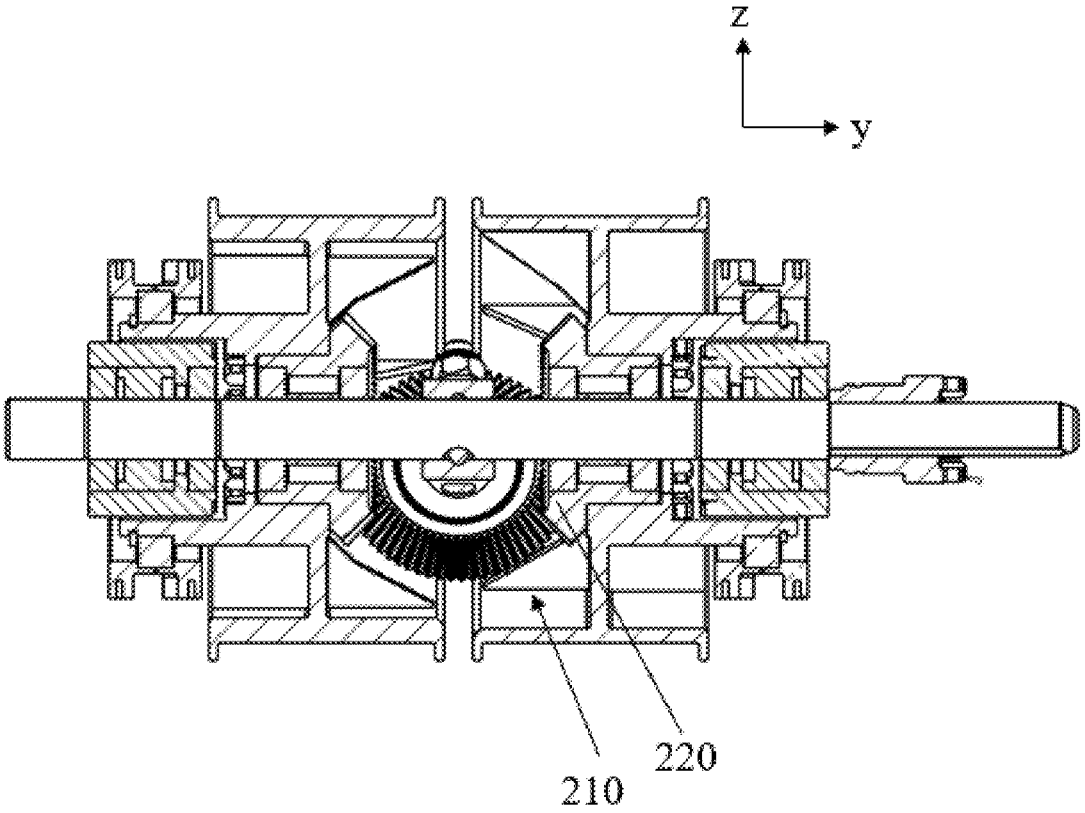
FIG. 1C is a diagram illustrating a cross-section of the switching device structure in an A-A direction of FIG. 1B according to some embodiments of the present disclosure.
Figure 2:
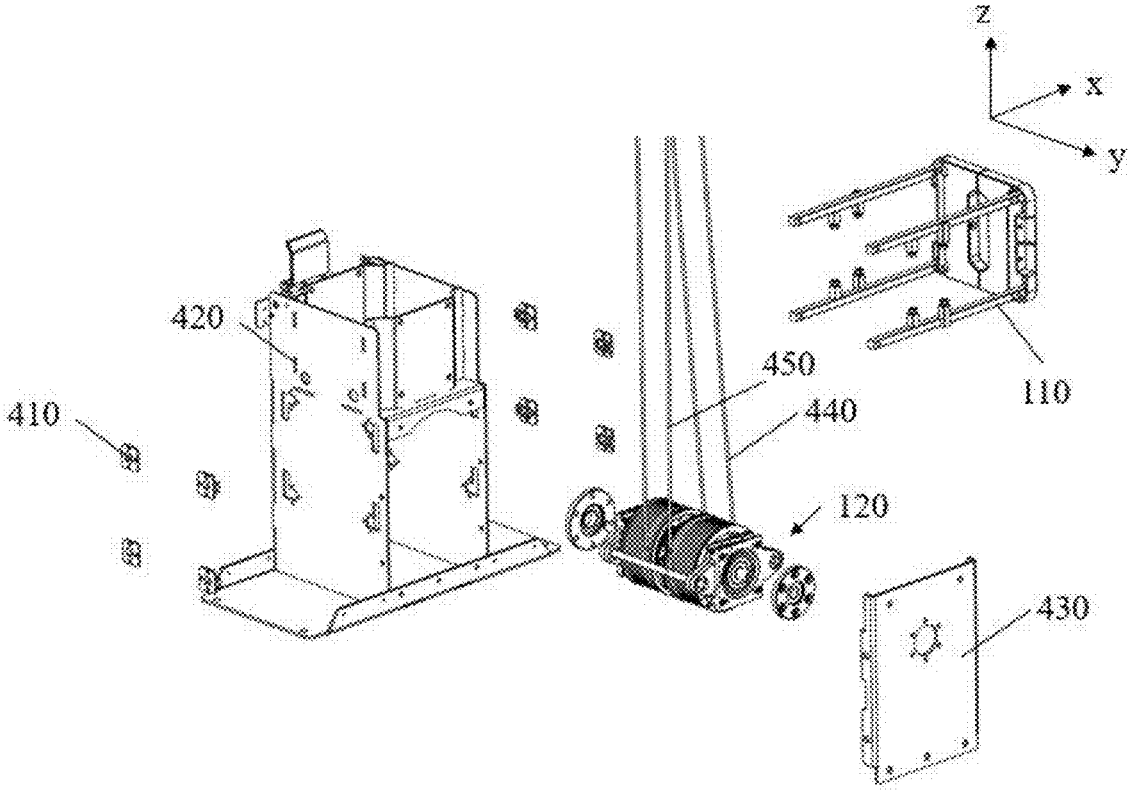
FIG. 2 is a diagram illustrating the mounting of an exemplary switching device according to some embodiments of the present disclosure.

FIG. 1A is an explosion structural diagram illustrating an exemplary switching device according to some embodiments of the present disclosure. FIG. 1B is a structural diagram illustrating a top view of an exemplary switching device according to some embodiments of the present disclosure. FIG. 1C is a diagram illustrating a cross-section of the switching device in an A-A direction of FIG. 1B according to some embodiments of the present disclosure. FIG. 2 is a diagram illustrating the mounting of an exemplary switching device according to some embodiments of the present disclosure.

The switching device for switching a training mode of at least one type of fitness equipment (hereinafter referred to as fitness equipment) may be capable of switching a state. For example, the switching device for switching a training mode of at least one type of fitness equipment may switch between a first state and a second state. The switching device may include a switching mechanism, a first connecting mechanism, and a second connecting mechanism. The switching mechanism may be configured to switch a training mode of the fitness equipment by switching the state of the switching device between the first state and the second state. The switching mechanism may be drivingly connected with the first connecting mechanism or the second connecting mechanism. In some embodiments, the switching device may be in a first state by a connection between the first connecting mechanism and the switching mechanism. The switching device may be in a second state by the connection between the second connecting mechanism and the switching mechanism.

Figure 4:
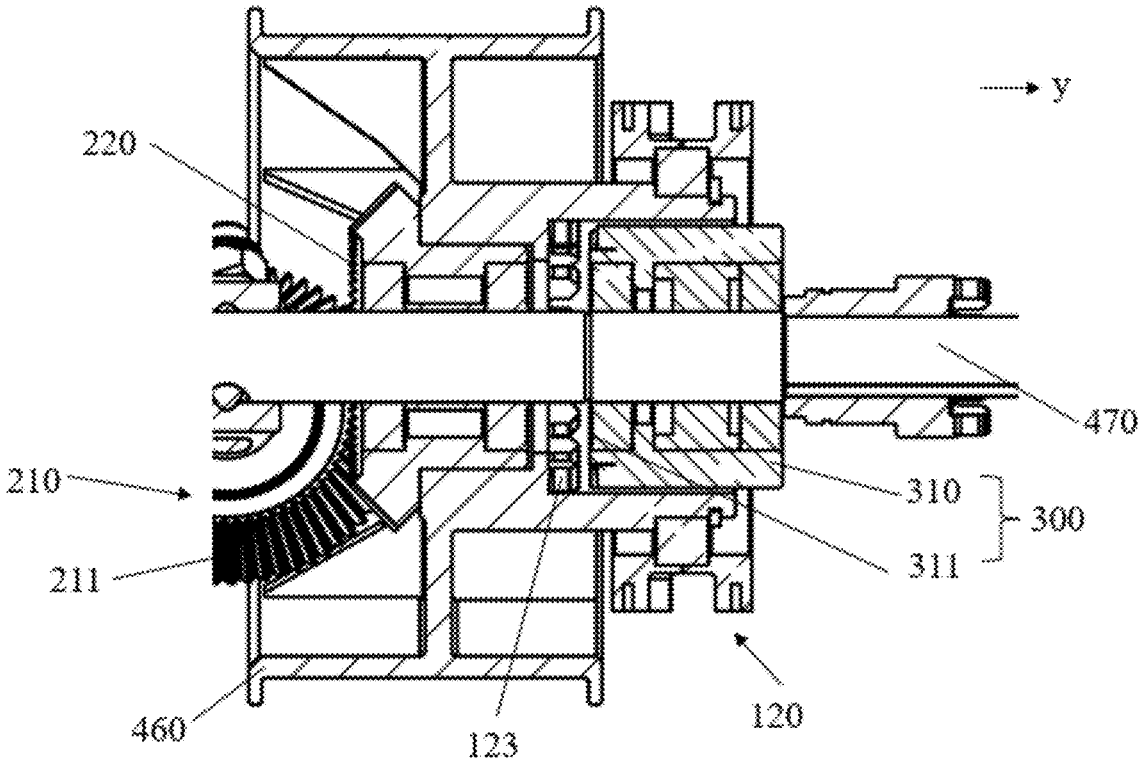
FIG. 4 is a diagram illustrating an exemplary partial structure of FIG. 1C according to some embodiments of the present disclosure.
Figure 6:
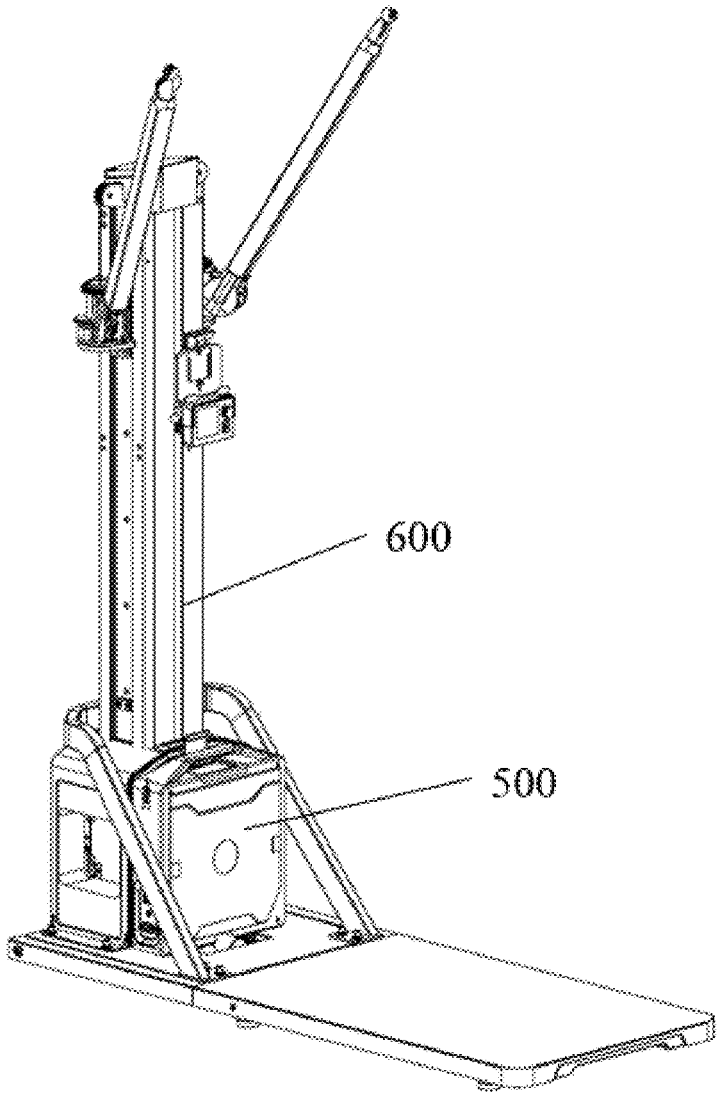
FIG. 6 is a structural diagram illustrating an exemplary fitness equipment according to some embodiments of the present disclosure.

For example, as shown in FIG. 1A-FIG. 1C, and FIG. 4, the switching device may include a switching mechanism 100, a first connecting mechanism 200, and a second connecting mechanism 300 (see FIG. 4). The switching mechanism 100 may be configured to switch a training mode of the fitness equipment (e.g., the fitness equipment 600 as shown in FIG. 6) by switching the state. The switching mechanism 100 may be drivingly connected with the first connecting mechanism 200 or the second connecting mechanism 300. In some embodiments, a connection between the first connecting mechanism 200 and the switching mechanism 100 may make the fitness equipment drivingly connected with a resistance module (e.g., a resistance module 500 as shown in FIG. 6), and the switching device may be in a first state. A connection between the second connecting mechanism 300 and the switching mechanism 100 may make the fitness equipment 600 drivingly connected with the resistance module 500, and the switching device may be in a second state.

In some embodiments, the switching mechanism 100 may be drivingly connected with the first connecting mechanism 200 or the second connecting mechanism 300 by an operator moves the switching mechanism 100 to be connected with the first connecting mechanism 200 or the second connecting mechanism 300 manually. In some embodiments, the switching mechanism 100 may be drivingly connected with the first connecting mechanism 200 or the second connecting mechanism 300 by driving the switching mechanism 100 using an electric device to be connected with the first connecting mechanism 200 or the second connecting mechanism 300 automatically. The switching mechanism 100 drivingly connected with the first connecting mechanism 200 or the second connecting mechanism 300 refers to that the switching mechanism 100 is connected with the first connecting mechanism 200 or the second connecting mechanism 300 via a transmission connection. The transmission connection may include a plurality of feasible forms, such as gear meshing transmission or connecting rod transmission. More descriptions regarding the transmission connection may be found in the present disclosure below.

The fitness equipment may provide a plurality of training modes for training. Different training modes may be related to training resistances provided by the fitness equipment. For example, the plurality of training modes may include a strength training mode and an aerobic training mode. The strength training mode may correspond to a first range of training resistance. The aerobic training mode may correspond to a second range of training resistance. In some embodiments, the maximum resistance of the first range of training resistance may be less than the minimum resistance of the second range of training resistance.

The resistance module may provide training resistance for training, and the resistance module may include a device such as a motor or a power source. In some embodiments, the first state of the switching device may correspond to a strength training mode of the fitness equipment, the resistance module may provide a large resistance, a user may need to resist a relatively large resistance during motion, and a training intensity may be high. The second state of the switching device may correspond to an aerobic training mode of the fitness equipment, the resistance module may provide a small resistance, the user may need to resist a relatively small resistance during motion, and the training intensity may be low. As described herein, the large resistance indicates that the resistance is greater than a first threshold. The small resistance indicates that the resistance is smaller than a second threshold. For the same fitness equipment, the first threshold is greater than or equal to the second threshold. In some embodiments, for different fitness equipment, the first threshold may be different or the same. In some embodiments, for different fitness equipment, the second threshold may be different or the same. In some embodiments, for the same fitness equipment, the first threshold and/or the second threshold may be set according to a user need.

Each of the first connecting mechanism 200 and/or the second connecting mechanism 300 may include a transmission structure, such as a turbine worm assembly, a gear set, etc. In some embodiments, the first connecting mechanism 200 and the second connecting mechanism 300 may include different transmission structures. For example, the first connecting mechanism 200 may include a turbine worm assembly and the second connecting mechanism 300 may include a gear set. In some embodiments, the first connecting mechanism 200 and the second connecting mechanism 300 may include the same transmission structure. For example, each of the first connecting mechanism 200 and the second connecting mechanism 300 may include a turbine worm assembly. In some embodiments, the first connecting mechanism 200 and the second connecting mechanism 300 may include the same transmission structure with different output parameters. For example, the first connecting mechanism 200 and the second connecting component 300 may include the same transmission structure with different output torques and/or speeds. As another example, the first connecting mechanism 200 and the second connecting mechanism 300 may include turbine worms with different transmission ratios and output torques. As still another example, the first connecting mechanism 200 and the second connecting mechanism 300 may include gear sets with different transmission ratios and output torques, etc. Different training modes of a fitness equipment may be realized by different structural settings of the first connecting mechanism 200 and the second connecting mechanism 300. More descriptions regarding the training mode may be found in the present disclosure below.

The switching mechanism 100 may include at least one toggle assembly. Each of the at least one toggle assembly may include a support and a toggle member slidably disposed in the support. The toggle member may be drivingly connected with the first connecting mechanism 200 or the second connecting mechanism 300 by sliding on the support 110. More descriptions regarding a specific manner in which the toggle member is disposed may be found in the present disclosure below.

In some embodiments, the switching mechanism 100 may include two sets of toggle assemblies symmetrically disposed relative to the X-axis direction.

Figure 3A:
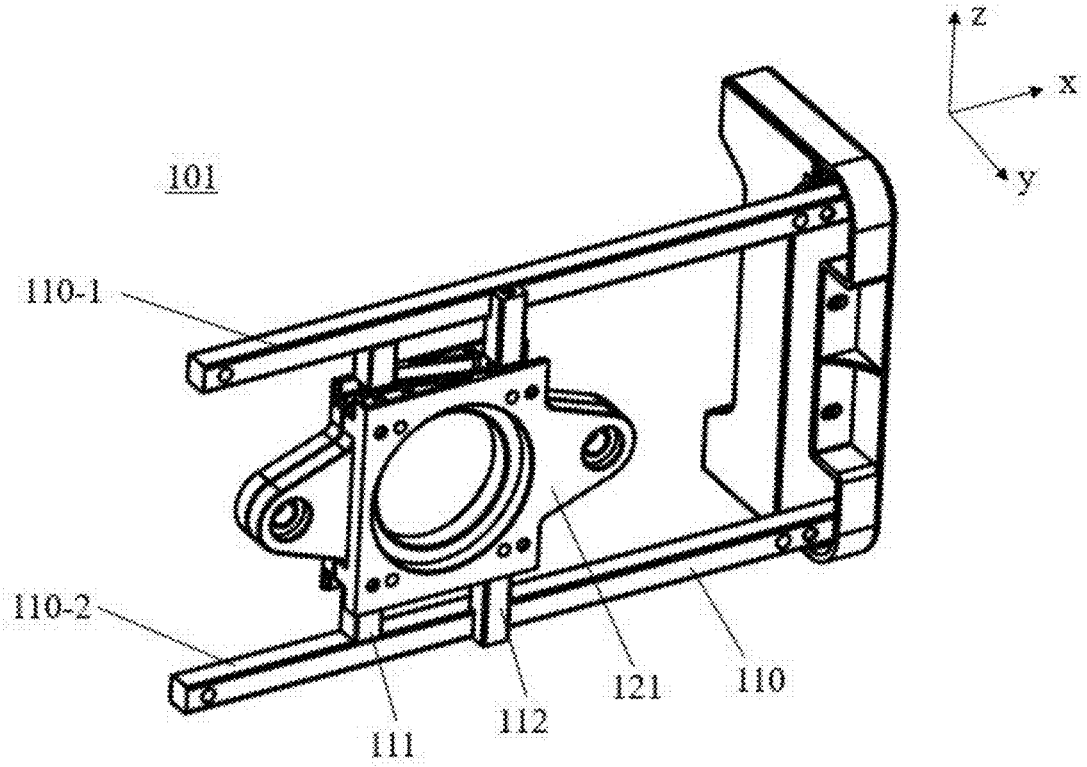
FIG. 3A is a structural diagram illustrating an exemplary toggle assembly according to some embodiments of the present disclosure.
Figure 3B:
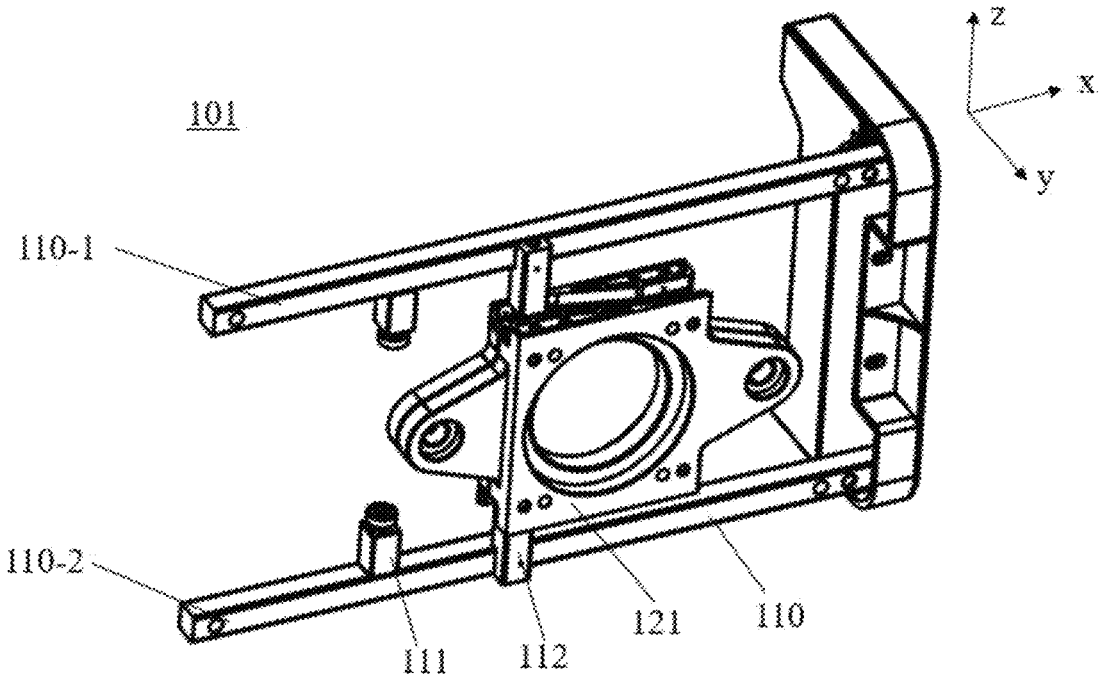
FIG. 3B is a structural diagram illustrating another exemplary toggle assembly according to some embodiments of the present disclosure.
Figure 3C:
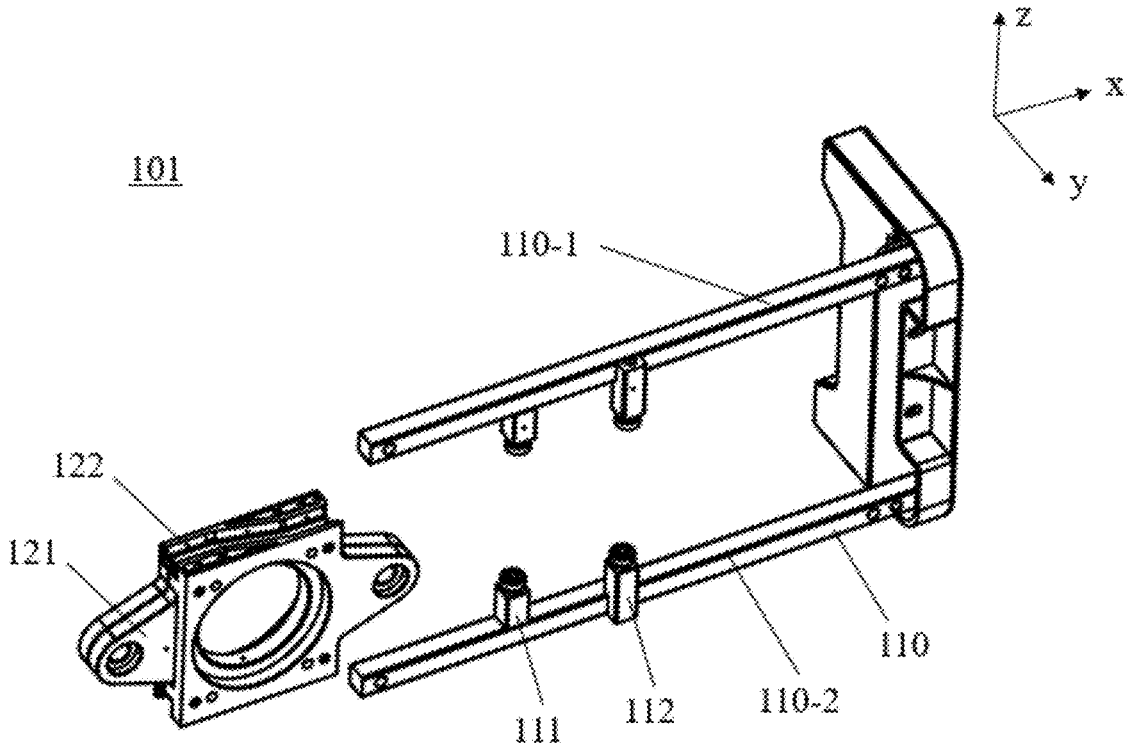
FIG. 3C is an explosion structural diagram illustrating an exemplary toggle assembly according to some embodiments of the present disclosure.

For example, FIGS. 3A-3C are structural diagrams illustrating different states of the switching mechanism according to some embodiments of the present disclosure. Combining FIG. 1A and FIGS. 3A-3C, the switching mechanism 100 may include at least one toggle assembly. Each of the at least one toggle assembly may include a support 110 and a toggle member 120 slidably disposed in the support. The toggle member 120 may be drivingly connected with the first connecting mechanism 200 or the second connecting mechanism 300 by sliding on the support 110.

Further, the switching mechanism 100 may include a first toggle assembly 101-1 and a second toggle assembly 101-2. The switching mechanism may include a set of first connecting mechanisms and a set of second connecting mechanisms drivingly connected with the first toggle assembly 101-1, and another set of first connecting mechanism and another set of second connecting mechanism drivingly connected with the second toggle assembly 101-2.

The support 110 may include one or more positioning shafts. The positioning shaft may be fixedly disposed on the support 110. The positioning shaft may include a rod structure. The rod structure may be in a shape of a cylinder, a rectangular cuboid, etc. In some embodiments, as shown in FIGS. 3A-FIG. 3C, the positioning shaft may include a first positioning shaft 111 and a second positioning shaft 112. The first positioning shaft 111 may be spaced apart from the second positioning shaft 112 in an x-axis direction, and the first positioning shaft 111 and the second positioning shaft 112 may be spaced apart in a y-axis direction. As described herein, being disposed in the x-axis direction indicates that the first positioning shaft 111 and the second positioning shaft 112 are disposed perpendicular to an x-axis, and being disposed in the y-axis direction indicates that the first positioning shaft 111 and the second positioning shaft 112 are disposed perpendicular to a y-axis. In other words, the first positioning shaft 111 and the second positioning shaft 112 may be perpendicular to a plane formed by the x-axis and the y-axis. Spacing distances between the first positioning shaft 111 and the second positioning shaft 112 in the plane formed by the x-axis and the y-axis may be set as needed.

In some embodiments, the first positioning shaft 111 may include a pair of first positioning sub-shafts coaxially disposed in a z-axis direction, and the second positioning shaft 112 may include a pair of second positioning sub-shafts coaxially disposed in the z-axis direction. As described herein, being coaxially disposed in the z-axis direction indicates that the first positioning shaft 111 and the second positioning shaft 112 are disposed parallel to a z-axis.

In some embodiments, as shown in FIGS. 3A-FIG. 3C, the support 110 may include a first crossbar 110-1 and a second crossbar 110-2 parallel to the x-axis, and the first crossbar 110-1 may be spaced apart from the second crossbar 110-2 in the z-axis direction. The two first positioning sub-shafts of the first positioning shaft 111 may be disposed on a lower surface of the first crossbar 110-1 and an upper surface of the second crossbar 110-2, respectively, and the two first positioning sub-shafts may be coaxial in the z-axis direction. The two second positioning sub-shafts of the second positioning shaft 112 may be disposed on side surfaces (e.g., sides facing the outside of the paper in FIG. 3A-FIG. 3C) of the first crossbar 110-1 and the second crossbar 110-2, respectively, and the two second positioning sub-shafts may be coaxial in the z-axis direction.

In some embodiments, the toggle member 120 may be slidably connected with the first positioning shaft 111 and the second positioning shaft 112. In some embodiments, the toggle member 120 may move in the x-axis direction and the y-axis direction simultaneously when the toggle member 120 slides along at least one of the first positioning shaft 111 and the second positioning shaft 112.

In some embodiments, the toggle member 120 may include a moving sleeve 121 and a connecting member. The toggle member 120 may move relative to at least one positioning shaft (the first positioning shaft 111 and the second positioning shaft 112) through the moving sleeve 121, and the toggle member 120 may be connected with the first connecting mechanism 200 or the second connecting mechanism 300 through the connecting member. In some embodiments, the toggle member 120 may only include the moving sleeve 121 and not include the connecting member.

The moving sleeve 121 may have a connection function of the connecting member, i.e., the toggle member 120 may be connected with the first connecting mechanism 200 or the second connecting mechanism 300 through the moving sleeve 121 when the toggle member 120 moves relative to the at least one positioning shaft through the moving sleeve 121.

In some embodiments, the moving sleeve 121 may be provided with a Z-groove 122. The first positioning shaft 111 and the second positioning shaft 112 may be able to slide in the Z groove 122. The Z-groove 122 may have a guiding effect with respect to the first positioning shaft 111 and the second positioning shaft 112. For example, the first positioning shaft 111 and the second positioning shaft 112 may be respectively provided with protrusions that match the Z-groove 122 and are embedded in the Z-groove 122, so that when the moving sleeve 121 moves, the protrusions may move in the Z-groove 122 relative to the Z-groove 122.

In some embodiments, the Z-groove 122 may be in any other feasible shape as long as two ends of the groove are spaced apart in the y-axis direction. For example, the Z-groove 122 may be diagonal. As another example, the Z-groove 122 may include a flat straight line segment portion and a diagonal line segment portion that are parallel to the x-axis direction.

In some embodiments, the Z-groove 122 may include a first straight line segment, a diagonal segment, and a second straight line segment. The first straight line segment and the second straight line segment may be respectively parallel to the x-axis direction, and the first straight line segment and the second straight line segment may be spaced apart in the y-axis direction (i.e., positions of the first straight line segment and the second straight line segment may be in the y-axis direction). The diagonal segment connects the first straight line segment and the second straight line segment. When the toggle member 120 is moved in the x-direction, the Z-groove 122 may slide with respect to the at least one of the first positioning shaft 111 and the second positioning shaft 112. When sliding from the first straight line segment to the second linear segment of the Z-groove 122 (or when sliding from the second linear segment to the first linear segment), the toggle member 120 may move in the y-axis direction under the action of the at least one positioning shaft (e.g., the first positioning shaft 111 and the second positioning shaft 112) in a relatively fixed position cooperating with the Z-groove 122 simultaneously.

In some embodiments, as shown in FIG. 3A, when the toggle member 120 is moved until both the first positioning shaft 111 and the second positioning shaft 112 are located in the Z-groove 122, the connecting member may be drivingly connected with the first connecting mechanism 200, and the switching mechanism may be in the first state.

In some embodiments, as shown in FIG. 3B, when the toggle member 120 is moved until when only the second positioning shaft 112 is located in the Z-groove 122, the connecting member may be drivingly connected with the second connecting mechanism 300, and the switching mechanism may be in the second state.

In some embodiments, the connecting member being drivingly connected with the first connecting mechanism 200 or the second connecting mechanism 300 may be a connection in the y-axis direction, i.e., a power transmission may be achieved in the y-axis direction. For example, as shown in FIGS. 1A-1C, the connecting member and the first connecting mechanism 200 or the second connecting mechanism 300 may achieve a tooth meshing connection in the y-axis direction, thereby carrying out the power transmission. More descriptions regarding the connection member being drivingly connected with the first connecting mechanism 200 or the second connecting mechanism 300 may be found in the present disclosure elsewhere in the present disclosure. The power transmission in the y-axis direction may be realized by applying only a force in the x-axis direction to the toggle member 120 when the toggle member 120 is moved. Therefore, a direction (e.g., x-axis direction) in which the toggle member 120 is moved for state switching may be different from a direction (e.g., y-axis direction) of the transmission connection. The direction (e.g., x-axis direction) in which the toggle member 120 switches states is different from the direction (e.g., y-axis direction) in which the power transmission is connected, so that the two directions may not affect each other, and the connection may be more stable and the power transmission effect may be better.

In some embodiments, the switching mechanism 100 may include a plurality of toggle assemblies, and the toggle members of the plurality of toggle assemblies 101 may be moved synchronously. For example, the toggle member 120 of the first toggle assembly 101-1 and the toggle member 120 of the second toggle assembly 101-2, as shown in FIG. 1B, may be connected through a connecting rod 125 to ensure that the two toggle members 120 move synchronously to increase the stability of the entire device.

In some embodiments of the present disclosure, the toggle member may skillfully realize the simultaneous movement in both the x-axis and the y-axis directions, and the switching mechanism may switch between two states accordingly by converting the user's operation of the x-axis direction of the toggle member into the movement of the toggle member in the y-axis direction, and the transmission may be stable.

In some embodiments, the support 110 may include a guiding structure, such as a guiding groove. The toggle member 120 may be provided with a guiding member (e.g., an embedded protrusion) that matches the guiding structure, and the embedded protrusion of the toggle member 120 may be moved along the guiding groove.

In some embodiments, the switching mechanism may include a positioning structure. The positioning structure may include a positioning post. The positioning post may extend in a movement direction of the toggle member 120 when the positioning post moves to a set position (e.g., when the toggle member 120 is drivingly connected with the first connecting mechanism 200 or the second connecting mechanism 300) to block the movement of the toggle member 120, thereby limiting the toggle member 120, so that the toggle member 120 may be drivingly connected with the first connecting mechanism 200 or the second connecting mechanism 300 stably.

In some embodiments, the positioning post may be connected with a micro motor. The positioning post may be controlled to stretch out and draw back by the micro motor. In some embodiments, the toggle member 120 may include two separate portions. One portion of the toggle member 120 may be moved to be drivingly connected with the first connecting mechanism 200, and another portion of the toggle member 120 may be moved to be drivingly connected with the second connecting mechanism 300. The switching mechanism 100 may be drivingly connected with the first connecting mechanism 200 or the second connecting mechanism 300 by respectively controlling the two portions to move.

In some embodiments, the switching mechanism 100 may have any other feasible structure as long as the switching mechanism 100 may be drivingly connected with the first connecting mechanism 200 or the second connecting mechanism 300.

Figure 5:
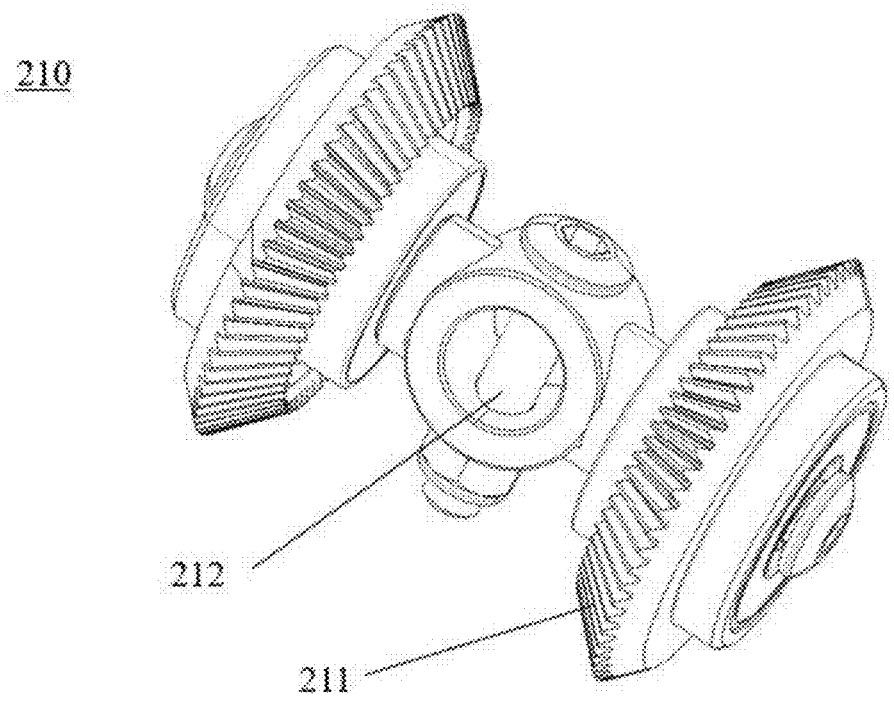
FIG. 5 is a structural diagram illustrating an exemplary central gear assembly of the first connection mechanism according to some embodiments of the present disclosure.

FIG. 4 is a diagram illustrating an exemplary partial structure of FIG. 1C according to some embodiments of the present disclosure. FIG. 5 is a structural diagram illustrating an exemplary central gear assembly of the first connection mechanism according to some embodiments of the present disclosure.

In some embodiments, as shown in FIGS. 1A-5, the first connecting mechanism 200 may include a central gear assembly 210 and a bevel gear 220. The central gear assembly 210 may include a fixed gear 211. The switching device may be in the first state by the toggle member 120 sliding towards a first position for driving, through the connecting member, the bevel gear 220 to mesh with the fixed gear 211.

In some embodiments, as shown in FIG. 5, the central gear assembly 210 may further include a central positioning pin 212. The fitness equipment may include a pull wheel assembly 460 and a transmission shaft 470. The central gear assembly 210 may be fixed to the transmission shaft 470 through the central positioning pin 212, and a rotating shaft of the fixed gear 211 may be perpendicular to an axis (y-axis direction) of the transmission shaft 470. The transmission shaft 470 may be configured to connect the resistance module 500 to provide resistance for the fitness equipment.

In some embodiments, as shown in FIG. 4, the bevel gear 220 may be disposed on a side of the toggle member 120 close to the pull wheel assembly 460, and the bevel gear 220 may be connected with the pull wheel assembly 460. When the toggle member 120 is moved in a negative direction of the y-axis, the connecting member of the toggle member 120 may drive the bevel gear 220 to move in the negative direction of the y-axis. In some embodiments, the connecting member of the toggle member 120 may be any feasible structure, or the toggle member 120 may not have the connecting member as long as the toggle member 120 may drive the bevel gear 220 to move in the negative direction of the y-axis.

In some embodiments, as shown in FIG. 3A and FIG. 4, the first position refers to that the toggle member 120 is located in a maximum position in the negative direction of the y-axis. At this time, the first positioning shaft 111 and the second positioning shaft 112 may be both located in the Z-groove 122, the bevel gear 220 may mesh with the fixed gear 211, and the switching device may be in the first state.

For example, as shown in FIG. 2, the fitness equipment may be a strength training station. The fitness equipment may include a pull rope 440 and an elastic rope 350, and a user may train by pulling the pull rope 440. When the user pulls the pull rope 440 and the elastic rope 450, the pull wheel assembly 460 may be driven to rotate, the pull wheel assembly 460 may rotate to drive the central gear assembly 210 to rotate, and the resistance module 500 may provide resistance (i.e., a force in an opposite direction of a force exerted by the user) for the central gear assembly 210 through the transmission shaft 470. When the user releases the force exerted on the pull rope 440, at this time, the resistance module 500 may also provide resistance to the transmission shaft 470 and the pull wheel assembly 460, and the pulled pull rope 440 may be rewound around the pull wheel assembly 460, and the elastic rope 450 may follow the pull wheel assembly 460 back into position at the same time. The bevel gear 220 meshes with the central gear assembly 210, so that torque may be transmitted in both forward and backward directions, the pulling out and recovery of the pull rope may be subject to the resistance provided by the resistance module 500, and the fitness equipment may be in a high-resistance and high-intensity strength training mode (i.e., a first mode).

In some embodiments, as shown in FIG. 4, the second connecting mechanism 300 may include a unidirectional wheelset 310, and the unidirectional wheelset 310 may include a unidirectional gear 311. In some embodiments, the switching device may be in the second state by the toggle member 120 sliding toward a second position for driving, through the connecting member to mesh with the unidirectional gear 311. The pull wheel assembly 460 may be connected with the unidirectional wheelset 310. In some embodiments, the unidirectional gear 311 may unidirectionally mesh with the transmission shaft 470. When the transmission shaft 470 rotates positively, the unidirectional wheelset 310 may rotate with the transmission shaft 470. When the transmission shaft 470 rotates in reverse, the unidirectional gear 311 may no longer mesh with the unidirectional gear 311, and the unidirectional gear 311 may rotate freely without transmitting torque. In some embodiments, the unidirectional wheelset 310 may be a gear set with unidirectional teeth on an end face.

In some embodiments, as shown in FIG. 3B and FIG. 4, the second position refers to that the toggle member 120 is located at a maximum position in a positive direction of the y-axis. At this time, only the second positioning shaft 112 may be located in the Z-groove 122, and the unidirectional gear 311 may mesh with the connecting member. In some embodiments, the connecting member may include inner teeth 123. When the toggle member 120 moves in the positive direction of the y-axis, the inner teeth 123 may be driven to move in the positive direction of the y-axis until the inner teeth 123 meshes with the unidirectional gear 311. At this time, the central gear assembly 210 and the bevel gear 220 may be in a state of separation. When the user pulls the pull rope 440 and the elastic rope 450, the pull wheel assembly 460 may be driven to rotate, the pull wheel assembly 460 may rotate to drive the unidirectional wheelset 310 to rotate, the unidirectional wheelset 310 may transmit the torque, and the user may be subjected to the resistance provided by the resistance module 500 when pulling out the pull rope 440. When the user releases the force exerted on the pull rope 440, at this time, a rebound force of the elastic rope 350 may drive the pull wheel assembly 460 to reverse, and the pull rope 440 pulled out may be rewound around the pull wheel assembly 460. Because the unidirectional wheel assembly 310 reverses without transmitting the torque, the resistance module 500 may not provide the resistance. In this case, the pull rope 440 may bear the resistance when pulled out and bear no resistance when recovered, and the fitness equipment 600 may be in a low-resistance and low-intensity aerobic training mode (i.e., a second mode).

In some embodiments of the present disclosure, two connection modes of connecting the pull wheel assembly to the central gear assembly and connecting the pull wheel assembly to the unidirectional wheelset may be switched, respectively, through the toggle assembly, so that the fitness equipment may be switched between the strength training mode and the aerobic training mode through the switching device, and the user may easily access the training modes through the single equipment.

FIG. 6 is a structural diagram illustrating an exemplary fitness equipment according to some embodiments of the present disclosure.

In some embodiments, if a switching device is in a first state, the fitness equipment 600 may be in a first mode. if the switching device is in a second state, the fitness equipment 600 may be in a second mode. Exemplarily, as shown in FIG. 6, the fitness equipment 600 may be a strength training station, and the first mode may correspond to a strength training mode and the second mode may correspond to an aerobic training mode. More descriptions regarding the states of the switching device and the modes of the fitness equipment 600 may be found in the present disclosure above, which is not repeated herein.

In some embodiments, as shown in FIG. 6, the fitness equipment 600 may further include a resistance module 500 and a pull wheel assembly (e.g., the pull wheel assembly 460 as shown in FIG. 4). When the switching device is in the first state, the resistance module 500 may be drivingly connected with the pull wheel assembly 460 through the first connecting mechanism 200. When the switching device is in a second state, the resistance module 500 may be drivingly connected with the pull wheel assembly 460 through the second connecting mechanism 300. In some embodiments, the resistance module 500 may include an output shaft, and the output shaft of the resistance module 500 may be connected with the transmission shaft 470 (see FIG. 4) to transmit resistance to the fitness equipment 600. More descriptions regarding the resistance module 500 being drivingly connected with the pull wheel assembly 460 may be found in the present disclosure above, which is not repeated herein.

In some embodiments, referring to FIG. 2, the fitness equipment 600 may further include a first housing 420, a second housing 430, the pull rope 440, and the elastic rope 450. The first housing 420 and the second housing 430 may be configured to mount a component of the fitness equipment 600. The support 110 of the toggle assembly 101 may be mounted in the first housing 420 through a mounting member 410. The toggle assembly 101 may be connected with an operating member. The operating member may be removably disposed outside the first housing 420 for ease of operation of a user. More descriptions regarding the pull rope 440 and the elastic rope 450 may be found in the present disclosure above, which is not repeated herein.

Figure 7:
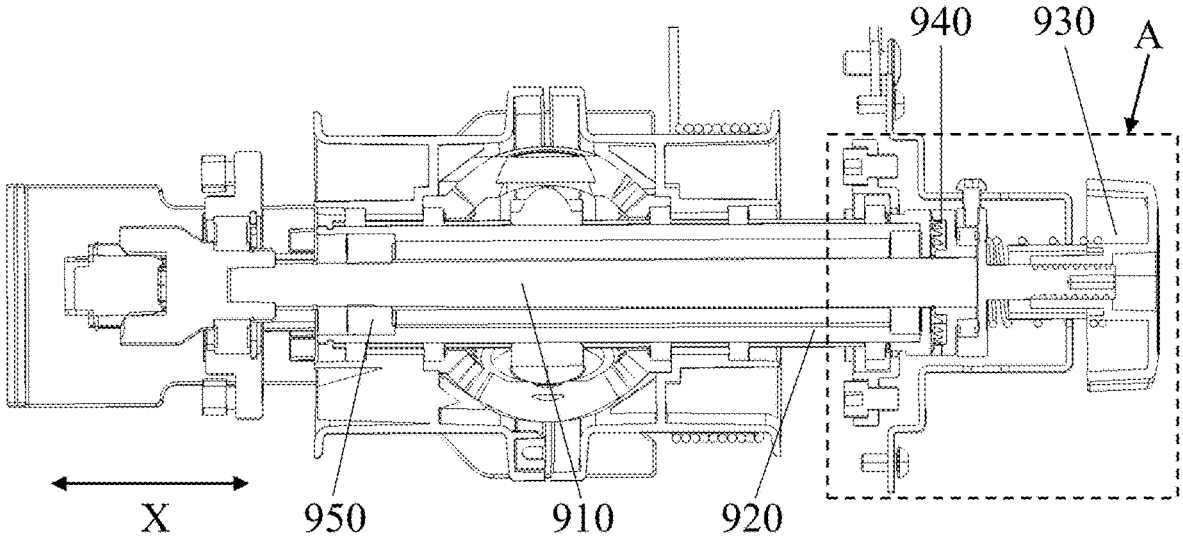
FIG. 7 is a structural diagram illustrating an exemplary switching device according to some embodiments of the present disclosure.

FIG. 7 is a structural diagram illustrating another exemplary switching device according to some embodiments of the present disclosure.

Some embodiments of the present disclosure further provide a switching device (hereinafter referred to as a switching device) for a fitness device (or fitness equipment). As shown in FIG. 7, the switching device may include a first rotating shaft 910, a second rotating shaft 920, and a switching member 930. The second rotating shaft 920 may sleeve outside the first rotating shaft 910. The first rotating shaft 910 and the second rotating shaft 920 may be detachably connected through a first connecting assembly 940.

The first rotating shaft 910 and the second rotating shaft 920 may be core components of the fitness device for transmitting motion or power.

In some embodiments, the length of the first rotating shaft 910 may be greater than the length of the second rotating shaft 920, to provide sufficient mounting space for a first matching member 941 described below, and also to better connect with the switching member 930.

In some embodiments, the diameter of the second rotating shaft 920 may be greater than the diameter of the first rotating shaft 910. The second rotating shaft 920 may be a hollow structure. The second rotating shaft 920 may sleeve outside the first rotating shaft 910.

The first connecting assembly 940 refers to an assembly used by the switching device to realize a detachable connection between the first rotating shaft 910 and the second rotating shaft 920. The detachable connection refers to a connection mode that allows two parts or assemblies to be connected and disconnected without permanent fixation. In some embodiments, the detachable connection may be achieved in various ways, such as a snap connection, a threaded connection, a magnetic connection, a sliding connection, etc.

In some embodiments, the first connecting assembly 940 may be disposed at any feasible position to achieve the detachable connection between the first rotating shaft 910 and the second rotating shaft 920. For example, the first connecting assembly 940 may be disposed at a middle position between the first rotating shaft 910 and the second rotating shaft 920. As another example, the first connecting assembly 940 may be disposed at one end of the first rotating shaft 910 and/or one end of the second rotating shaft 920.

The switching member 930 refers to a component of the switching device for a user to perform a switching operation. For example, the switching member 930 may include a button, a knob, a pull rod, or other structural members that are convenient for the user to operate.

In some embodiments, the switching member 930 may be connected with the first connecting assembly 940. The switching member 930 may drive the first connecting assembly 940 to move to change a connection state between the first rotating shaft 910 and the second rotating shaft 920, such that the switching device may be in different states, thereby realizing quick switching of different professional training modes of the fitness device.

The switching member may be configured to switch between a first state and a second state by driving the first rotating shaft to connect or separate from the second rotating shaft through a movement of the first connecting assembly. For example, the switching member 930 may drive the first connecting assembly 940 to move to cause the first rotating shaft 910 to be connected with the second rotating shaft 920, and when the first rotating shaft 910 is connected with the second rotating shaft 920, the switching device may be in a first state. The switching member 930 may be configured to be in the second state by driving the first rotating shaft 910 to separate from the second rotating shaft 920 through the movement of the first connecting assembly 940.

The first state and the second state are only used to describe a working state of the switching device. If the working state of the switching device changes, the professional training mode of the fitness device may change. For example, when the switching device is in the first state, the fitness device may be in a first mode (e.g., a strength training mode). As another example, when the switching device is in the second state, the fitness device may be in second mode (e.g., an aerobic training mode).

More descriptions regarding the switching device may be found in FIGS. 8A-11 and related descriptions thereof.

In some embodiments of the present disclosure, the first connecting assembly may be driven to move by the switching member such that the first rotating shaft and the second rotating shaft can be quickly connected or separated, and the training mode of the fitness device can be quickly switched to meet the different exercise needs of the user, thereby enhancing the user experience.

Figure 8A:
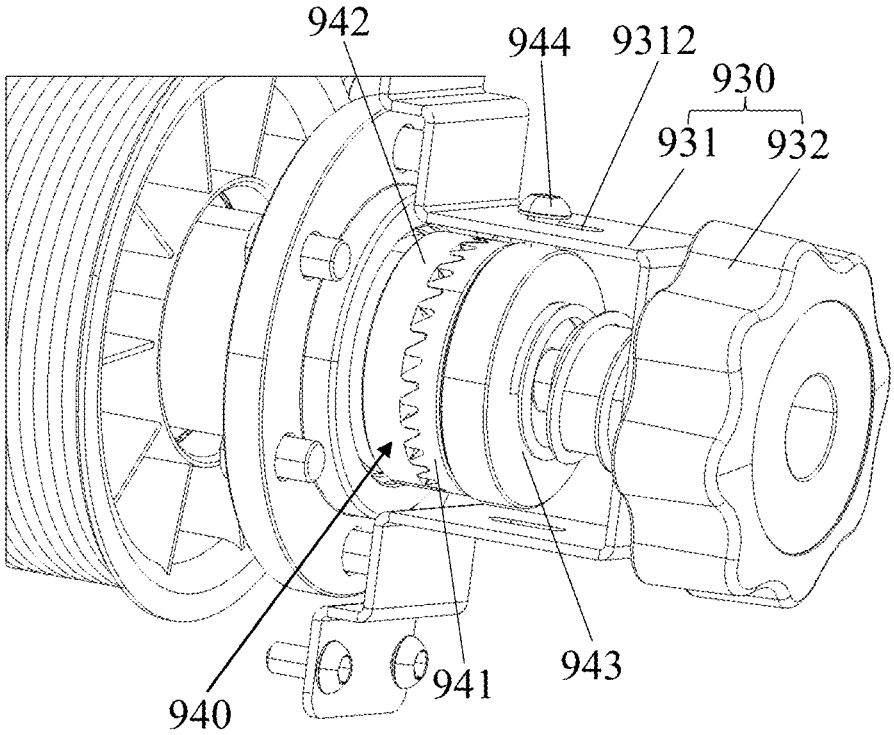
FIG. 8A is a structural diagram illustrating cooperation of an exemplary first connecting assembly and a switching member according to some embodiments of the present disclosure.
Figure 8B:
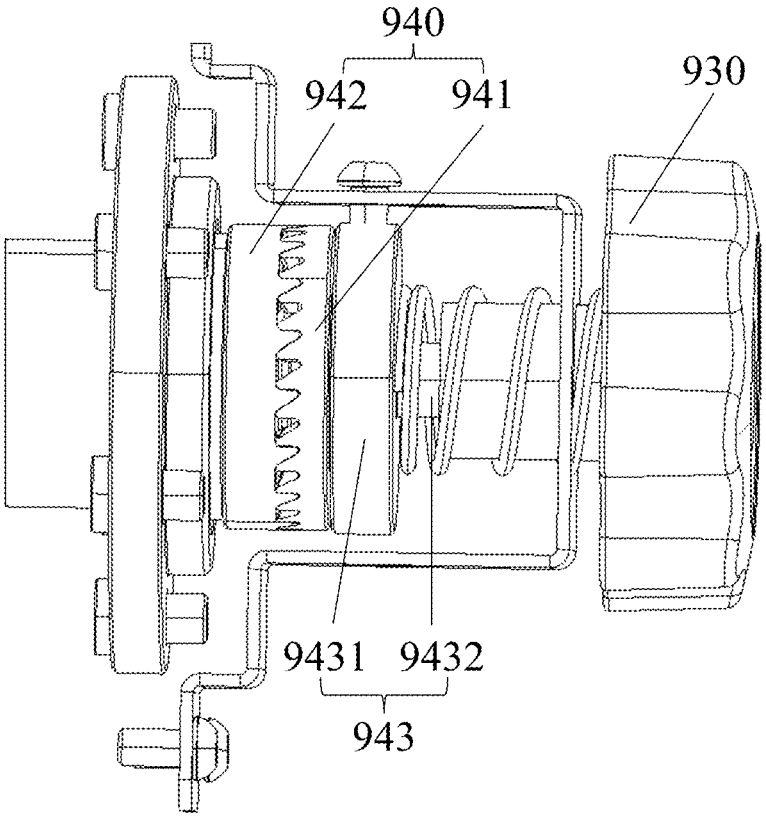
FIG. 8B is a structural diagram illustrating cooperation of an exemplary first connecting assembly and a switching member according to some embodiments of the present disclosure.
Figure 8C:
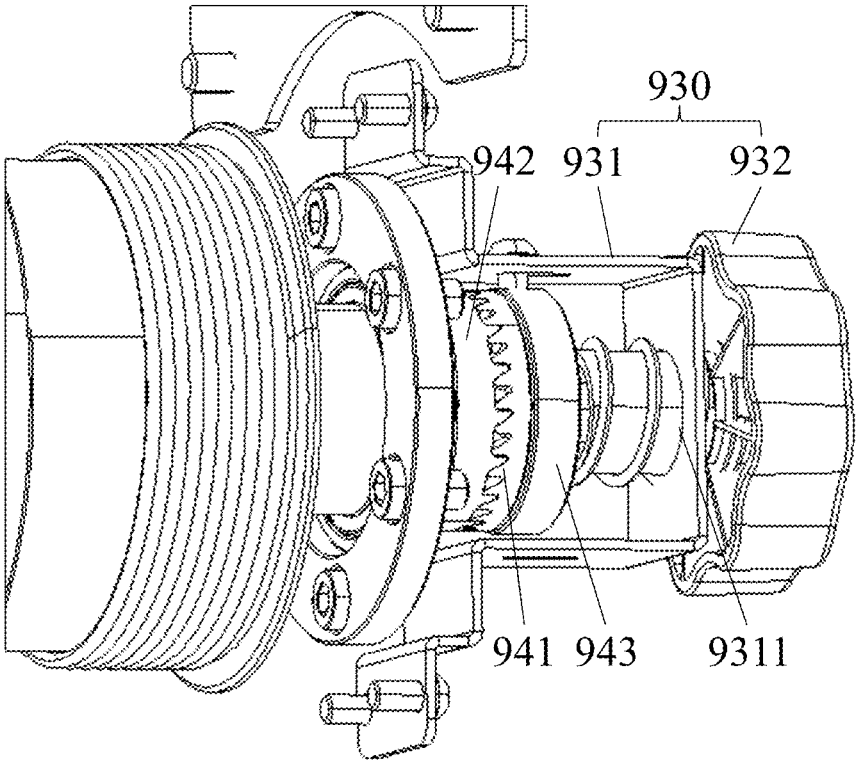
FIG. 8C is a structural diagram illustrating cooperation of an exemplary first connecting assembly and a switching member according to some embodiments of the present disclosure.

FIG. 8A is a structural diagram illustrating cooperation of an exemplary first connecting assembly and a switching member according to some embodiments of the present disclosure; FIG. 8B is a structural diagram illustrating cooperation of an exemplary first connecting assembly and a switching member according to some embodiments of the present disclosure; FIG. 8C is a structural diagram illustrating cooperation of an exemplary first connecting assembly and a switching member according to some embodiments of the present disclosure.

In some embodiments, as shown in FIGS. 8A-8C, the first connecting assembly 940 may include the first matching member 941 and a second matching member 942. The first matching member 941 may be disposed at an end of the first rotating shaft 910. The second matching member 942 may be disposed at an end of the second rotating shaft 920. The first matching member 941 and the second matching member 942 may be detachably connected. In some embodiments, the switching member 930 may be connected with the first matching member 941 or the second matching member 942. In some embodiments, the switching member 930 may be connected with the first matching member 941 and the second matching member 942 simultaneously.

The first matching member 941 refers to a portion of the first connecting assembly 940 disposed on the first rotating shaft 910. The second matching member 942 refers to a portion of the first connecting assembly 940 disposed on the second rotating shaft 920.

In some embodiments, the first matching member 941 and the second matching member 942 may be correspondingly arranged and may be detachably connected under the drive of the switching member 930. In some embodiments, the first matching member 941 may be movably disposed on the first rotating shaft 910, i.e., the first matching member 941 may move along the axial direction of the first rotating shaft 910, such that the switching member 930 may drive the first matching member 941 to move along the axial direction of the first rotating shaft 910 to be connected with or separated from the second matching member 942, and the first matching member 941 and the first rotating shaft 910 may not rotate relatively. Similar to the first matching member 941, the second matching member 942 may also be movably disposed on the second rotating shaft 920, and the switching member may drive the second matching member 942 to move. In some embodiments, the axial direction of the first rotating shaft 910 (or an axial direction of the second rotating shaft 920) may be represented by an X-direction indicated by the arrow in FIG. 7.

For example, the first matching member 941 may be a fixture block sleeving the first rotating shaft 910. The fixture block may be set in a groove extending along the axial direction of the first rotating shaft 910. The second matching member 942 may be a neck sleeving the second rotating shaft 920. The switching member 930 may be connected with the fixture block to drive the fixture block to move along the neck, such that the fixture block and the neck may cooperate with or separate from each other, thereby realizing the detachable connection between the first rotating shaft 910 and the second rotating shaft 920.

It should be noted that the structural form of the first matching member 941 and the second matching member 942 is not limited, as long as the first matching member 941 and the second matching member 942 can be driven to move by the switching member 930 to achieve the detachable connection.

In some embodiments, as shown in FIGS. 8A-8C, the first matching member 941 may include first meshing teeth, and the second matching member 942 may include second meshing teeth. When the switching member 930 drives the first matching member 941 and/or the second matching member 942 to move to cause the first meshing teeth to be engaged with the second meshing teeth, the switching device may be in the first state. When the switching member 930 drives the first matching member 941 and/or the second matching member 942 to move to cause the first meshing teeth to be separated from the second meshing teeth, the switching device may be in the second state.

The meshing teeth refer to one or more pairs of tooth structures that cooperate with each other. The meshing teeth may transmit motion or power through contact and interaction between the teeth.

The meshing teeth may have various structural shapes, such as spur teeth, helical teeth, spiral teeth, etc. In some embodiments, the first meshing teeth and the second meshing teeth may be arranged correspondingly. For example, the first meshing teeth and the second meshing teeth may both be the spur teeth. As another example, the first meshing teeth and the second meshing teeth may both be the helical teeth, etc.

In some embodiments, the meshing type of the first meshing teeth and the second meshing teeth is not limited, which may be internal meshing, external meshing, spur meshing, helical meshing, etc.

In some embodiments, the first meshing teeth may sleeve a right end (e.g., an end close to the switching member 930) of the first rotating shaft 910, and the second meshing teeth may sleeve a right end of the second rotating shaft 920. The first meshing teeth and the second meshing teeth may be engaged or separated under the action of the switching member 930, such that the first rotating shaft 910 and the second rotating shaft 920 may be detachably connected.

Figure 9:
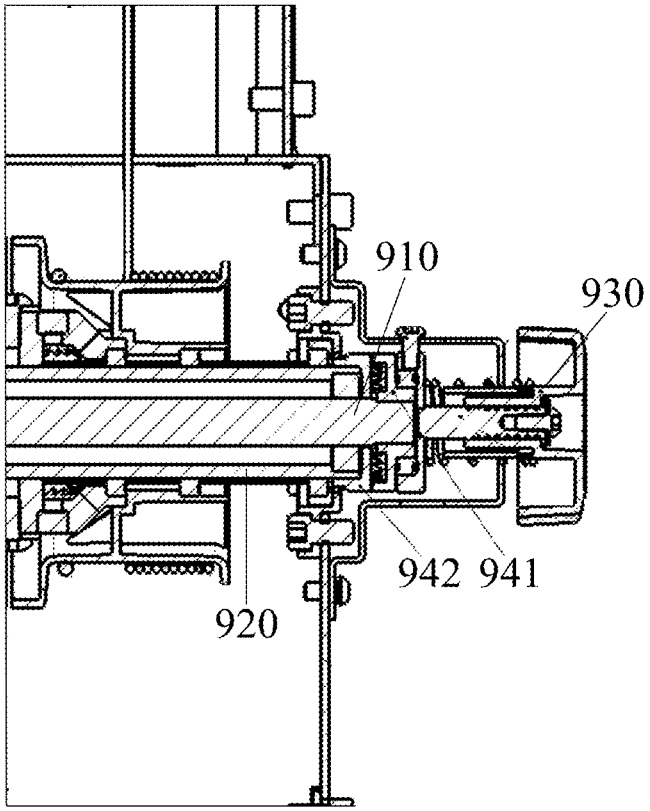
FIG. 9 is a structural diagram illustrating an exemplary meshing of first meshing teeth with second meshing teeth according to some embodiments of the present disclosure.
Figure 10:
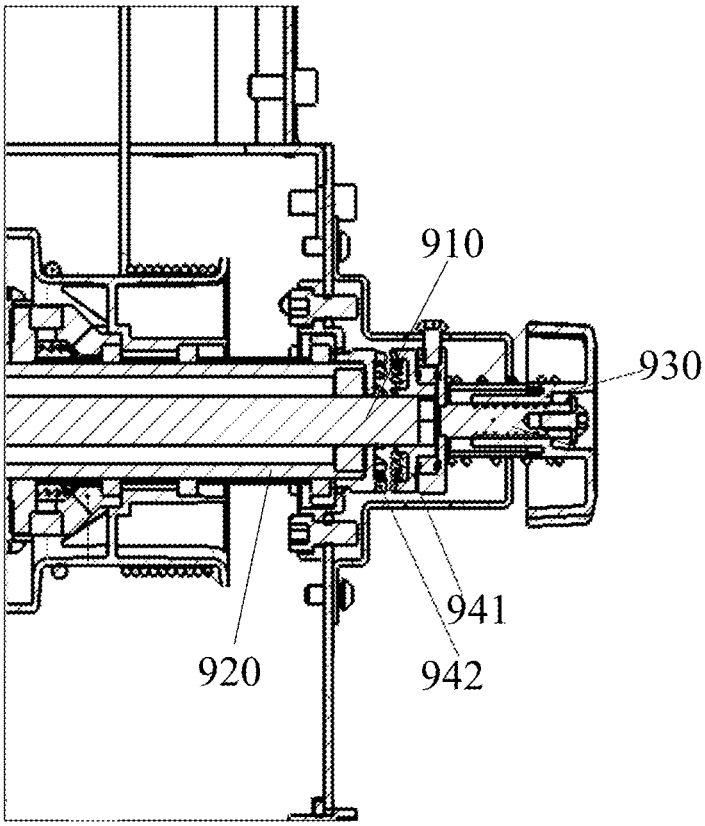
FIG. 10 is a structural diagram illustrating an exemplary separation of first meshing teeth from second meshing teeth according to some embodiments of the present disclosure.

FIG. 9 is a structural diagram illustrating an exemplary meshing of the first meshing teeth with the second meshing teeth according to some embodiments of the present disclosure. FIG. 10 is a structural diagram illustrating an exemplary separation of the first meshing teeth from the second meshing teeth according to some embodiments of the present disclosure. As shown in FIG. 9, when the first meshing teeth are meshed with the second meshing teeth, the first rotating shaft 910 may be connected with the second rotating shaft 920, and the switching device may be in the first state. As shown in FIG. 10, when the first meshing teeth are separated from the second meshing teeth, the first rotating shaft 910 may be disconnected from the second rotating shaft 920 (i.e., separated), and the switching device may be in the second state.

In some embodiments, the switching member 930 may be connected with the first meshing teeth and/or the second meshing teeth to drive the first meshing teeth and/or the second meshing teeth to move, such that the first meshing teeth may be engaged with or separated from the second meshing teeth. As shown in FIGS. 8A-8C, the switching member 930 may be connected with the first meshing teeth to drive the first meshing teeth to move, such that the first meshing teeth may be engaged with or separated from the second meshing teeth.

In some embodiments of the present disclosure, the meshing teeth may be adopted as the first matching member and the second matching member, and the first matching member and/or the second matching member may be driven to move by the switching member. On the premise of considering the convenience of separation, a tight connection between the first meshing teeth and the second meshing teeth during the meshing can be effectively ensured, thereby facilitating better transmission.

In some embodiments, the first matching member 941 (e.g., the first meshing teeth) and the second matching member 942 (e.g., the second meshing teeth) may be connected with the switching member 930 in a connection mode. Exemplary connection modes may include a snap connection, a welding connection, a riveting connection, etc.

More descriptions regarding the specific connection mode of the first matching member and the second matching member and the switching member may be found in the related descriptions below (e.g., FIG. 11).

Figure 11:
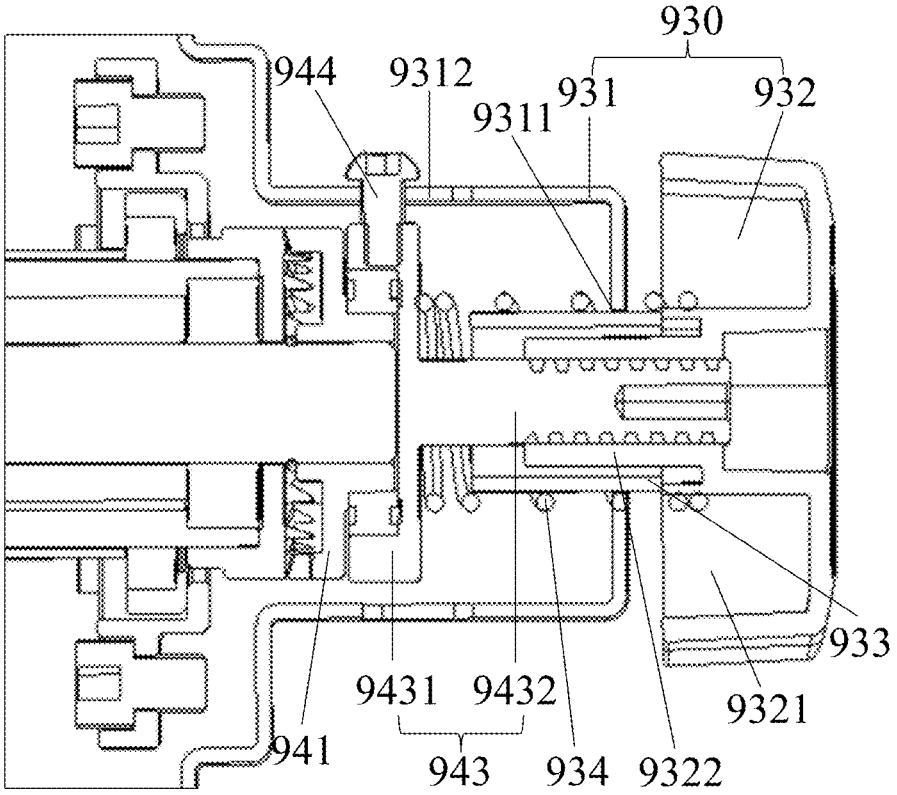
FIG. 11 is a schematic diagram illustrating an enlargement of a point A in FIG. 7.

In some embodiments, as shown in FIG. 11, the first rotating shaft 910 and the second rotating shaft 920 may be drivingly connected through a second connecting assembly 950, and may synchronously rotate in a first rotation direction through the second connecting assembly 950. The first rotating shaft 910 and the second rotating shaft 920 may be detachably connected through the first connecting assembly 940, and may synchronously rotate in the first rotation direction and a second rotation direction through the first connecting assembly 940. The first rotation direction may be opposite to the second rotation direction.

The second connecting assembly 950 refers to an assembly of the switching device for realizing a driving connection between the first rotating shaft 910 and the second rotating shaft 920. The driving connection refers to a connection mode for transmitting power or motion. Exemplary driving connection modes may include gear driving, belt driving, chain driving, coupling driving, bearing driving, universal joint driving, etc.

In some embodiments, the second connecting assembly 950 may include a one-way bearing. The first rotating shaft 910 may sleeve the second rotating shaft 920 through the one-way bearing.

The one-way bearing, also referred to as an overrunning clutch or a freewheel bearing, is a mechanical element that allows a shaft to rotate in one direction while locking in another direction. In some embodiments, the one-way bearing may include an inner ring, an outer ring, and some elements (e.g., balls or rollers) that roll freely between the inner ring and the outer ring. In a normal working direction (e.g., the first rotation direction), the rolling elements may roll between the inner ring and the outer ring to achieve low-friction rotation. In an opposite direction (e.g., the second rotation direction), the rolling elements may be blocked by a locking mechanism (e.g., a spring-loaded wedge block) to prevent the outer ring from rotating.

In some embodiments, the one-way bearing may be clamped at the left end (an end away from the switching member 930) of the second rotating shaft 920, and the n outer wall of the outer ring of the one-way bearing may abut against the inner wall of the second rotating shaft 920. The left end of the first rotating shaft 910 may penetrate through the inner ring of the one-way bearing, and the inner wall of the inner ring of the one-way bearing may abut against the outer wall of the first rotating shaft 910, thereby realizing that the first rotating shaft 910 sleeves the second rotating shaft 920.

In some embodiments, when the switching member 930 drives the first connecting assembly 940 (e.g., the first matching member 941 and/or the second matching member 942) to cause the first rotating shaft 910 to be connected with the second rotating shaft 920, it is equivalent to that the first connecting assembly 940 and the second connecting assembly 950 may be simultaneously connected with the first rotating shaft 910 and the second rotating shaft 920. In this case, the first rotating shaft 910 and the second rotating shaft 920 may be regarded as a whole, and may realize bidirectional synchronous rotation (e.g., synchronous rotation in the first rotation direction and the second rotation direction) under the action of an external force.

Figure 12:
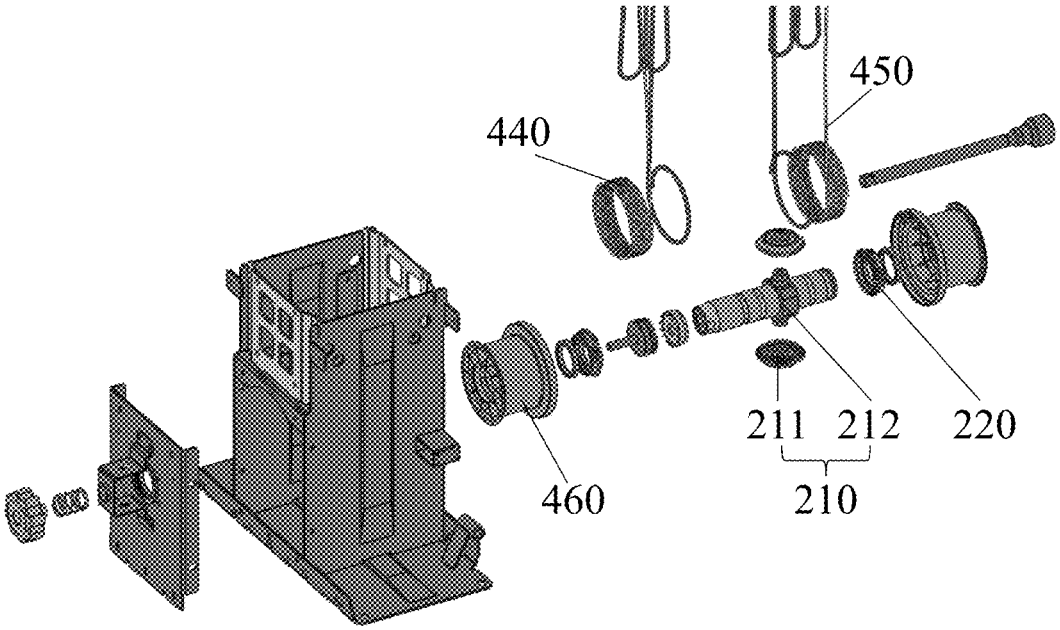
FIG. 12 is an explosion structural diagram illustrating a fitness device according to some embodiments of the present disclosure.
Figure 13:
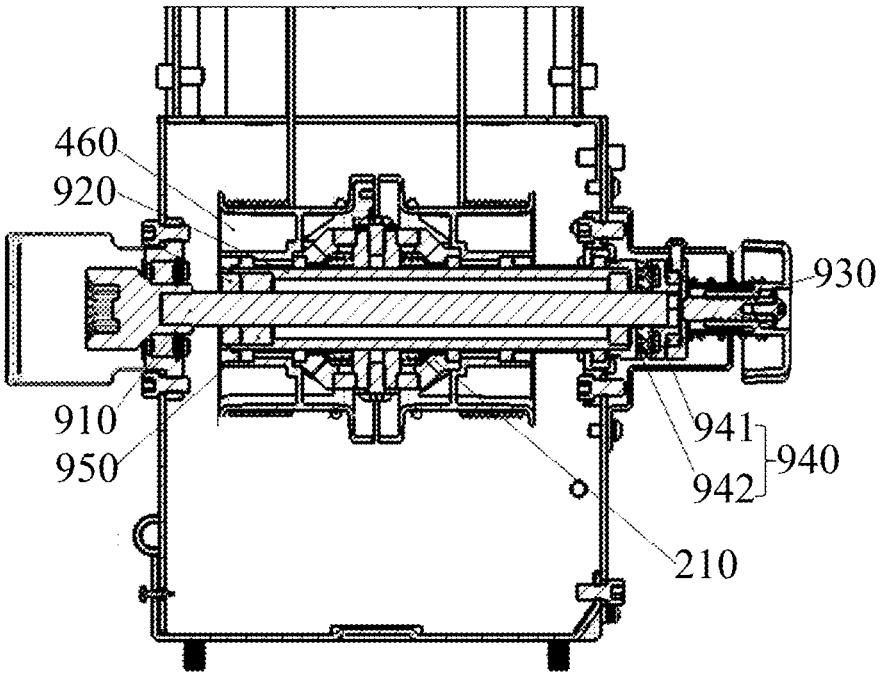
FIG. 13 is a structural diagram illustrating an exemplary fitness device according to some embodiments of the present disclosure.

In order to more clearly illustrate that the first rotating shaft 910 and the second rotating shaft 920 are detachably connected through the first connecting assembly 940, and can synchronously rotate in the first rotation direction and the second rotation direction through the first connecting assembly 940, some embodiments of the present disclosure will be described with reference to the actual application scenario of the switching device in the fitness device. As shown in FIGS. 12-13, the fitness device (or the fitness equipment 600 shown in FIGS. 2-6) may include the pull rope 440 and the elastic rope 450, and a user may perform training by pulling the pull rope 440. When the user pulls the pull rope 440 and the elastic rope 450 to drive the pull wheel assembly 460 to rotate, and the rotation of the pull wheel assembly 460 drives the central gear assembly 210 to rotate, the switching member 930 may drive the first connecting assembly 940 to move, such that the first rotating shaft 910 may be connected with the second rotating shaft 920 (i.e., the first connecting assembly 940 and the second connecting assembly 950 may be simultaneously connected with the first rotating shaft 910 and the second rotating shaft 920). The first rotating shaft 910 and the second rotating shaft 920 may be regarded as a whole, and a power device may provide resistance (i.e., a force in an opposite direction to the force applied by the user. In this case, the rotation directions of the first rotating shaft 910 and the second rotating shaft 920 may be opposite to the rotation direction of the pull wheel assembly 460) to the central gear assembly 210 through the first rotating shaft 910 and the second rotating shaft 920. When the user releases the force applied to the pull rope 440, the power device may provide resistance to the pull wheel assembly 460 through the first rotating shaft 910 and the second rotating shaft 920 (in this case, the rotation directions of the first rotating shaft 910 and the second rotating shaft 920 may be the same as the rotation direction of the pull wheel assembly 460), and the pulled pull rope 440 may be rewound around the pull wheel assembly 460, and the elastic rope 450 may be rewound on the pull wheel assembly 460, and the elastic rope 450 may reset following the pull wheel assembly 460. Since the bevel gear 220 is meshed with the central gear assembly 210, a torque may be transmitted in both forward and backward directions, and the pull rope 440 may be subjected to the resistance provided by the power device through the first rotating shaft 910 and the second rotating shaft 920 when the pull rope 440 is pulled out and recovered.

More descriptions regarding the fitness device may be found elsewhere in the present disclosure (e.g., FIGS. 12-13).

In some embodiments, when the switching member 930 drives the first connecting assembly 940 (e.g., the first matching member 941 and/or the second matching member 942) to move to cause the first rotating shaft 910 to be separated from the second rotating shaft 920, it is equivalent to that only the second connecting assembly 950 may be connected with the first rotating shaft 910 and the second rotating shaft 920. In this case, since the second connecting assembly 950 includes a one-way bearing, based on the working principle of the one-way bearing, the first rotating shaft 910 and the second rotating shaft 920 may only achieve one-way synchronous rotation (e.g., synchronous rotation in the first rotation direction) under the action of an external force.

Similarly, in order to more clearly illustrate that the first rotating shaft 910 and the second rotating shaft 920 are drivingly connected through the second connecting assembly 950, and can synchronously rotate in the first rotating direction through the second connecting assembly 950, some embodiments of the present disclosure will be described with reference to the actual application scenario of the switching device in the fitness equipment. As shown in FIGS. 12-13, when the user pulls the pull rope 440 and the elastic rope 450 to drive the pull wheel assembly 460 to rotate, and the rotation of the pull wheel assembly 460 drives the central gear assembly 210 to rotate, the switching member 930 may drive the first connecting assembly 940 to move, and the first rotating shaft 910 may be separated from the second rotating shaft 920 are separated, which is equivalent to that only the second connecting assembly 950 may be connected with the first rotating shaft 910 and the second rotating shaft 920. The power device may provide resistance to the central gear assembly 210 through the first rotating shaft 910 and the second rotating shaft 920, i.e., the user may be subjected to the resistance provided by the power device while pulling out the pull rope 440. When the user releases the force applied to the pull rope 440, since the second connecting assembly 950 is a one-way bearing, the power device cannot provide resistance to the pull wheel assembly 460 through the first rotating shaft 910 and the second rotating shaft 920. In this case, the pull wheel assembly 460 may be mainly driven by a rebound force of the elastic rope 450 to rewind the pulled pull rope 440 around the pull wheel assembly 460. At this time, the pull rope 440 may be subjected to the resistance when being pulled out, and may not be subjected to the resistance when being recovered.

The first rotation direction and the second rotation direction may be two opposite directions. For example, the first rotation direction may be a clockwise rotation direction around an axial direction (or an axial direction of the second rotating shaft 920) of the first rotating shaft 910, and the second rotation direction may be a counterclockwise rotation direction around the axial direction of the first rotating shaft 910. The axial direction of the first rotating shaft 910 may be a horizontal direction.

In some embodiments, the second connecting assembly 950 may also be any other feasible structural member that can realize the driving connection between the first rotating shaft 910 and the second rotating shaft 920 through the structural member, and can synchronously rotate in the first rotation direction through the structural member.

FIG. 11 is a schematic diagram illustrating an enlargement of a point A in FIG. 7.

In some embodiments, as shown in FIGS. 8A-8C and FIG. 11, the switch member 930 may include a switch member housing 931 and a switch button 932. The switch button 932 may be at least partially disposed in the switch member housing 931. The first matching member 941 and the second matching member 942 may be disposed in the switch member housing 931, and the first matching member 941 may be connected with the switch button 932 through a connecting component 943. In some embodiments, the first matching member 941 and the connecting component 943 may be rotatably contacted or connected, i.e., when the first matching member 941 rotates, the connecting component 943 may not simultaneously rotate with the first matching member 941.

The switch member housing 931 refers to a structural member that covers the first matching member 941 and the second matching member 942. In some embodiments, the switch member housing 931 may be configured to support or reinforce the first matching member 941 and the second matching member 942 to ensure the connection stability when the first matching member 941 and the second matching member 942 are connected.

In some embodiments, as shown in FIGS. 8A-11, the switch member housing 931 may be provided with a central hole 9311 along the axial direction of the first rotating shaft 910 (or the axial direction of the second rotating shaft 920). The connecting component 943 may penetrate through the central hole 9311 to be connected with the switch button 932 to realize the connection between the first matching member 941 and the switch button 932. An exemplary fixed connection mode may include, but is not limited to, a threaded connection, a snap connection, a riveting connection, etc.

The switch button 932 refers to a structural member of the switch member 930 for the user to perform a switching operation. For example, the switch button 932 may include a knob, a pull rod, etc.

In some embodiments, as shown in FIGS. 8A-8C and FIG. 11, the switch button 932 may include a button cover 9321 and a button rod 9322. The button cover 9321 may be disposed at one end (e.g., a right end) of the button rod 9322. The button cover 9321 and the button rod 9322 may integrated to form the switch button 932, or may be connected to form the switch button 932 through the threaded connection, the welding connection, etc.

The button cover 9321 refers to a structural member for the switch button 932 to directly contact with the user. In some embodiments, the button cover 9321 may be provided with an element, such as threads, curved surface patterns, or stripes to increase friction and facilitate user operation.

The button rod 9322 refers to a structural member used for the switch button 932 to connect with the first matching member 941. In some embodiments, as shown in FIG. 11, the button rod 9322 may be a hollow structure. The connecting component 943 may be at least partially inserted into the hollow structure to achieve the connection between the first matching member 941 and the switch button 932.

The connecting component 943 refers to a structural member used to connect the first matching member 941 with the switch button 932. In some embodiments, as shown in FIG. 8B and FIG. 11, the connecting component 943 may include a connecting sleeve 9431 and a connecting rod 9432. The connecting sleeve 9431 may be configured to be rotatably connected with the first matching member 941. The connecting rod 9432 may be connected with the button rod 9322.

In some embodiments, the connecting sleeve 9431 may be rotatably connected with the first matching member 941 in a connection mode. Exemplary connection modes may include: providing a ball bearing between the connecting sleeve 9431 and the first matching member 941, setting a universal joint structure in the connection between the connecting sleeve 9431 and the first matching member 941, etc.

In some embodiments, the connecting rod 9432 may be connected with the switch button 932 in various ways. Merely by way of example, as shown in FIG. 11, the button rod 9322 of the switch button 932 may be a hollow structure, and internal threads may be provided in the hollow structure. The connecting rod 9432 may be correspondingly provided with external threads. The external threads on the connecting rod 9432 may be cooperated with the internal threads in the hollow structure of the button rod 9322 to tightly connect the connecting rod 9432 with the switch button 932. It is understood that the connecting rod 9432 may also be a hollow structure provided with the internal threads, and the button rod 9322 may also be a rod structure correspondingly provided with the external threads.

In some embodiments, the switch button 932 may also penetrate through a center of the button cover 9321 through a bolt or screw or other connecting member to connect with the connecting rod 9432, thereby achieving further connection with the first matching member 941.

In some embodiments, as shown in FIG. 11, a bushing 933 may sleeve outside the button rod 9322. The bushing 933 may be sleeved with an elastic member 934. The bushing 933 may be disposed in the central hole 9311. One end of the elastic member 934 may be connected with the button cover 9321, and the other end of the elastic member 934 may abut against the connecting sleeve 9431.

The elastic member 934 refers to a material or component that can deform under the action of an external force and return to the original shape after the external force is removed. The elastic member is usually made of an elastic material, such as spring steel, rubber, polyurethane, polytetrafluoroethylene (PTFE), etc. An exemplary elastic member 934 may include a spring, a corrugated pipe, a washer, etc.

In some embodiments, a clearance may be provided between the bushing 933 and the button rod 9322 to facilitate smoother movement of the button rod 9322. The bushing 933 and the elastic member 934 may be provided to ensure stability during user operation when the user rotates the switch button 932 to push the first matching member 941 to move through the connecting component 943.

In some embodiments, as shown in FIG. 8A and FIG. 11, a positioning hole 9312 may be provided in the switching member housing 931. A positioning member 944 may be provided in the positioning hole 9312. The positioning member 944 may move in the positioning hole 9312 along the axial direction of the first rotating shaft 910 (or the axial direction of the second rotating shaft 920) under the drive of the switching button 932.

The positioning hole 9312 and the positioning member 944 may be configured to limit a movement distance of the first matching member 941 and may be used to indicate whether the first matching member 941 moves to the place. In some embodiments, the shape of the positioning hole 9312 may match the shape of the outer contour of the positioning member 944. For example, when the positioning member 944 is a cylindrical screw, the positioning hole 9312 may be a round hole with semicircular ends.

In some embodiments, a length of the positioning hole 9312 in the axial direction of the first rotating shaft 910 may be determined according to a size of the positioning member 944 and the movement distance of the first matching member 941. The movement distance of the first matching member 941 may be determined based on a size of the first matching member 941. For example, when the first matching member 941 includes first meshing teeth, the greater the tooth height of the first meshing teeth, the greater the movement distance required for the first matching member 941 to ensure that the first matching member 941 and the second matching member 942 can be successfully connected or separated.

In some embodiments, one end of the positioning member 944 may penetrate through the positioning hole 9312 to be connected with the connecting component 943 (e.g., the connecting sleeve 9431). When the switch button 932 drives the first matching member 941 to move through the connecting component 943, the positioning member 944 may move synchronously in the positioning hole 9312. When the positioning member 944 contacts with a left inner wall of the positioning hole 9312, the first matching member 941 may be connected with the second matching member 942. When the positioning member 944 contacts with a right inner wall of the positioning hole 9312, the first matching member 941 may be separated from the second matching member 942.

In some embodiments of the present disclosure, the positioning hole and the positioning member may be provided to limit the movement distance of the first matching member, thereby preventing the switching member from driving the first matching member and/or the second matching member to move excessively. The first matching member (e.g., the first meshing teeth) and the second matching member (e.g., the second meshing teeth) are ensured to be tightly connected without causing damage to the meshing teeth, and the separation speed or efficiency of the first matching member and the second matching member can be improved to a certain extent.

FIG. 12 is an explosion structural diagram illustrating a fitness device according to some embodiments of the present disclosure. FIG. 13 is a structural diagram illustrating an exemplary fitness device according to some embodiments of the present disclosure.

As shown in FIGS. 12-13, the fitness device may include a switching device for the fitness device. When the switching device is in a first state, the fitness device may be in a first mode. When the switching device is in a second state, the fitness device may be in a second mode.

The fitness device may include fitness equipment for strength training and fitness equipment for aerobic training. In some embodiments, the first state of the switching device may correspond to a strength training mode (i.e., the first mode) of the fitness device (or the fitness equipment 600). In the training mode, a user may need to resist greater resistance during exercise and the training intensity may be high. In some embodiments, the second state of the switching device may correspond to an aerobic training mode (i.e., the second mode) of the fitness device (or the fitness equipment 600). In the training mode, the user may need to resist less resistance during exercise and the training intensity may be low.

As shown in FIGS. 12-13, the fitness device may further include the gear assembly 210, the bevel gear 220, and the pulley assembly 460. The gear assembly 210 may include the fixed gear 211 and the positioning pin 212. The positioning pin 212 may sleeve the second rotating shaft 920 of the switching device. The rotation axis of the fixed gear 211 may be perpendicular to an axial direction of the second rotating shaft 920. The pulley assembly 460 may be connected with the central gear assembly 210 by meshing the bevel gear 220 with the fixed gear 211.

In some embodiments, the fitness device may further include a resistance module (not shown in the figure). The resistance module may include a power device. More descriptions regarding the power device may be found in the present disclosure above.

In some embodiments, the power device may be connected with the first rotating shaft 910 of the switching device to provide resistance or a braking torque to the fitness device. An exemplary connection mode may include using a connector, a coupler, etc.

As described above, the switching device for switching the training mode of the fitness device can switch the state. In some embodiments, as shown in FIG. 7, the switching device may include the first rotating shaft 910, the second rotating shaft 920, and the switching member 930. The second rotating shaft 920 may sleeve outside the first rotating shaft 910. The first rotating shaft 910 and the second rotating shaft 920 may be detachably connected through the first connecting assembly 940. The switching member 930 may drive the first connecting assembly 940 to move, such that the first rotating shaft 910 may be connected with the second rotating shaft 920, and the switching device may be in a first state. The switching member 930 may drive the first connecting assembly 940 to move, such that the first rotating shaft 910 may be separated from the second rotating shaft 920, and the switching device may be in a second state.

In some embodiments, the switching device may further include the second connecting assembly 950. The first rotating shaft 910 and the second rotating shaft 920 may be drivingly connected through the second connecting assembly 950, and may synchronously rotate in the first rotation direction through the second connecting assembly 950. In some embodiments, the second connecting assembly 950 may include a one-way bearing. The first rotating shaft 910 may sleeve the second rotating shaft 920 through the one-way bearing.

In some embodiments, the switching member 930 may drive the first connecting assembly 940 to move, such that the first rotating shaft 910 may be connected with the second rotating shaft 920. The power device and the pull wheel assembly 460 may be drivingly connected through the first connecting assembly 940 and the second connecting assembly 950. In this case, the first rotating shaft 910, the second rotating shaft 920 and the pull wheel assembly 460 may rotate synchronously in the first rotation direction and the second rotation direction. The power device may provide bidirectional resistance to the fitness device, the switching device may be in the first state, and the fitness equipment is in the second mode.

In some embodiments, the switching member 930 may drive the first connecting assembly 940 to move to cause the first rotating shaft 910 to be separated from the second rotating shaft 920, and the power device may be drivingly connected with the pull wheel assembly 460 through the second connecting assembly 950. In this case, the first rotating shaft 910, the second rotating shaft 920, and the pull wheel assembly 460 may only rotate synchronously in the first rotation direction, the power device may provide unidirectional resistance to the fitness device, the switching device may be in the second state, and the fitness device may be in the second mode.

More descriptions regarding the switching device may be found in the related descriptions above (e.g., FIGS. 7-11).

In some embodiments of the present disclosure, the fitness device can switch between two or more different modes by switching different states of the device. Such setting enables a single device to meet multiple training needs, thereby improving the functionality and use efficiency of the device.

In some embodiments, a fitness device may further include a physiological monitoring device, a motion monitoring device, and a controller. The controller may be configured to control mode switching of the training modes of the fitness equipment by controlling state switching of the switching device.

The physiological monitoring device refers to a device configured to monitor physiological monitoring data (e.g., heart rate, blood pressure, blood oxygen) of the user. The physiological monitoring device may be disposed at a position where the user is in contact with the fitness equipment 600. The motion monitoring device refers to a device configured to obtain motion data (e.g., a tensile force, a speed, or a count of times) of the user. For example, the motion monitoring device may include a displacement sensor, a speed sensor, and a tension sensor mounted on the pull rope or the elastic rope for monitoring the motion and tensile force of the pull rope. The sensors may determine a complete rope-pulling action by measuring changes of the speed, displacement, or tensile force of the rope-pulling motion, thereby counting the count of times the rope is pulled.

In some embodiments, the switching device may further include a drive motor. The drive motor may be connected with the switching mechanism 100, for example, the drive motor may be connected with the toggle member 120, so as to control the state switching of the switching device.

Some embodiments of the present disclosure further provide a method for switching a training mode, which may be applied to the above fitness device. The switching method may include extracting a motion feature of the user based on the motion data obtained by the motion monitoring device; determining a motion state of the user based on the physiological monitoring data obtained by the physiological monitoring device and the motion feature; and determining whether to switch the training mode of the fitness equipment 600 of the fitness device based on the motion state.

In some embodiments, the motion data may include a sequence of tensile force/speed during training. The motion feature may include a sequence including a frequency of a target behavior per unit of time, the time consumption of the target behavior, and the stability degree of the target behavior. The target behavior refers to a preset target exercise behavior, and the target behavior may be related to a type of fitness equipment 600. For example, if for the fitness equipment 600, training of different postures or actions may be completed by pulling the rope, the target behavior may be pulling the rope without distinguishing the specific action of pulling the rope. The controller may extract a count of cycles of the tensile force/speed change per unit time based on the tensile force/speed sequence during the training, and determine the count of cycles as the frequency of the target behavior per unit of time. For example, the frequency of the target behavior per unit time may be a count of times the rope is pulled in 1 minute. The time consumption of the target behavior refers to the time it takes the user to complete the last complete target behavior. The consumption time of the target behavior may be obtained by querying history. The stability degree of the target behavior may be used to characterize the stability degree of the strength or speed of the user during training. The stability degree of the target behavior may be obtained through statistical analysis. For example, the stability degree of the tensile force of the target behavior refers to a standard deviation of a plurality of tensile force values when the target behavior is completed.

In some embodiments, the motion state of the user may be expressed as a motion degree. In some embodiments, the more tired the user is, the smaller the value of the motion degree may be. In some embodiments, the controller may determine the motion degree. The controller may calculate a first similarity degree by comparing the physiological monitoring data with reference physiological data, and calculate a second similarity degree by comparing the motion feature with a reference motion feature. The current motion degree of the user is equal to (a×first similarity degree+b×second similarity degree), where a and b are preset weights.

In some embodiments, the reference physiological data may be obtained by obtaining the physiological monitoring data of the user during a time period T1~T2 in which a plurality of consecutive target behaviors are completed and taking an average value of each indicator of the physiological monitoring data of the user between T1 and T2 as a value of each indicator of the reference physiological data. In some embodiments, the reference motion feature may be obtained by: obtaining the motion data of the user during the time period T1~T2 in which the plurality of consecutive target behaviors are completed, extracting the motion feature, and taking an average value of each indicator of the motion feature of the user between T1 and T2 as a value of each indicator of the reference motion feature. For example, if the motion feature is the time consumption of the target behavior, and after a preset time from the start of the training, a time consumed to complete the plurality of consecutive target behaviors may be obtained and an average value of time consumption of each target behavior may be calculated, and the average value of time consumption may be used as the reference motion feature.

In some embodiments, the controller may determine whether to switch the training mode of the fitness equipment 600 based on the motion degree. For example, in the strength training mode, when the motion degree of the user is smaller than a first threshold, the strength training mode may be switched to the aerobic training mode. In the aerobic training mode, when the motion degree of the user is greater than a second threshold, the aerobic training mode may be switched to the strength training mode. The first threshold may be smaller than the second threshold. When the value of the current motion degree of the user in the strength training mode is lower, it may indicate that the user may be in a state of fatigue, and at this time, the resistance may need to be reduced and appropriate relaxation may need to be carried out. Therefore, the strength training mode may be switched to the aerobic training mode. At the same time, when the current motion degree of the user is relatively easy for the user in the aerobic training mode, the motion degree may be appropriately enhanced, and the aerobic training mode may be switched to the strength training mode. The first threshold and the second threshold may be values manually set based on experience.

In some embodiments, the user may set a switching time between the two modes voluntarily. The switching time may be directly determined based on a training goal input by the user according to a preset relationship. The training goal input by the user may be set in advance in the system and selected by the user, such as muscle gain or weight loss; or the training goal may be a specific goal value input by the user, such as a motion duration or a muscle gain weight. The preset relationship may be a correspondence between the training goal and the motion mode and motion time set in advance in the system. In some embodiments, the user may preset a switching frequency of the strength training mode and the aerobic training mode. In some embodiments, the user may input via software communicatively connected with the fitness equipment 600. In some embodiments, the user may achieve mode switching via a button, an interactive screen, or a voice acquisition system of the fitness equipment 600.

In some embodiments, the controller may adjust the resistance module of the fitness equipment 600 in response to the motion state not meeting a preset condition. The adjusting the resistance of the resistance module may be to increase the resistance or to decrease the resistance. In some embodiments, the adjustment of the resistance of the resistance module may be related to mode switching. For example, the resistance may be increased in the aerobic training mode, and the resistance may be further increased in the strength training mode when the aerobic training mode is switched to the strength training mode.

In some embodiments, in the strength training mode, after the strength training mode is conducted for a preset time period, and if the preset condition is that the first threshold<the motion degree of the user<a third threshold, and the controller controls the resistance module to decrease the resistance, it may indicates that the mode switching condition has not been reached, but the user is still relatively tired, and the resistance may need to be decreased; or if the preset condition is that the motion degree of the user>the third threshold, and the controller controls the resistance module to increase the resistance, it may indicate that the mode switching condition has not been reached, and the user is in a relatively relaxed state, and thus the resistance may need to be increased.

In some embodiments, in the aerobic training mode, after the aerobic training mode is conducted for the preset time period, and if the preset condition is that a fourth threshold<an ease degree of motion of the user<the second threshold, and the controller controls the resistance module to increase the resistance, it may indicates that the mode switching condition has not been reached and the user is in a relatively easy state, and thus the resistance may need to be increased; or if the preset condition is that 0<the ease degree of motion of the user<the fourth threshold, and the controller controls the resistance module to decrease the resistance, it may indicate that the user is a little bit tired, and thus the resistance may need to be decreased. A relationship may be that the first threshold<the second threshold<the third threshold<the fourth threshold. The third threshold and the fourth threshold may be values manually set based on experience. The adjustment of the resistance of the resistance module may be obtained by a preset correspondence between the motion degree of the user and an amount of resistance adjustment. The correspondence may be set manually based on experience.

In some embodiments of the present disclosure, the mode may be switched and the resistance of the resistance module may be changed through the training intensity of the user, which may make the current motion intensity of the fitness equipment 600 suitable for the current state of the user to satisfy an exercise need of a customer and prevent the user from being in a excessive fatigue state, thereby reducing the risk of injury to the user and improving the exercise experience of the user.

FIG. 7 is a structural diagram illustrating an exemplary resistance module according to some embodiments of the present disclosure. FIG. 8 is a diagram illustrating an exemplary internal structure of a resistance module according to some embodiments of the present disclosure. FIG. 9 is a diagram illustrating an exemplary partial structure of a resistance module and a fitness equipment according to some embodiments of the present disclosure.

In some embodiments, as shown in FIGS. 7-FIG. 9, the resistance module 500 may include a housing 510, a power device 520, and a transmission mechanism 530. In some embodiments, the transmission mechanism 530 may include a connecting shaft 531. The connecting shaft 531 may be configured to be drivingly connected with different fitness equipment. The power device 520 may provide resistance to the fitness equipment through the connecting shaft 531. In some embodiments, the fitness equipment may include a strength training station, a rowing machine, a ski machine, etc.

The housing 510 refers to a housing of the resistance module 500, and the housing 510 may provide support for other components of the resistance module 500 and protect an internal component of the resistance module 500. The material of the housing 510 may be metal, plastic, or other material that is strong enough to support the internal component of the resistance module 500.

In some embodiments, a handle 511 may be disposed of outside the housing 510, and a fixed plate 512 may be disposed of inside the housing 510. The handle 511 may be configured to facilitate a user to lift the resistance module 500 to mount the resistance module 500 on the different fitness equipment. The fixed plate 512 may be configured to mount the one or more internal components of the resistance module 600. In some embodiments, the power device 520 and the transmission mechanism 530 may be mounted on the fixed plate 512. A cooling fan 513 may be disposed on the fixed plate 512. The cooling fan 513 may be configured to dissipate heat from the resistance module 500.

The power device 520 refers to a device that may provide mechanical or electrical energy for the resistance module 500. In some embodiments, the power device 520 may include a motor assembly 521, a resistor 522, and a controller 523. The motor assembly 521 may be configured to provide resistance to the fitness equipment 600.

In some embodiments, the motor assembly 521 may include a motor stator, a magnet, a motor rotor, an encoder, etc. The resistor 522 may be configured to regulate an output of the motor assembly 521, and a magnitude of the output may correspond to a magnitude of the resistance provided by the resistance module 500 for the fitness equipment 600. In some embodiments, the resistor 522 may include a metal resistor, a cement resistor, or the like, or any combination thereof. The controller 523 may control a parameter (e.g., the output or a speed) of the motor assembly 521 to control the resistance provided for the fitness equipment 600. The controller 523 may be configured to process data from at least one component of resistance module 500 or an external data source. In some embodiments, the controller 523 may include a central processing unit (CPU), an application specific integrated circuit (ASIC), or the like, or any combination thereof.

In some embodiments, the power device 520 may further include a power source. A type of power source may include a plug-in power source or a battery. The battery may include a rechargeable battery 524. The plug-in power source may include a power switch 525 and a power port 526. The power port 526 may be connected with an external power source via a power cord. The power switch 525 may be configured to turn on and turn off the motor assembly 521.

The transmission mechanism 530 refers to a mechanism that transfers power of the power device 520 to the fitness equipment 600. In some embodiments, the transmission mechanism 530 may include a positioning shaft 601. In some embodiments, the connecting shaft 531 may be concentric with a rotating shaft of a gantry of the fitness equipment 600 through the positioning shaft 601. An end of the positioning shaft 601 may be provided with shaft teeth, and an end of the connecting shaft 531 may be provided with shaft teeth that match the shaft teeth of the positioning shaft 601, so that the positioning shaft 601 may mesh with the connecting shaft 531 via teeth.

In some embodiments, as shown in FIG. 9, the connecting shaft 531 may include a shaft sleeve for inserting the positioning shaft 601. The end of the connecting shaft 531 may be provided with the shaft teeth, and an outer side of the positioning shaft 601 may be provided with a shaft teeth sleeve 602 that matches the connecting shaft 531, so that the positioning shaft 601 may mesh with the connecting shaft 531 via the shaft tooth sleeve 602 meshing with the shaft teeth of the connecting shaft 531 after the positioning shaft 601 is inserted into the connecting shaft 531. In some embodiments, the positioning shaft 601 may be a component fixedly disposed on the gantry of the fitness equipment 600.

In some embodiments of the present disclosure, the transmission mechanism may be disposed so that the resistance module may be activated after being connected with the fitness equipment through the connecting shaft. The rotating shaft of the gantry of the fitness equipment may move synchronously with the connecting shaft, so as to provide resistance for fitness training of the user.

For the resistance module provided by some embodiments of the present disclosure, a function such as power provision and resistance adjustment may be integrated into a resistance module. The resistance module may be connected with the different fitness equipment through the connecting shaft and the connecting shaft may be further concentric with the rotating shaft of the gantry of the fitness equipment through the positioning shaft, so as to better provide resistance for the different fitness equipment. For example, the resistance module may be connected with different gantries such as a rowing machine, a ski machine, and an integrated strength training station, etc., which may provide power to the user by replacing a traditional system such as a traditional wind damping, water damping, magnetic damping, or weight counterweight. The user may adjust the training intensity and resistance as needed, thereby making training more flexible and personalized. The resistance module may be connected with various different fitness equipment, which may also save the user costs. The various fitness equipment may be obtained when only one resistance module is connected with the gantries of the various fitness equipment, which can greatly reduce the user costs.

At the same time, the handle of the resistance module is convenient to lift and push, and the power source of the resistance module may be the rechargeable battery, which is convenient to replace with different equipment. The cooling fan, the resistor, and the controller of the resistance module may provide good support for the performance of the resistance module. The shaft tooth meshing and positioning shaft positioning of the resistance module ensure a good transmission connection between the resistance module and the fitness equipment, so that the resistance module may be applied to the various different fitness equipment.

In some embodiments, the resistance module 500 may further include a taper structure. The taper structure may be disposed outside the connecting shaft 531. In some embodiments, the taper structure may match with a matching structure disposed on the fitness equipment 600 to make the connecting shaft 531 concentric with the rotating shaft of the gantry of the fitness equipment 600. The taper structure may be configured to further assist in aligning the connecting shaft 531 with the rotating shaft. In the process of alignment of the resistance module 500 with the fitness equipment 600, the taper structure and the matching structure may cooperate to guide the connecting shaft 531 of the resistance module 500 and the rotating shaft of the fitness equipment 600 to be concentric, which may improve the ease of alignment.

In some embodiments, an easy-to-observe place (e.g., top or side) of the taper structure may be provided with a through groove. The user may observe the meshing situation through the through groove. The material of the taper structure may be transparent plastic for easy observation of the user. In some embodiments, the taper structure may be also provided with a scale for indicating a meshing distance of the taper structure to indicate whether a meshing depth is satisfied. The meshing distance refers to a relative distance between two portions of the taper structure meshing with each other. If the scale reaches a preset position, it may be considered that the meshing depth is satisfied. The scale may be disposed at a position of the through groove, so that the user may observe the meshing and observe the meshing distance at the same time, thereby further improving the ease of observation of the user.

The taper structure is further described below in conjunction with the accompanying drawings. FIG. 10A is a structural diagram illustrating an exemplary taper structure according to some embodiments of the present disclosure. FIG. 10B is a structural diagram illustrating an exemplary meshing of a taper structure according to some embodiments of the present disclosure.

As shown in FIG. 10A and FIG. 10B, the taper structure may include an outer taper member 710 and an inner taper member 720. The outer taper member 710 may be disposed around an outer side of the connecting shaft 531, and the inner taper member 720 may be disposed around an outer side of the shaft tooth sleeve 602. An outer side 711 of the outer taper member 710 may be an inclined side relative to a surface where the outer taper member 710 is mounted, and an inner side 721 of the inner taper member 720 may be an inclined side relative to a surface where the inner taper member 720 is mounted. An inclined angle of the outer side 711 of the outer taper member 710 may match with an inclined angle of the inner side 721 of the inner taper member 720, i.e., along the direction e in FIG. 10*a* and FIG. 10*b*, a diameter of the outer side 711 of the outer taper member 710 may gradually decrease and a diameter of the inner side 721 of the inner taper member 720 may gradually increase, so that the outer side 711 of the outer taper member 710 and the inner side 721 of the inner taper member 720 may be fitted to each other. When the resistance module 500 is close to the fitness equipment 600, the outer taper member 710 may be relatively far away from the inner taper member 720 (as shown in FIG. 10*a*), so it may be easy to operate. In the process of the resistance module 500 approaching the fitness equipment 600, the connecting shaft 531 of the resistance module 500 and the shaft tooth sleeve 602 of the fitness equipment 600 may gradually move towards a center of the connecting shaft due to the guidance of the taper structure, so that concentricity may be easily achieved. When the shaft teeth of the resistance module 500 mesh with the shaft tooth sleeve 602, the outer taper member 710 and the inner taper member 720 may also be fitted (as shown in FIG. 10*b*), so that the meshing positioning and concentricity may be completed.

In some embodiments, the length of the outer taper member 710 and the length of the inner taper member 720 may be greater than the positioning length of the positioning shaft 601. The positioning length refers to an extension length of a portion of the positioning shaft 601 that extends outside of the shaft tooth sleeve 602. The taper structure may assist in the positioning of the positioning shaft 601 before the positioning of the positioning shaft 601, which may improve the convenience of penetration of the positioning shaft 601.

FIG. 11 is a structural diagram illustrating an exemplary resistance module and a fitness equipment according to some embodiments of the present disclosure. FIG. 12 is a structural diagram illustrating an exemplary mounting structure according to some embodiments of the present disclosure.

In some embodiments, the fitness equipment may include the mounting structure configured to mount the resistance module 500. The mounting structure may be disposed on the fitness equipment, and the resistance module 500 may be fixed relative to the fitness equipment through the mounting structure. Understandably, the mounting structure may be determined according to a structural feature of the fitness equipment.

In some embodiments, as shown in FIG. 11 and FIG. 12, the fitness equipment may be a rowing machine 800, the mounting structure may be disposed on the rowing machine 800, and the mounting structure may include a fixed frame 810, a fixed plate 820, and a hinge 830. The fixed frame 810 may be provided with a three-sided support plate matching the resistance module 500, and the fixed frame 810 may be configured to support the resistance module 500 from at least three directions. The fixed plate 820 may be configured to limit the position of the resistance module 500, and the fixed plate 820 may be rotated along the hinge 830. In some embodiments, a process of fixing the resistance module 500 is as follows. The resistance module 500 may be placed into the fixed frame 810, the fixed plate 820 may be rotated along the hinge 830 until the fixed plate 820 is rotated to a position where the fixed plate 820 fits the resistance module 500, the fixed plate 820 may be connected with the fixed frame 810, and the mounting may be completed. The connection manner may include a snap fit connection, a pin connection, a threaded connection, etc.

Figure 14:
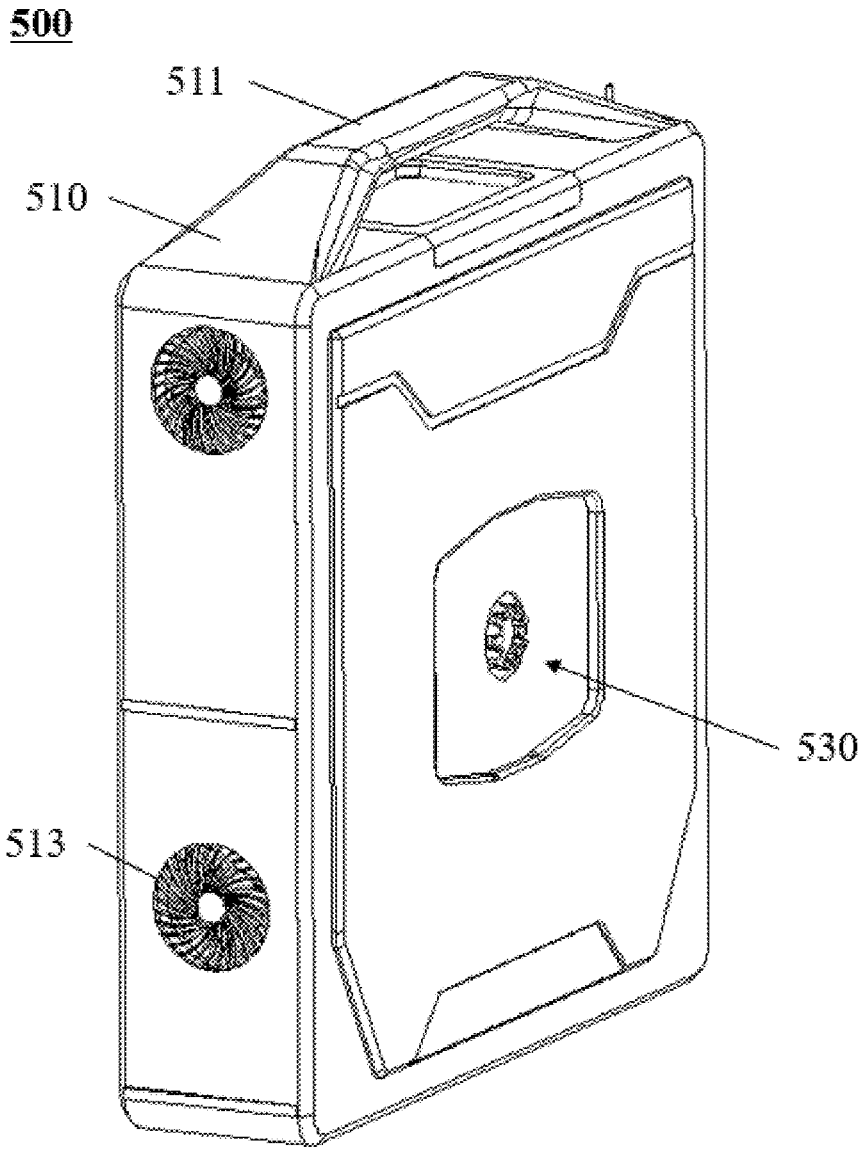
FIG. 14 is a structural diagram illustrating an exemplary resistance module according to some embodiments of the present disclosure.
Figure 15:
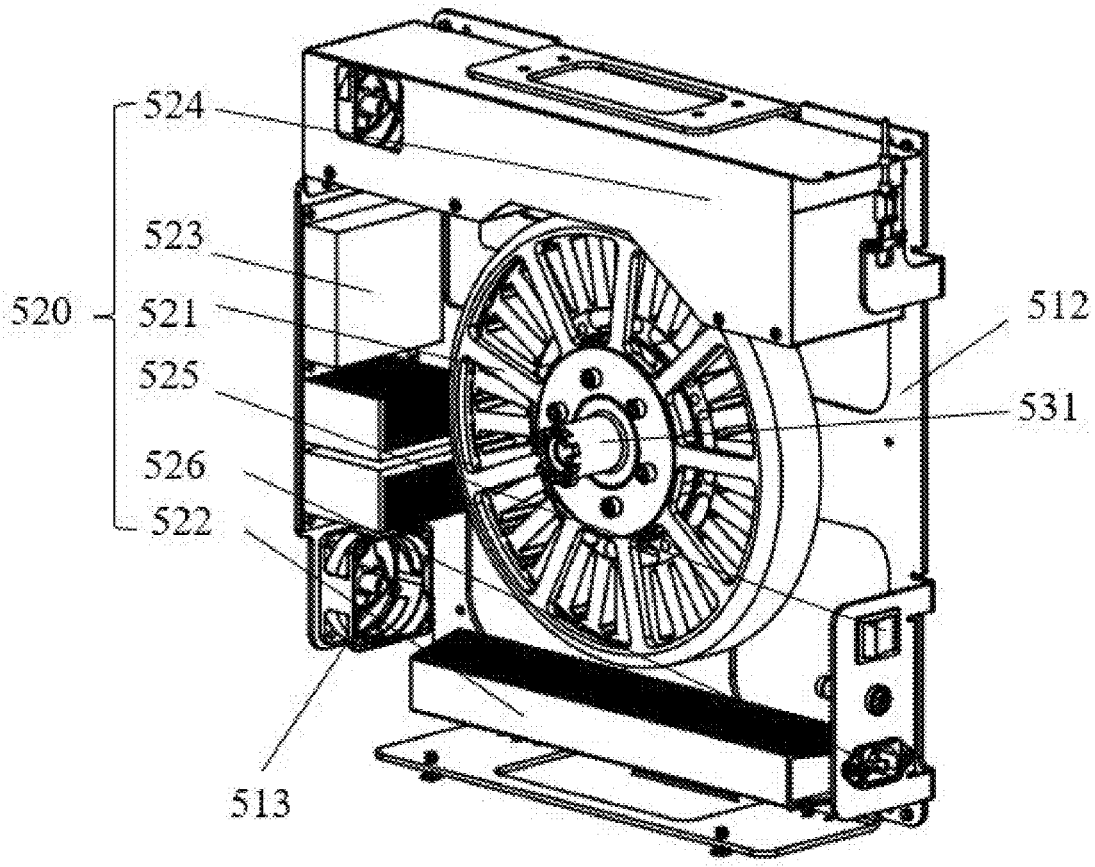
FIG. 15 is a structural diagram illustrating an exemplary internal structure of a resistance module according to some embodiments of the present disclosure.

FIG. 13 is a structural diagram illustrating an exemplary resistance module and another fitness equipment according to some embodiments of the present disclosure. FIG. 14 is a structural diagram illustrating an exemplary mounting structure according to some embodiments of the present disclosure. FIG. 15A is a structural diagram illustrating an exemplary first positioning assembly according to some embodiments of the present disclosure. FIG. 15B is a structural diagram illustrating another exemplary first positioning assembly according to some embodiments of the present disclosure. FIG. 15C is a structural diagram illustrating another exemplary first positioning assembly according to some embodiments of the present disclosure.

In some embodiments, as shown in FIG. 13 and FIG. 14, the mounting structure may include a first positioning assembly 610 and a second positioning assembly 620. As shown in FIGS. 15A-FIG. 15C, the first positioning assembly 610 may include an L-shaped platen 611. An end of a transverse plate of the L-shaped platen 611 may be provided with a snap hook structure 612 for hooking the resistance module 500 to prevent the resistance module 500 from moving outwardly. The transverse plate of the L-shaped platen 611 may abut the resistance module 500, so that the resistance module 500 may not move upward. A longitudinal plate of the L-shaped platen 611 may be used for easy user lifting. In some embodiments, the L-shaped platen 611 may be provided with a torsion spring 613. A downward force may be applied to the transverse plate of the L-shaped platen 611 by an elastic force of the torsion spring 613, which may further press down the resistance module 500. In some embodiments, when the user pulls the L-shaped platen 611 upward, the snap hook structure 612 may be lifted upwardly at an angle to separate from the resistance module 500.

Figure 16:
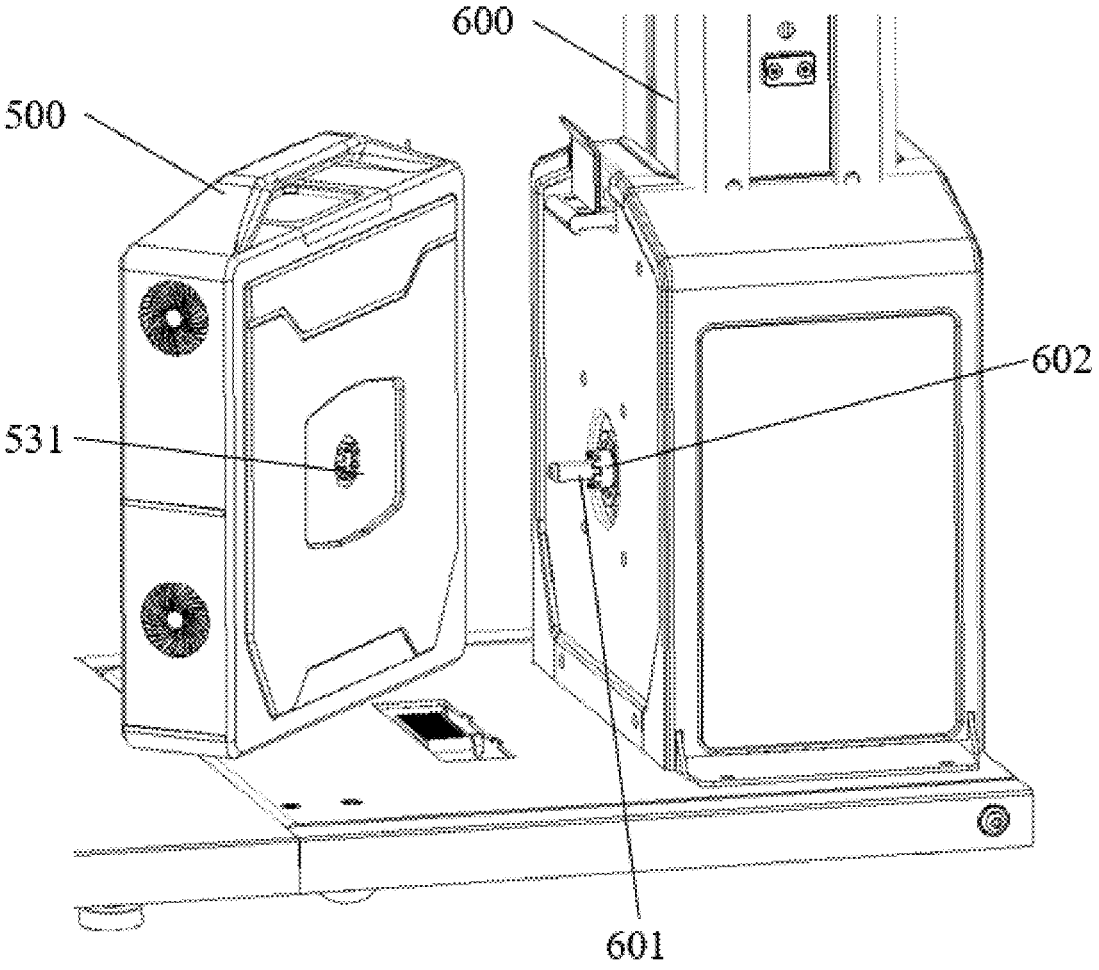
FIG. 16 is a diagram illustrating an exemplary partial structure of a resistance module and a fitness equipment according to some embodiments of the present disclosure.
Figure 17A:
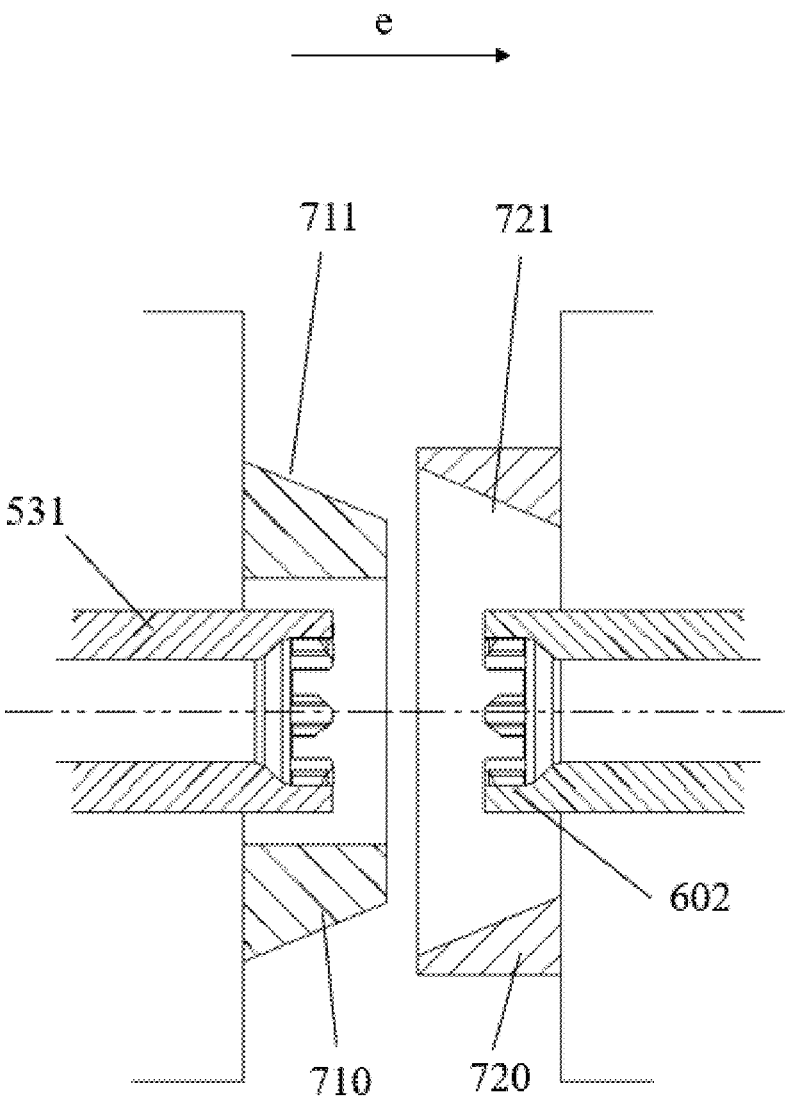
FIG. 17A is a structural diagram illustrating an exemplary taper structure according to some embodiments of the present disclosure.
Figure 17B:
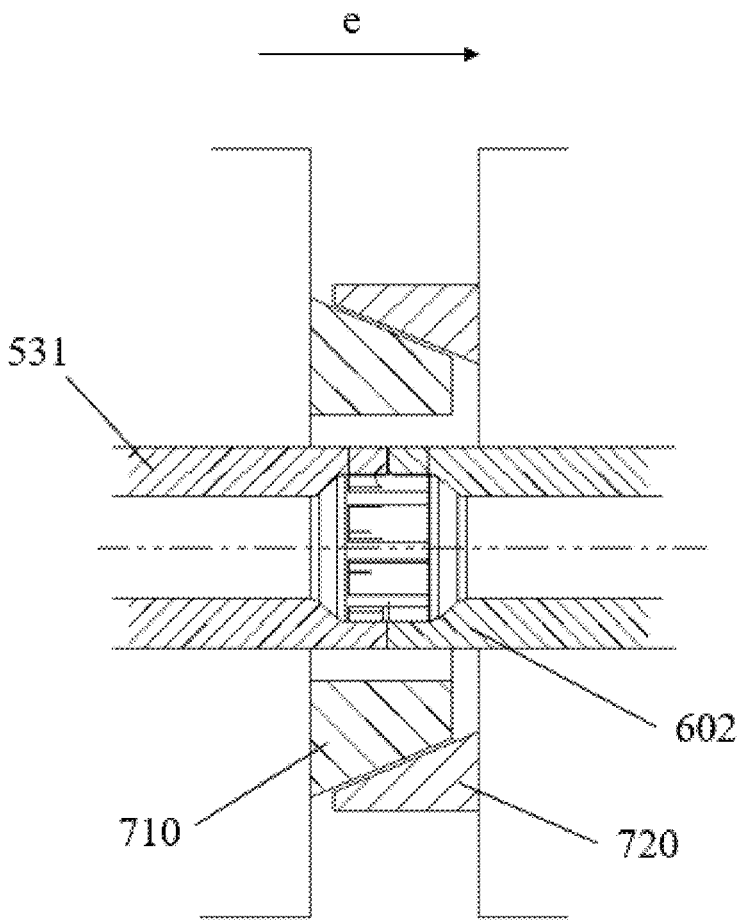
FIG. 17B is a structural diagram illustrating an exemplary meshing of a taper structure according to some embodiments of the present disclosure.
Figure 18:
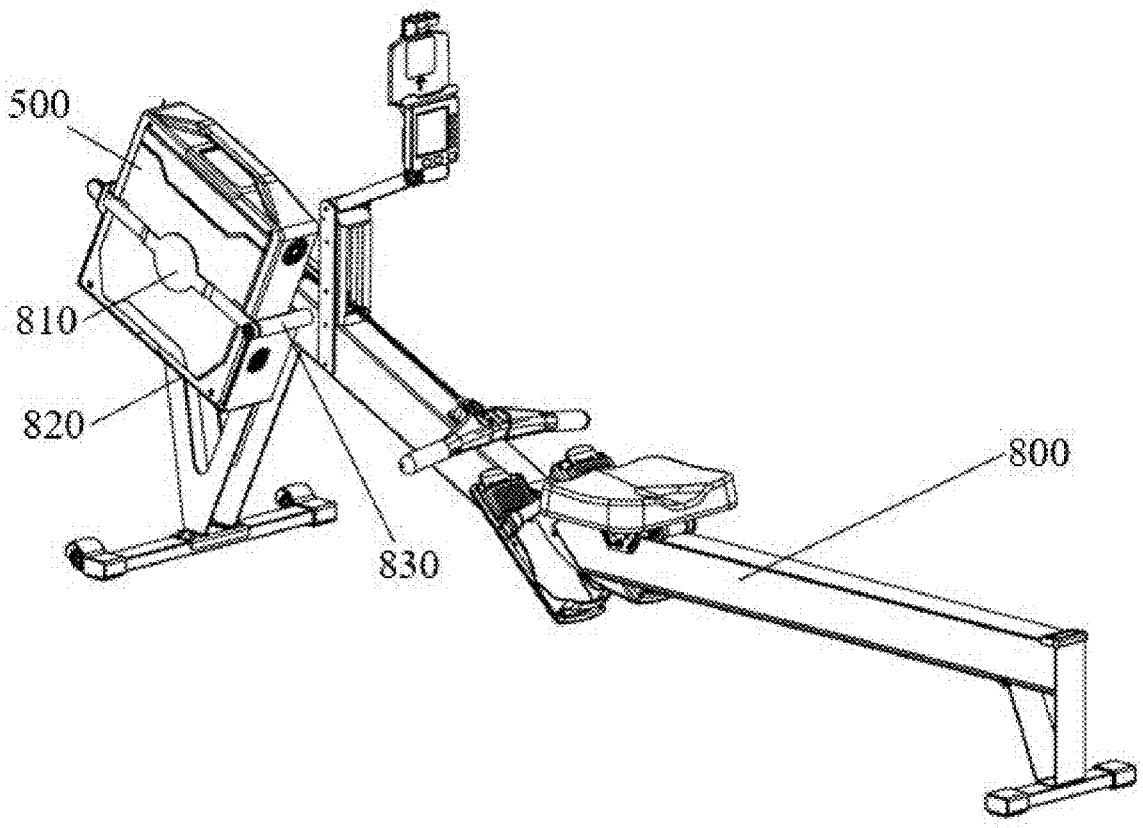
FIG. 18 is a structural diagram illustrating an exemplary resistance module and a fitness equipment according to some embodiments of the present disclosure.
Figure 19:
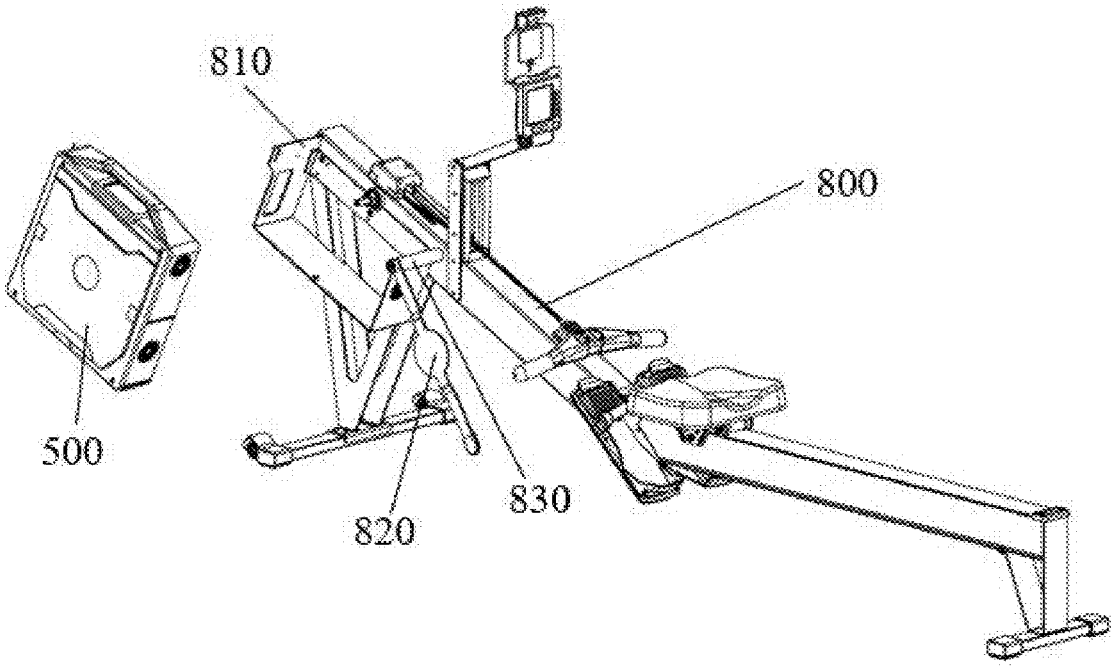
FIG. 19 is a structural diagram illustrating an exemplary mounting structure according to some embodiments of the present disclosure.
Figure 20:
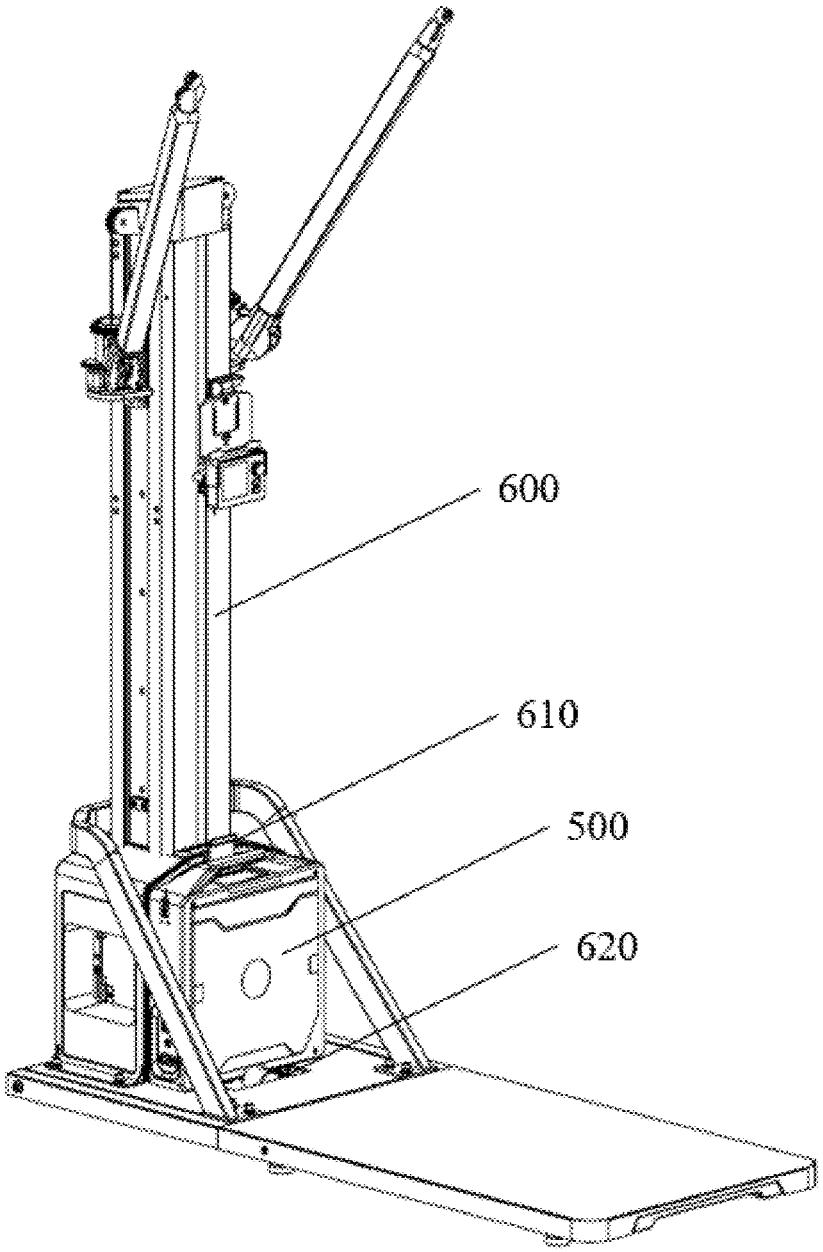
FIG. 20 is a structural diagram illustrating an exemplary resistance module and another fitness equipment according to some embodiments of the present disclosure.
Figure 21:
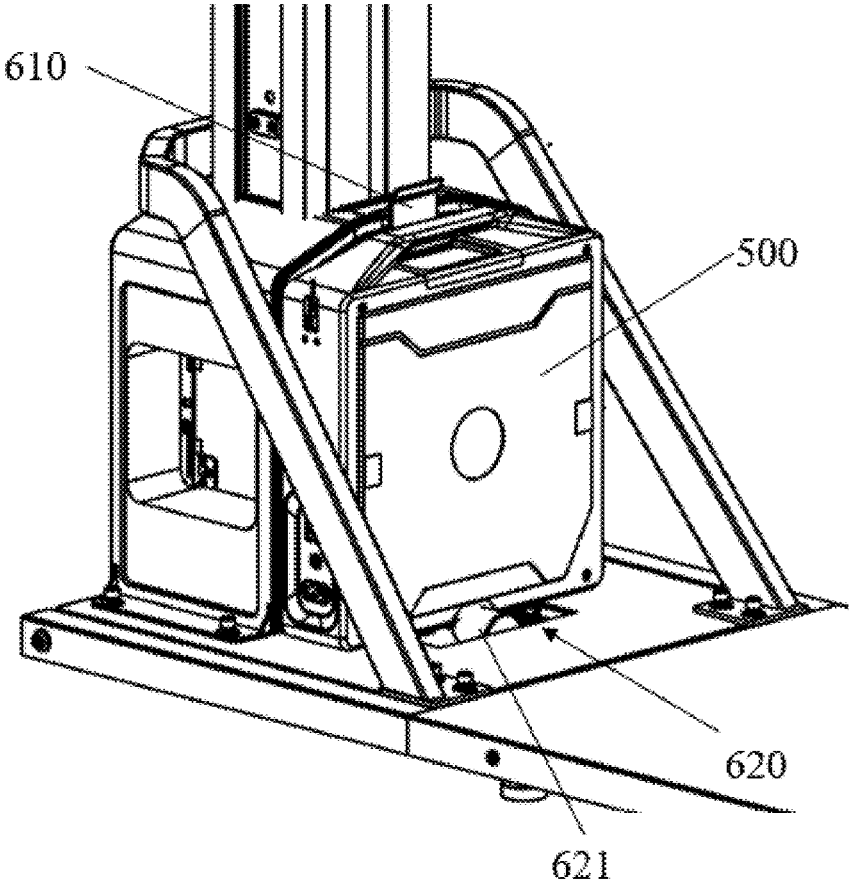
FIG. 21 is a structural diagram illustrating an exemplary mounting structure according to some embodiments of the present disclosure.
Figure 22A:
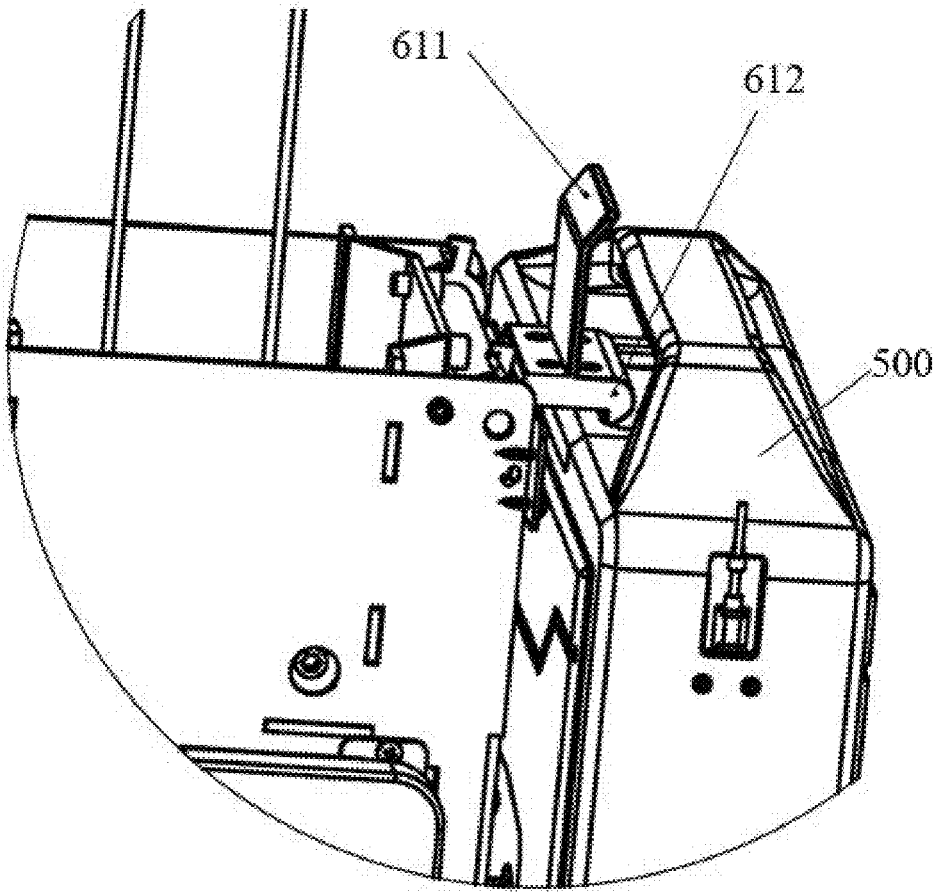
FIG. 22A is a structural diagram illustrating an exemplary first positioning assembly according to some embodiments of the present disclosure.
Figure 22B:
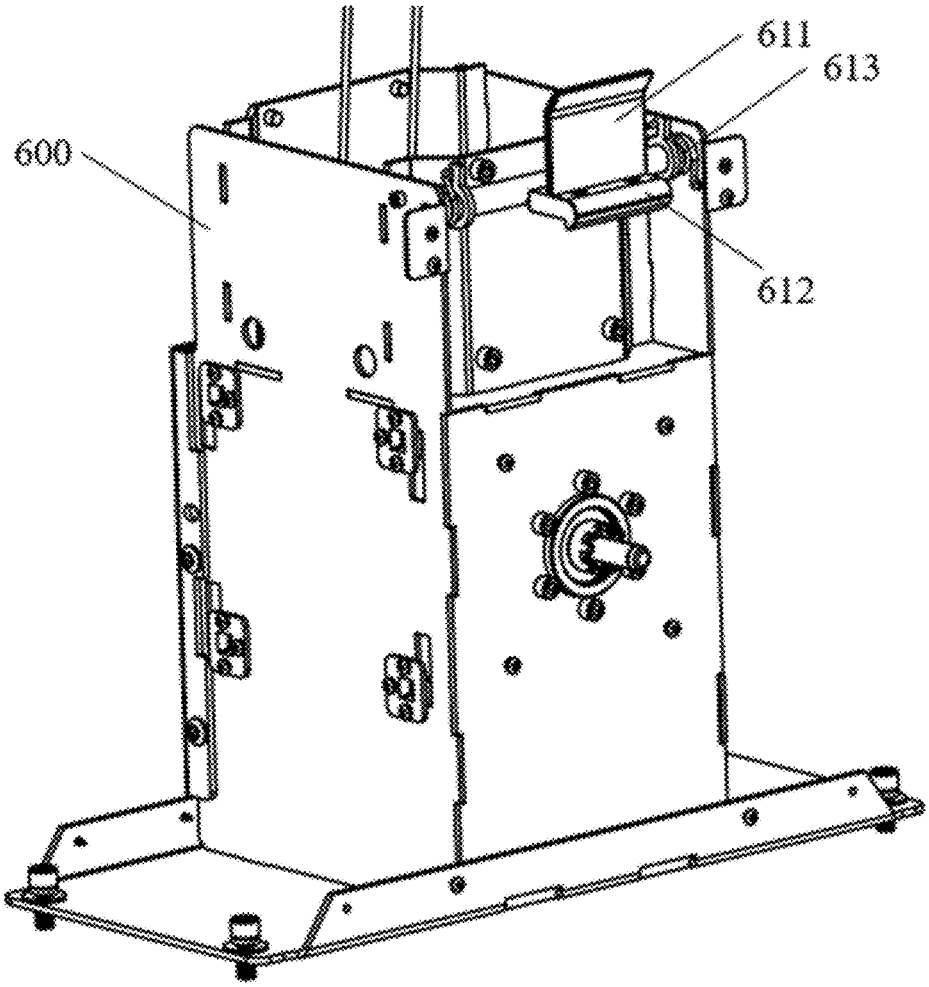
FIG. 22B is a structural diagram illustrating another exemplary first positioning assembly according to some embodiments of the present disclosure.
Figure 22C:
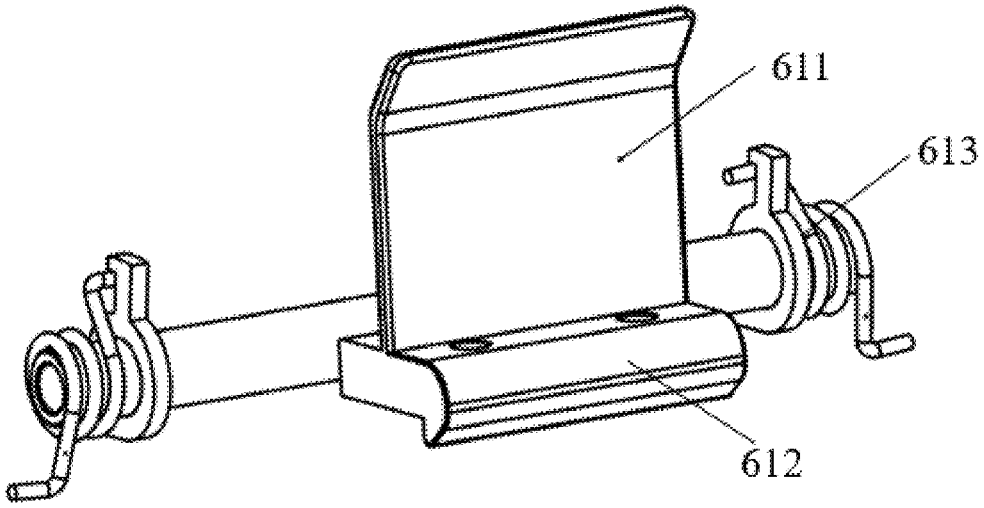
FIG. 22C is a structural diagram illustrating another exemplary first positioning assembly according to some embodiments of the present disclosure.
Figure 23A:
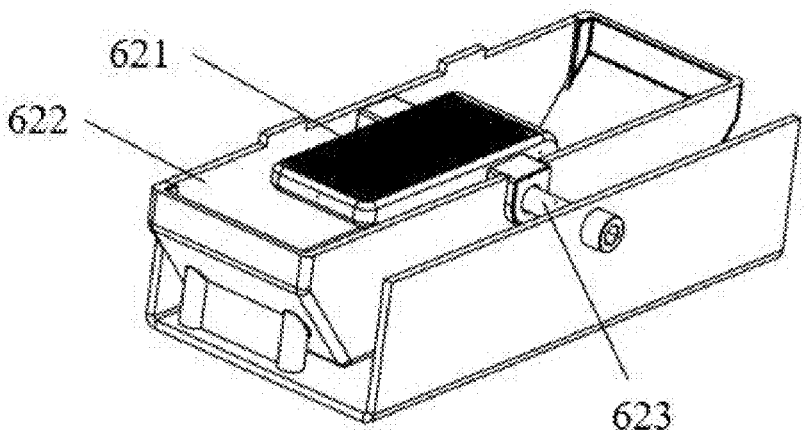
FIG. 23A is a structural diagram illustrating an exemplary second positioning assembly according to some embodiments of the present disclosure.
Figure 23B:
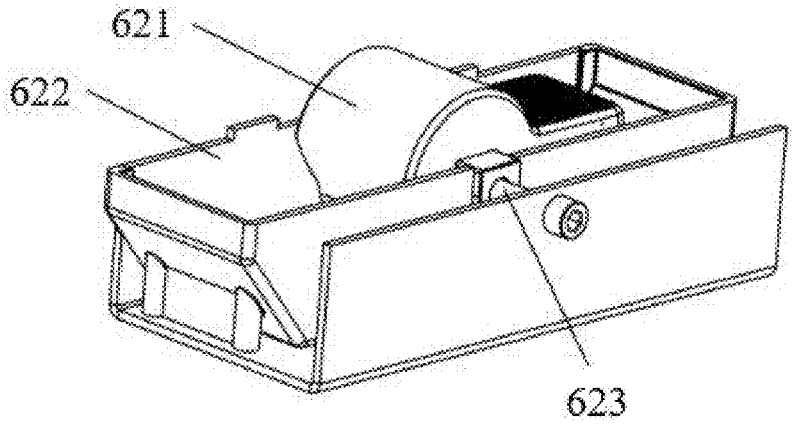
FIG. 23B is a structural diagram illustrating another exemplary second positioning assembly according to some embodiments of the present disclosure.
Figure 23C:
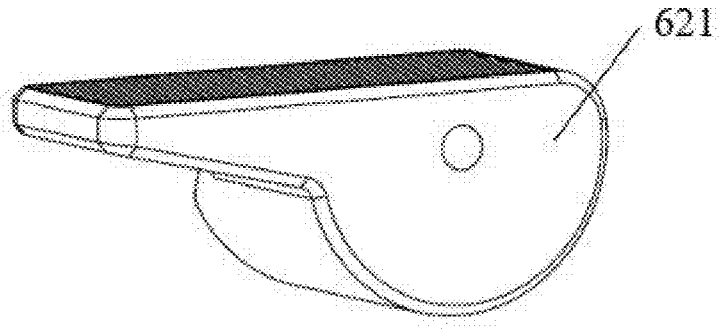
FIG. 23C is a structural diagram illustrating an exemplary convex plate according to some embodiments of the present disclosure.

FIG. 16A is a structural diagram illustrating an exemplary second positioning assembly according to some embodiments of the present disclosure. FIG. 16B is a structural diagram illustrating another exemplary second positioning assembly according to some embodiments of the present disclosure. FIG. 16C is a structural diagram illustrating an exemplary convex plate according to some embodiments of the present disclosure.

As shown in FIG. 16A to FIG. 16C, the second positioning assembly 620 may include a convex plate 621 and a mounting groove 622. One side of the convex plate 621 may be a flat surface, and another side of the convex plate 621 may have a protrusion (as shown in FIG. 16C). The convex plate 621 may be rotatably disposed in the mounting groove 622. For example, the convex plate 621 may be provided with a pin shaft 623, and both ends of the pin shaft 623 may be fixed in the mounting groove 622, so that the convex plate 621 may be rotated based on the pin shaft 623. In some embodiments, the convex plate 621 shown in FIG. 16A may be rotated until the flat surface of the convex plate 621 is coplanar with a surface including a notch of the mounting groove 622, and may remain stable in the state when not subjected to a force pushing the convex plate 621 to rotate. At this time, the fitness equipment 600 may be not mounted with the resistance module 500 or the resistance module 500 may be not limited. In some embodiments, under the effect of gravity distribution of the convex plate 621 (i.e., the side having the protrusion may have a greater weight), the convex plate 621 may maintain a state in which the flat surface of the convex plate 621 is coplanar with the surface including the notch of the mounting groove 622.

In some embodiments, as shown in FIG. 16B, the convex plate 621 may be rotated by a force until the convex plate 621 protrudes beyond the surface including the notch of the mounting groove 622, and may remain stable in the state without being subjected to the force pushing the convex plate 621 to rotate. At this time, the resistance module 500 may be stuck by the protrusion of the convex plate 621 to achieve a stable mounting (see FIG. 14). In some embodiments, since the resistance module 500 is stuck by the protrusion of the convex plate 621, the convex plate 621 may maintain a state protruding beyond the surface including the notch of the mounting groove 622.

In some embodiments, the second positioning assembly 620 may further include a small motor (not shown). The small motor may be connected with the convex plate 621 so as to drive the convex plate 621 to rotate, so that the user may not need to manually operate. The user may operate the second positioning assembly 620 by controlling the small motor, which is more convenient.

In some embodiments of the present disclosure, the mounting structure may be disposed on the fitness equipment that matches the resistance module, so that the resistance module may be relatively fixed to the fitness equipment, thereby ensuring that the resistance module is in good contact with the fitness equipment during operation, and the resistance is transmitted to the fitness equipment better.

In some embodiments, the resistance module 500 may further include one or more position sensors. The one or more position sensors may be configured to monitor whether the resistance module 500 reaches a preset mounting position. For example, the one or more position sensors may include a first position sensor and a second position sensor. The first position sensor may be disposed on the resistance module 500 for monitoring a position of the transmission mechanism 530. The second position sensor may be disposed on the fitness equipment for monitoring a position of the mounting structure. In some embodiments, the one or more position sensors may include a third position sensor for recognizing a type of fitness equipment connected with the resistance module 500. Types of the one or more position sensors may include, such as a capacitive sensor, a displacement sensor, a grating sensor, a position encoder, etc. In some embodiments, the one or more position sensors may be communicatively connected with the controller 523, and the controller 523 may perform further processing based on a monitoring result of the one or more position sensors.

In some embodiments, the first position sensor and the third position sensor may be Hall sensors. A Hall sensor may be disposed at different positions of different fitness equipment. The Hall sensor may detect the position. The controller 523 may recognize the type of fitness equipment to which the resistance module 500 is connected through the detected position. For example, the controller 523 may recognize whether the fitness equipment connected with the resistance module 500 is a strength training station or a rowing machine based on the detected position.

In some embodiments, the resistance module 500 may further include an interactive screen. The interactive screen may facilitate communication between a user and components of the fitness equipment. For example, the user may interact with (e.g., control) the resistance module 500 or the fitness equipment by touching a screen, clicking a button, typing text, dragging an icon, etc. In some embodiments, the interactive screen may be disposed on at least one of the resistance module 500 or the fitness equipment. In other embodiments, the interactive screen may be a smart device (e.g., smartphone or smartwatch), and the smart device may be communicatively connected with either the resistance module 500 or the fitness equipment 600.

In some embodiments, the resistance module 500 may further include a distance sensor. The distance sensor may be configured to monitor a distance between an end face of the connecting shaft 531 and an end face of a rotating shaft of a gantry of the fitness equipment.

In some embodiments, the controller 523 may provide a reminder on the interactive screen indicating that the connecting shaft 531 is not mounted in place in response to the recognized type of the fitness equipment 600 to which the resistance module 500 is connected, and the distance between the end face of the connecting shaft 531 and the end face of the rotating shaft of the gantry of the fitness equipment denoted by distance sensor data does not satisfy a preset condition. In some embodiments, the controller 523 may, in response to the reminder indicating that the connecting shaft 531 is not mounted in place, display a corresponding mounting video or a scale position on the taper structure, etc., on the interactive screen to help the user to mount. In some embodiments, the controller 523 may repeatedly monitor the distance sensor data based on a preset time interval until the distance between the end face of the connecting shaft 531 and the end face of the rotating shaft of the gantry of the fitness equipment meets the preset condition. The preset condition may be that the distance between the end face of the connecting shaft 531 and the end face of the rotating shaft of the gantry of the fitness equipment 600 is smaller than a distance threshold. The distance threshold may be preset empirically, and the distance threshold may be 0, 1 centimeter, 2 centimeters, etc.

In some embodiments, the controller 523 may, in response to determining that detection data of the first position sensor and detection data of the second position sensor satisfy a preset condition, determine and prompt that the resistance module 500 has reached the preset mounting position; and send, based on the determination that the resistance module 500 has reached the preset mounting position, an activation command to activate the power device 520 of the resistance module 500. In some embodiments, the controller 523 may, in response to determining that the detection data of the first position sensor and the detection data of the second position sensor detection data do not satisfy the preset condition, determine and prompt specific content (e.g., a component and a position that are not mounted in place) that does not satisfy the preset condition; and provide mounting guidance based on the specific content that does not satisfy the preset condition. For example, the controller 523 may display a mounting video of the corresponding component on the interactive screen based on the specific content that does not satisfy the preset condition. The preset condition may be preset based on experience or historical data. For example, if current detection data of the first position sensor and current detection data of the second position sensor is consistent with detection data of the first position sensor and detection data of the second position sensor corresponding to the historical data when the resistance module 500 has been mounted in place, the preset condition may be considered to be satisfied.

In some embodiments, the controller 523 may, in response to determining that the fitness equipment is changed or replaced by another fitness equipment (e.g., the resistance module 500 is separated from a certain fitness equipment and close to or connected with another fitness equipment), provide mounting guidance of the resistance module 500 of the replaced fitness equipment or fitness training guidance, etc., on the interactive screen.

In some embodiments of the present disclosure, the position sensor, the distance sensor, and the interactive screen may be disposed, which may help the user to determine the type of the connected fitness equipment, and guide the user to mount the fitness equipment in a timely manner, thereby providing the user with convenience of mounting. At the same time, the controller 523, by determining the position sensor data and the distance sensor data, may fully ensure that the resistance module is reliably mounted and reliably positioned before activating the resistance module, which can ensure the safety of the user using the resistance module.

In some embodiments, the position sensor may include a fourth position sensor for monitoring the status data of the fitness equipment. In some embodiments, when the fitness equipment is a strength training station, the status data may include a position of a rotating shaft arm of the strength training station and an exercise program corresponding to the fitness equipment, a speed at which a pull rope is pulled out, a length that the pull rope is pulled out, etc. In some embodiments, when the fitness equipment is a rowing machine, the status data may include an exercise program of the rowing machine, a speed at which a pull rope is pulled out, a length that the pull rope is pulled out, etc. The exercise program refers to exercise data related to exercise. The exercise data may include a fitness parameter, an exercise duration, an effective exercise duration, etc. More descriptions regarding the exercise data may be found below.

In some embodiments, the controller 523 may provide a reminder for changing the exercise program in response to determining that the status data exceeds a preset value, and cause the resistance module 500 to change the resistance. In some embodiments, power device parameters (e.g., a speed or an output power) of the resistance module 500 corresponding to different training modes may be different, and the power device parameters corresponding to the different training modes may be preset values. In some embodiments, the controller 523 may obtain the power device parameters in advance based on a switching sequence of the training modes in the history records.

In some embodiments, the controller 523 may activate the resistance module 500 based on a power device parameter in response to determining that the motor assembly stops rotating when the fitness equipment is switched or after the fitness equipment 600 is switched. In some embodiments, the preset condition may need to be met before the resistance module 500 is activated. More descriptions regarding the preset condition that needs to be met before activation of the resistance module 500 may be found above.

In some embodiments, the controller 523 may collect, in response to determining that the resistance module 500 is connected with one of at least one set of fitness equipment exercise data of the user based on the fitness equipment, determine a recommended fitness parameter, and display the recommended fitness parameter on the interactive screen. The at least one set of fitness equipment refers to one or more different fitness equipment that may be connected with the resistance module 500. The exercise data may include a fitness parameter, an exercise duration, etc. The fitness parameter may include a parameter such as a tensile force, a torque force, or resistance of the fitness equipment.

In some embodiments, the resistance module 500 may be connected with different fitness equipment, the controller 523 may obtain exercise data corresponding to the fitness equipment connected with the resistance module 500. In some embodiments, the exercise data may include an exercise duration and an effective exercise duration. The exercise duration refers to a time spent by the user doing exercise using the fitness equipment. The effective exercise duration refers to a time spent by the user doing exercise with a relatively good result. In some embodiments, the effective exercise duration may be a duration when the resistance is output by the resistance module 500, which may exclude a case where the resistance module 500 runs but not outputs resistance.

In some embodiments, after the resistance module 500 is connected with the fitness equipment, the controller 523 may determine the effective exercise duration based on exercise intensity data corresponding to the fitness equipment. In some embodiments, the effective exercise duration may be obtained based on the exercise duration through weighting. If an exercise intensity is a standard exercise intensity, a weight may be 1. If the exercise intensity is smaller than the standard exercise intensity, the weight may be smaller than 1. If the exercise intensity is greater than the standard exercise intensity, the weight may be greater than 1. The exercise intensity data is used to indicate the exercise intensity, which reflects the amount of force exerted by the user, and the physical tension degree of the user, etc., during the exercise. The exercise intensity data may include an activation time of the fitness equipment recorded by the fitness equipment, an activation time of the resistance module 500, data such as resistance output by the resistance module 500 at different time points, power consumption, etc. In some embodiments, the standard exercise intensity may be associated with a user feature. For example, the standard exercise intensity may be lowered for a beginner and raised for a regular exerciser. In some embodiments, the standard exercise intensity may be set by a user for using the fitness equipment. In some embodiments, the standard exercise intensity may be related to a count of times the resistance module 500 has been switched in a previous preset time period and a historical effective exercise duration of the user. For example, if the user has switched the resistance module 100 three times in the past one hour, and the effective exercise duration is close to 20 minutes after each switch, it may indicate that the user is serious about the exercise, and the standard exercise intensity may be lowered when the user does exercise subsequently, so that a longer effective exercise duration may be recorded for the user.

In some embodiments of the present disclosure, by recording the exercise data of different fitness equipment connected by the resistance module, the exercise data of the user exercising in different fitness equipment may be obtained, so as to better personalize the exercise of the user and meet exercise needs of the user.

In some embodiments, the controller 523 may display the recommended fitness parameter to the user on the interactive screen based on the exercise data. The exercise data may include exercise data obtained through historical statistics (also referred to as historical exercise data) and currently recorded exercise data (also referred to as current exercise data). The recommended fitness parameter may include a parameter such as a tensile force, a torque force, resistance of fitness equipment, etc., recommended to the user. In some embodiments, the recommended fitness parameter of the resistance module 500 may be gradual increased in intensity. The intensity of the recommended fitness parameter of the resistance module 500 may stop increasing until the effective exercise duration varies by a magnitude that is smaller than a preset time threshold or decreases (indicating that the current exercise intensity may be too high relative to the user).

In some embodiments, the recommended fitness parameter may be related to the effective exercise duration of the user and a standard exercise duration. In some embodiments, the standard exercise duration may be related to the user feature (e.g., a user feature that is recorded when the user logs in). For example, if the effective exercise duration of the user is smaller than the standard exercise duration, the exercise intensity of the recommended fitness parameter may be reduced, and a reduced percentage may be equal to a ratio of the effective exercise duration to the standard exercise duration). If the effective exercise duration of the user is greater than the standard exercise duration, the exercise intensity may be increased in the recommended fitness parameter, and an increased percentage may be equal to a ratio of the effective exercise duration to the standard exercise duration. In some embodiments, the recommended fitness parameter may be no longer adjusted when a difference between two adjacent effective exercise durations of the user is smaller than a threshold.

In some embodiments of the present disclosure, the recommended fitness parameter of the user may be continuously optimized, which may improve a matching degree between the recommended fitness parameter and the user, so as to improve the exercise effect of the user, and at the same time to avoid exercise injuries to the user due to an excessive exercise intensity.

In some embodiments, the controller 523 may, in response to determining that the resistance module 500 is connected with the fitness equipment, predict an optimal fitness parameter of the user through a fitness parameter prediction model and send the optimal fitness parameter to the interactive screen for display. The optimal fitness parameter refers to a fitness parameter that has a highest matching degree with the user.

In some embodiments, the fitness parameter prediction model may be a machine learning model. For example, the fitness parameter prediction model may include a convolutional neural network (CNN) model, a neural network (NN) model, other customized model structure, or the like, or any combination thereof.

An input of the fitness parameter prediction model may include the user feature, the type of the current fitness equipment, and a candidate fitness parameter. The controller may recognize the type of the fitness equipment and input the type of the fitness equipment into the fitness parameter prediction model. An output of the fitness parameter prediction model may include a recommendation degree of the candidate fitness parameter. The user feature may be obtained when the user logs in online through a terminal, for example, the user feature may be inputted by the user voluntarily. The candidate fitness parameter may be one of a plurality of sets of fitness parameters determined by matching through a predetermined fitness parameter database based on the user feature and the current fitness equipment. For example, the controller 523 may construct a retrieval vector (e.g., {User feature 1, fitness equipment A}) based on the user feature and the current fitness equipment, retrieve in a fitness parameter vector database, and select a fitness parameter corresponding to a standard vector that has a closest distance (e.g., cosine distance) with the retrieval vector as the candidate fitness parameter. The fitness parameter vector database may be a vector database established by collecting historical data to construct vectors.

In some embodiments, the controller 523 may generate, based on a count of times the fitness equipment during a recent time period, a type of fitness equipment that is replaced each time, and the effective exercise duration corresponding to each replacement, sequence data, and match the candidate fitness parameter based on the sequence data. For example, if the user does exercise using only a fixed type of fitness equipment every day, as the exercise proceeds, the user may need a greater exercise intensity, and at this time, the intensity of the candidate fitness parameter subsequently may be appropriately increased. As another example, if the effective exercise duration of the user is relatively long before the fitness equipment is switched, and when the user switches the fitness equipment, the candidate fitness parameter subsequently may be appropriately reduced to avoid excessive fatigue of the user. The recommendation degree of the candidate fitness parameter refers to a degree to which the candidate fitness parameter matches the user, and the recommendation degree of the candidate fitness parameter may be expressed in a way, for example, the recommendation degree may be expressed as 0-100%.

In some embodiments, the fitness parameter prediction model may be obtained by training a plurality of training samples with labels. For example, the plurality of training samples with the labels may be input into an initial fitness parameter prediction model, a loss function may be constructed based on the labels and output results of the initial fitness parameter prediction model, and parameters of the initial fitness parameter prediction model may be iteratively updated through gradient descent or other manner based on the loss function. The model training may be completed when a preset condition is met, and a trained fitness parameter prediction model may be obtained. The preset condition may be that the loss function converges, a count of iterations reaches a threshold, etc.

In some embodiments, the training sample may at least include a sample user feature, a sample current fitness equipment, and a sample candidate fitness parameter. The label may be a recommendation degree corresponding to the sample candidate fitness parameter. In some embodiments, the controller 523 may obtain the label in various ways. For example, the controller 523 may obtain feedback from the user on the interactive screen after the exercise is completed (e.g., an active pop-up evaluation page) and determine the label based on the feedback. As another example, based on a large amount of historical data, if the difference between two adjacent effective exercise durations of the user is smaller than the threshold, it may indicate that the current fitness parameter is appropriate (also referred to as an appropriate fitness parameter). When the label is obtained through the feedback of the user on the interactive screen, it may be considered that the label of the current fitness parameter corresponding to the good comment is 1, and the label of the current fitness parameter corresponding to the bad or neutral comment is 0. When the label is obtained based on historical data, it may be considered that the label of an appropriate fitness parameter is 1 and the label of an inappropriate fitness parameter is 0.

In some embodiments, the controller 523 may use a candidate fitness parameter with a highest recommendation degree as the optimal fitness parameter displayed to the user based on the recommendation degree of the candidate fitness parameter output by the fitness parameter prediction model. In some embodiments, the controller 523 may also recommend a plurality of candidate fitness parameters in a sequential order, and note a candidate fitness parameter with a relatively low recommendation degree at the bottom of the ordering may be noted as a reminder such as "intensity may be too low," or "there may be a risk of strain" to further satisfy the choice of the user.

In some embodiments of the present disclosure, the optimal fitness parameter may be determined, and the optimal parameter may be combined with the user feature, thereby further obtaining the exercise program that matches the user and improving the exercise effect of the user.

In some embodiments, the fitness device may further include a control system (not shown in the figure).

The control system refers to a system for controlling parameters such as a rotation speed or a rotation direction of a power device. In some embodiments, the control system may be electrically connected with the power device. In some embodiments, the control system may be integrated in the power device, i.e., the control system may be a portion of the power device.

In some embodiments, the control system may include a processor. The processor may be configured to process data and/or information obtained from other devices and/or other components of the fitness device. The processor may execute program instructions based on these data, information and/or processing results to perform one or more functions described in the present disclosure. In some embodiments, the processor may include one or more sub-processing devices (e.g., a single-core processing device or a multi-core processing device). Merely by way of example, the processor may include a central processing unit (CPU), a controller, a microcontroller unit, a microprocessor, or the like, or any combination thereof.

In some embodiments, the fitness device may further include an angle position regulator (APR, not shown in the figure) and an angular speed regulator (ASR, not shown in the figure). The APR and the ASR may be electrically connected with the control system.

The APR may be configured to control a rotor of an electric motor (e.g., the power device) to reach and maintain a specific position and/or angle.

The ASR may be configured to control a rotation speed and/or a rotation direction of the rotor of the electric motor (e.g., the power device).

In some embodiments, the fitness device may further include an extended state observer (ESO, not shown in the figure) and/or a torque driver (not shown in the figure). In some embodiments, the ESO and/or the torque driver may be electrically connected with the control system.

The ESO may be configured to estimate an internal state of the electric motor (e.g., the power device) in real time, such as speed, position, or current. The ESO may also be configured to detect and estimate an external state of the electric motor (e.g., the power device), such as a load change, etc.

In some embodiments, the ESO may determine a current pulling force of the power device and predict a peak pulling force based on the torque current of the power device.

The torque driver, also referred to as a moment driver or a motor driver, may be configured to control a torque output of the electric motor (e.g., the power device).

Figure 24:
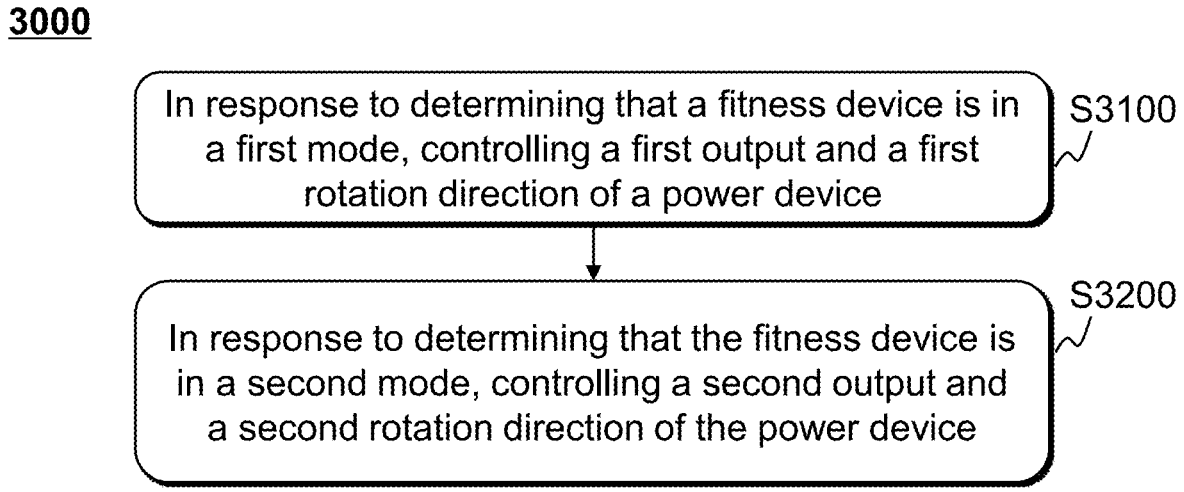
FIG. 24 is a flowchart illustrating an exemplary control method for a fitness device according to some embodiments of the present disclosure.

FIG. 24 is a flowchart illustrating an exemplary control method for a fitness device according to some embodiments of the present disclosure. As shown in FIG. 24, a process 3000 may include the following operations. In some embodiments, the process 3000 may be performed by a control system.

In S3100, in response to determining that a fitness device is in a first mode, a first output and a first rotation direction of a power device may be controlled.

More descriptions regarding the fitness device and the first mode may be found in the related descriptions above (e.g., FIGS. 12-13).

The first output refers to at least one of a target rotation speed or a target output torque of a rotor of the power device when the fitness device is in the first mode. The first rotation direction refers to an actual rotation direction of the rotor of the power device when the fitness device is in the first mode.

In some embodiments, in response to determining that the fitness device is in the first mode, the control system may control the first output and the first rotation direction of the power device based on the operation of the APR, the ASR, the torque driver, etc.

Figure 25:
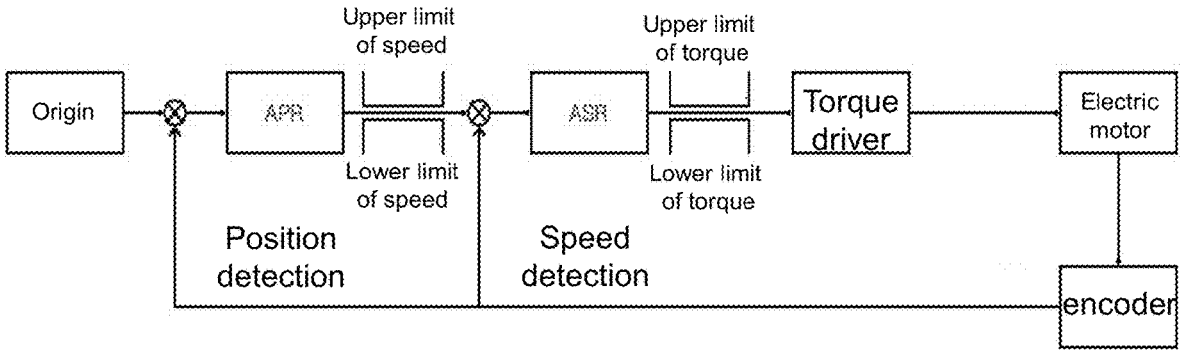
FIG. 25 is a schematic diagram illustrating a control principle of a power device when a fitness device is in a first mode according to some embodiments of the present disclosure.
Figure 26:
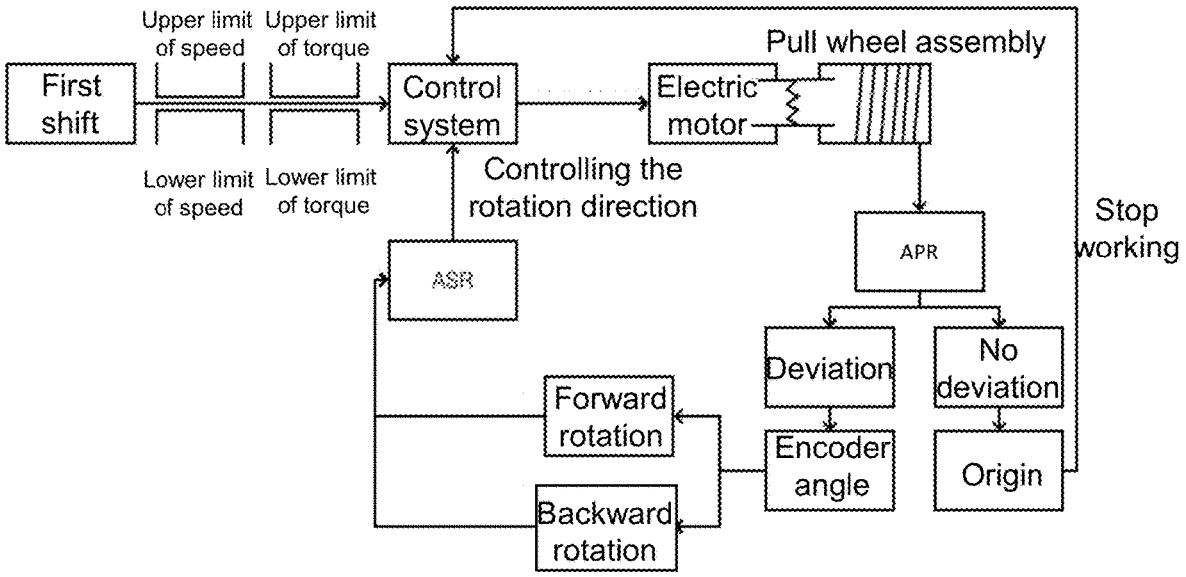
FIG. 26 is a schematic diagram illustrating a control method of a power device when a fitness device is in a first mode according to some embodiments of the present disclosure.
Figure 27:
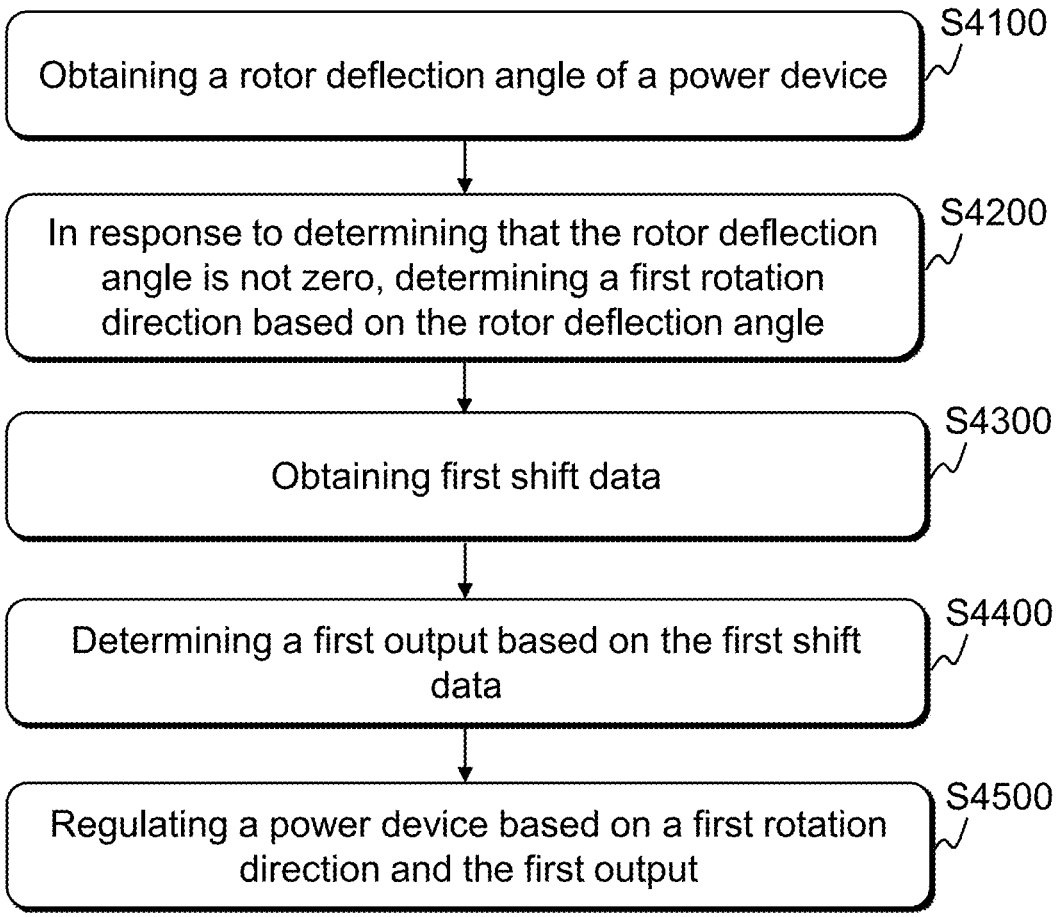
FIG. 27 is a flowchart illustrating an exemplary control method of a power device when a fitness device is in a first mode according to some embodiments of the present disclosure.

More descriptions regarding the control method of the power device when the fitness device is in the first mode may be found in FIGS. 25-27 and related descriptions thereof.

In S3200, in response to determining that the fitness device is in a second mode, a second output and a second rotation direction of the power device may be controlled.

The second output refers to at least one of a target rotation speed or a target output torque of the rotor of the power device when the fitness device is in the second mode. The second rotation direction refers to an actual rotation direction of the rotor of the power device when the fitness device is in the second mode.

In some embodiments, in response to determining that the fitness device is in the second mode, the control system may control the second output and the second rotation direction of the power device based on the operation of the ESO, the torque driver, etc.

Figure 28:
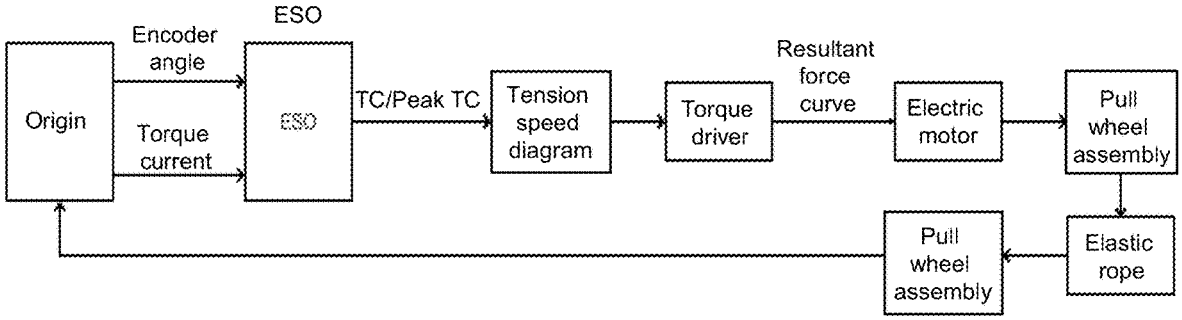
FIG. 28 is a schematic diagram illustrating a control principle of a power device when a fitness device is in a second mode according to some embodiments of the present disclosure.
Figure 29:
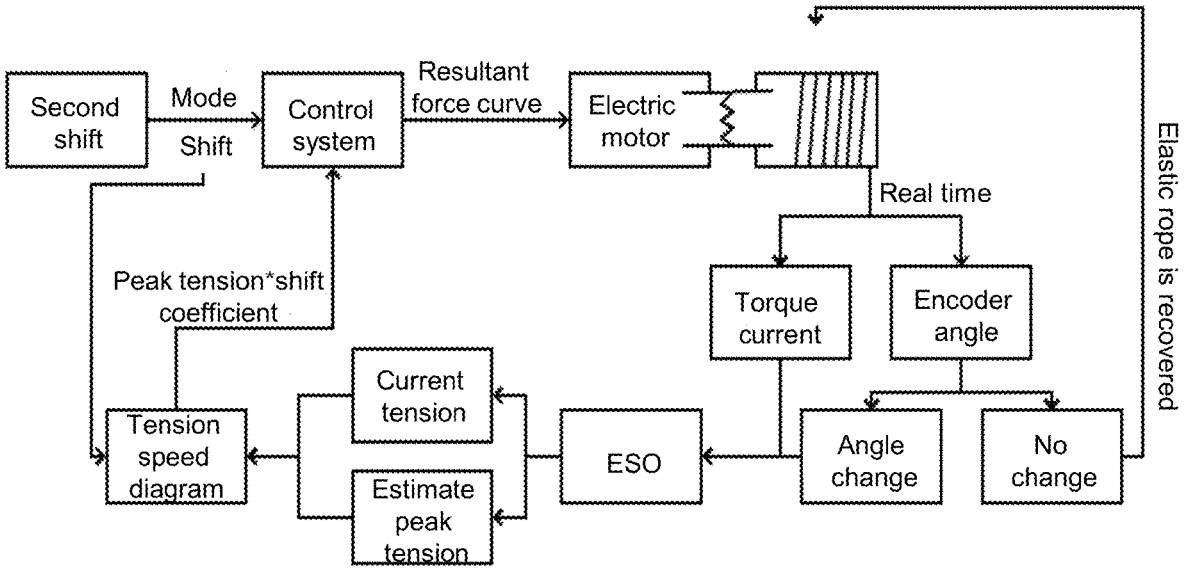
FIG. 29 is a schematic diagram illustrating a control method of a power device when a fitness device is in a second mode according to some embodiments of the present disclosure.
Figure 30:
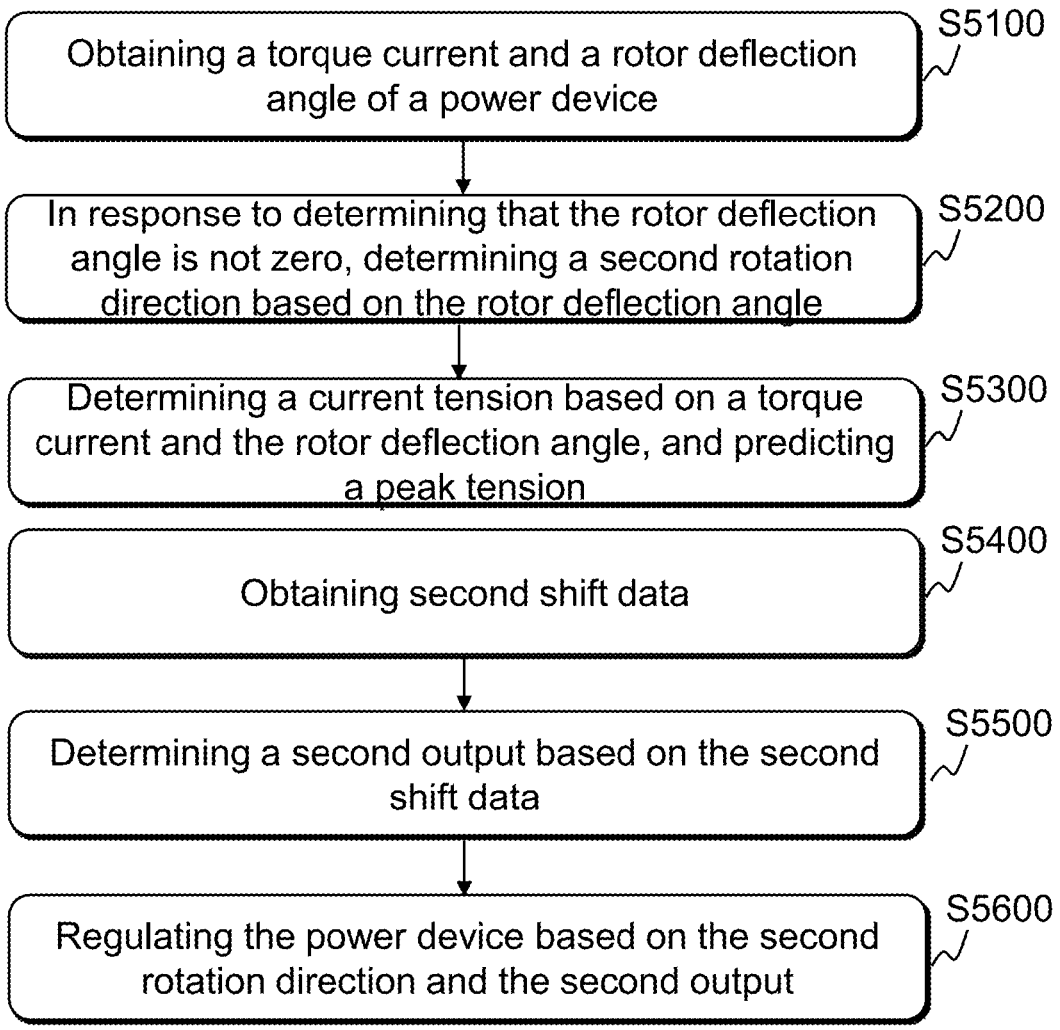
FIG. 30 is a flowchart illustrating an exemplary control method of a power device when a fitness device is in a second mode according to some embodiments of the present disclosure.

More descriptions regarding the control method of the power device when the fitness device is in the second mode may be found in FIGS. 28-30 and related descriptions thereof.

In some embodiments of the present disclosure, by controlling the specific output of the power device, the fitness device can provide a personalized training experience according to the mode selected by the user (e.g., the first mode or the second mode). Different modes may require different resistance levels and exercise modes to meet different training needs and goals of the user.

FIG. 25 is a schematic diagram illustrating a control principle of a power device when a fitness device is in a first mode according to some embodiments of the present disclosure. As shown in FIG. 25, when the fitness device is in the first mode, the rotor of a power device may be located at an origin when no external force is applied. When the external force is applied, an encoder may detect deviation of the rotor of the power device through position detection, and the APR may generate a speed regulation instruction in response to receipt of the deviation of the rotor of the power device, and send the speed regulation instruction to the ASR. When the ASR receives the instruction, the encoder may detect an actual rotation speed and an actual rotation direction of the rotor of the power device through speed detection, and the ASR may generate a current regulation instruction based on the speed regulation instruction, and the actual rotation speed and the actual rotation direction of the power device, and send the current regulation instruction to a torque driver. The torque driver may control an output torque or a rotation speed of the power device through the torque driver, such that the rotation speed of the power device may always be between a set upper speed limit and a lower speed limit, or between an upper output torque limit and a lower output torque limit.

FIG. 26 is a schematic diagram illustrating a control method of a power device when a fitness device is in a first mode according to some embodiments of the present disclosure. As shown in FIG. 26, a fitness device may be in the first mode, and a rotor of a power device may be located at an origin when no external force is applied. When the external force is applied, the rotor of the power device may deviate, and the APR may send a rotation instruction to the ASR according to an encoder angle (i.e., a rotor deflection angle of the power device described below). After receiving the rotation instruction, the ASR may control the power device to rotate until rotating to a target position (e.g., origin position). Meanwhile, the control system may control a torque driver to work according to first shift data, such that the power device may operate according to the first shift data to provide resistance to a pull wheel assembly. More descriptions regarding the specific control method of the power device when the fitness device is in the first mode may be found in FIG. 27 and related descriptions thereof.

FIG. 27 is a flowchart illustrating an exemplary control method of a power device when a fitness device is in a first mode according to some embodiments of the present disclosure. As shown in FIG. 27, a process 4000 may include the following operations. In some embodiments, the process 4000 may be performed by a control system.

In S4100, a rotor deflection angle of a power device may be obtained.

The rotor deflection angle of the power device refers to a deflection angle of a rotor of the power device when the rotor of the power device deflects by an external force (e.g., when a user pulls a pull rope). For example, when the power device is not subjected to the external force, the rotor of the power device may be located at an origin position; when the external force acts on the power device, the rotor of the power device may deviate. The deviation may be the rotor deflection angle.

In some embodiments, the rotor deflection angle of the power device may be obtained using an encoder. For example, the encoder may be an incremental encoder, and a measuring shaft of the encoder may be on an output shaft of the power device to ensure that the measuring shaft of the encoder rotates synchronously with the output shaft of the power device. When the rotor of the power device deflects under the action of the external force, the encoder may determine a relative position and speed of the rotor by counting the number of pulses and tracking the direction of the pulses, thereby realizing the detection of the rotor deflection angle of the power device.

In some embodiments, the rotor deflection angle of the power equipment may also be obtained by other angle sensors. An exemplary angle sensor may include but is not limited to a Hall effect sensor, a rotary transformer, etc.

In S4200, in response to determining that the rotor deflection angle is not zero, a first rotation direction may be determined based on the rotor deflection angle.

In some embodiments, the control system may determine a direction opposite to a rotor deflection direction as a first rotation direction of the power device based on the rotor deflection angle in response to determining that the rotor deflection angle is not zero (i.e., when the user pulls the pull rope or the pull rope is recovered, the rotor of the power device deflects). For example, when the fitness device is in a first mode, and the user pulls the pull rope to cause the rotor of the power device to deflect in the first rotation direction (or a second rotation direction), the first rotation direction of the power device may be the second rotation direction; when the pull rope is recovered to cause the rotor of the power device to deflect in the second rotation direction (or the first rotation direction), the first rotation direction of the power device may be the first rotation direction (or the second rotation direction).

More descriptions regarding the first rotation direction may be found in the related descriptions above.

In S4300, first shift data may be obtained.

The first shift data refers to shift parameters of resistance or a braking torque provided by the power device when the fitness device is in the first mode. In some embodiments, the first shift data may include at least one of an output speed, an output torque, or a provided resistance of the power device.

In some embodiments, the power device may generate the output torque during operation, and the torque may be converted into the resistance (i.e., the provided resistance) acting on a pulley assembly through a transmission member (e.g. a first rotating shaft, a second rotating shaft, a central gear assembly, a bevel gear, the pulley assembly, etc.).

In some embodiments, the resistance provided by the power device may be related to the output torque. For example, a product of the provided resistance and a set coefficient may be the output torque. The set coefficient may be set manually in advance. The set coefficient may have a corresponding relationship with parameters of the transmission member. The corresponding relationship may be obtained by experiments or the like.

In some embodiments, the first shift data may include upper and lower limits of the output speed of the power device, upper and lower limits of the output torque, and upper and lower limits of the provided resistance, so as to ensure that the output of the power device is within a suitable range.

For example, when the user pulls the pull rope, the resistance provided by the power device may be 8 KG, and when the pull rope is recovered, the resistance provided by the power device may be 10 KG. In this case, the upper limit of the resistance provided by the power device may be 10 KG. As another example, when the user pulls the pull rope, the resistance provided by the power device may be 12 KG, and when the pull rope is recovered, the resistance provided by the power device may be 15 KG. In this case, the upper limit of the resistance provided by the power device may be 20 KG.

In some embodiments, the first gear position data may be obtained by user input. In some embodiments, the first gear position data may be adjusted according to actual user needs.

In S4400, a first output may be determined based on the first shift data.

In some embodiments, the control system may determine at least one of the output speed, the output torque, the provided resistance, etc. of the power device in the first shift data as the first output based on the first shift data.

In S4500, a power device may be regulated based on a first rotation direction and the first output.

In some embodiments, the control system may control the APR to generate a rotation instruction based on the first rotation direction and send the rotation instruction to the ASR, thereby controlling the power device to rotate until a target position (e.g., a position where the rotor deflection angle is zero). During the rotation process of the power device, the control system may control a torque driver to work based on the first output to adjust a phase current of the power device, thereby controlling the power device to operate based on the first output.

The rotation instruction refers to an instruction for controlling the power device to achieve rotation by controlling the ASR. It is understood that the forward rotation is rotation in the first rotation direction mentioned above, or in the second rotation direction mentioned above, which maybe set accordingly as needed.

In some embodiments of the present disclosure, the output and rotation direction of the power device can be accurately controlled according to the real-time load provided to the power device by the exercise of the user through the cooperative work of the APR, the ASR, and torque driver, thereby meeting the precise motion control requirements of the fitness device.

FIG. 28 is a schematic diagram illustrating a control principle of a power device when a fitness device is in a second mode according to some embodiments of the present disclosure. As shown in FIG. 28, when the fitness device is in the second mode, a rotor of the power device may be located at an origin when no external force is applied. When the external force is applied, the ESO may obtain an encoder angle (i.e., a rotor deflection angle of the power device) from an encoder and a torque current of the power device from a current sensor, and then obtain a current tension (TC) exerted on an output shaft of the power device based on the encoder angle and the torque current to estimate a peak tension. The control system may generate a resultant force curve based on a tension speed diagram (i.e., a tension speed curve described below, and control a torque driver to operate such that the power device may operate based on the resultant force curve to continuously provide corresponding resistance. When the power device stops working, a pull rope may be recovered by a rebound force of an elastic rope and rewound on a pull wheel assembly.

FIG. 29 is a schematic diagram illustrating a control method of a power device when a fitness device is in a second mode according to some embodiments of the present disclosure. As shown in FIG. 29, the fitness device may be in the second mode. A rotor of the power device may be located at an origin when no external force is applied. When the external force is applied to a rotor of the power device, the rotor of the power device may deviate, and the ESO may determine a current tension of an output shaft of the power device under the external force according to an encoder angle and a torque current of the power device, and estimate a peak tension. Meanwhile, a control system may obtain second shift data, and determine a corresponding tension speed diagram according to a training mode in the second shift data, and then generate a resultant force curve based on the current tension, the peak tension and the training mode in the second shift data. Finally, the control system may control a torque driver to work based on the resultant force curve, so that the power device may operate based on the resultant force curve to continuously provide the corresponding resistance until the rotation speed is reduced to 0. When the rotation speed of the power device is reduced to 0, the power device may stop working, and a pull rope may be recovered by a rebound force of an elastic rope and rewound on a pull wheel assembly.

FIG. 30 is a flowchart illustrating an exemplary control method of a power device when a fitness device is in a second mode according to some embodiments of the present disclosure. As shown in FIG. 30, a process 5000 may include the following operations. In some embodiments, the process 5000 may be performed by a control system.

In S5100, a torque current and a rotor deflection angle of a power device may be obtained.

The torque current of the power device refers to a current component flowing through a winding of the power device. The current component may be directly responsible for generating an electromagnetic torque to make a rotor of the power device rotate.

In some embodiments, the torque current of the power device may be obtained using a current sensor. An exemplary current sensor may include a current divider, a current transformer, etc. Merely by way of example, by connecting the current sensor and the winding of the power device in series in a motor circuit to measure the current flowing through the winding of the power device, the torque current of the power device can be obtained.

More descriptions regarding the rotor deflection angle may be found in the present disclosure above.

In S5200, in response to determining that the rotor deflection angle is not zero, a second rotation direction may be determined based on the rotor deflection angle.

In some embodiments, the control system may determine a direction opposite to the rotor deflection angle as a second rotation direction based on the rotor deflection angle in response to determining that the rotor deflection angle is not zero. For example, when the fitness device is in the second mode, and the user pulls the pull rope to cause the rotor of the power device to deviate along the first rotation direction (or the second rotation direction), the first rotation direction of the power device may be the second rotation direction. Since a first rotating shaft is separated from a second rotating shaft when the fitness device is in the second mode, in this mode, when the pull rope is recovered, the rotor of the power device may not deviate, and the power device may stop operating.

In S5300, a current tension may be determined based on a torque current and the rotor deflection angle, a peak tension may be predicted.

The current tension refers to a tension currently applied to the output shaft of the power device under the action of an external force (e.g., the user pulls the pull rope) when the fitness device is in the second mode.

The peak tension refers to a maximum tension value that the output shaft of the power device may be subjected to under the action of external force when the fitness device is in the second mode.

In some embodiments, the ESO may determine the current tension and the peak tension based on the torque current and the rotor deflection angle through various feasible modes (e.g., a machine learning algorithm, a statistical mode, etc.).

In S5400, second shift data may be obtained.

The second shift data refers to shift parameters of the resistance provided by the power device when the fitness device is in the second mode. In some embodiments, the second shift data may include a training shift and a training mode.

The training shift is used to characterize a level of the maximum resistance that the power device can provide. For example, the higher the value of the training shift, the greater the value of the maximum resistance that the power device can provide.

The training mode refers to a resistance mode that the power device can provide. In some embodiments, the training mode may include at least one of a wind resistance mode, a water resistance mode, and a magnetic resistance mode.

In S5500, a second output may be determined based on the second shift data.

In some embodiments, the control system may determine the second output based on the second shift data through the following operations.

In S5510, a current training shift and/or a current training mode may be obtained.

In some embodiments, the current training shift and the current training mode may be obtained based on user input. For example, the control system may determine a training shift and a training mode input or selected by the user for the last time as the current training shift and the current training mode, respectively.

In S5520, a tension speed curve corresponding to the current training mode may be determined based on the current training mode.

The tension speed curve corresponding to the current training mode refers to a graphical representation of a relationship between the tension and the rotation speed of the output shaft of the power device at different operation speeds in the current training mode. It is understood that different training modes may correspond to different tension speed curves.

Figure 31A:
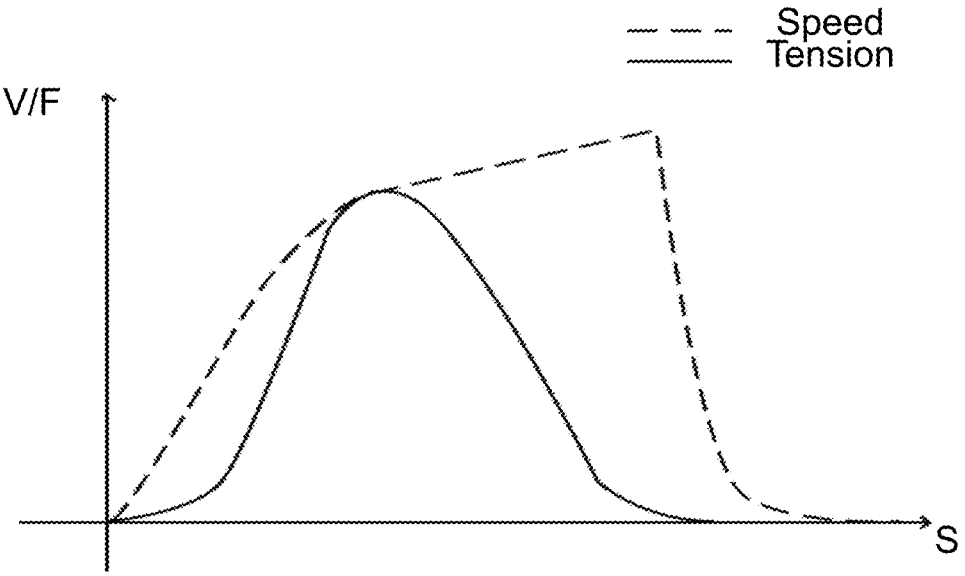
FIG. 31A is a schematic diagram illustrating an exemplary tension speed curve in a wind resistance mode according to some embodiments of the present disclosure.
Figure 31B:
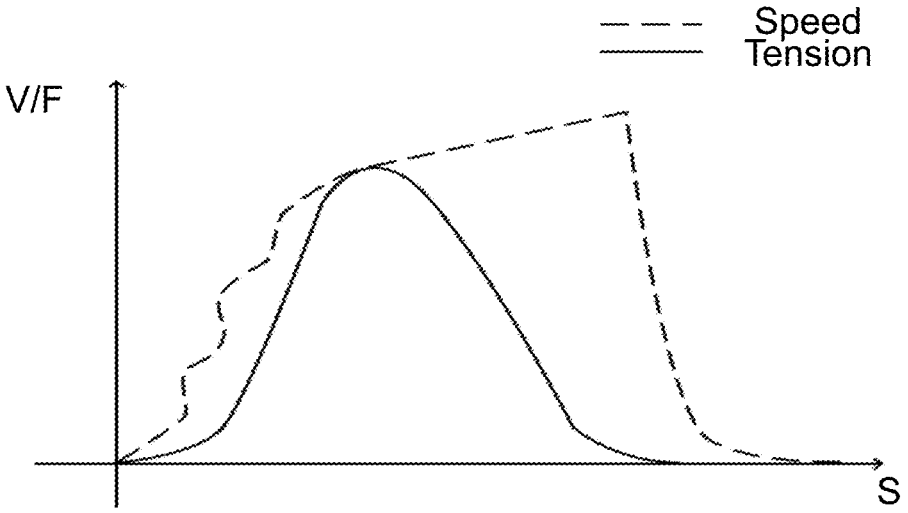
FIG. 31B is a schematic diagram illustrating an exemplary tension speed curve in a water resistance mode according to some embodiments of the present disclosure.
Figure 31C:
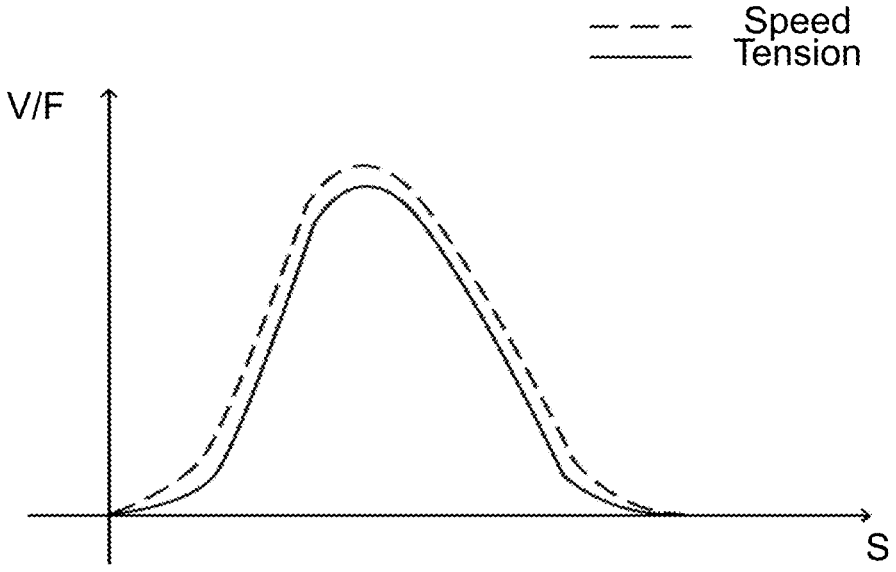
FIG. 31C is a schematic diagram illustrating an exemplary tension speed curve in a magnetic resistance mode according to some embodiments of the present disclosure.

FIG. 31A is a schematic diagram illustrating an exemplary tension speed curve in a wind resistance mode according to some embodiments of the present disclosure. FIG. 31B is a schematic diagram illustrating an exemplary tension speed curve in a water resistance mode according to some embodiments of the present disclosure. FIG. 31C is a schematic diagram illustrating an exemplary tension speed curve in a magnetic resistance mode according to some embodiments of the present disclosure. It is easy to find from FIGS. 31A-31C that a rotation speed of a power device and a tension on an output shaft of the power device are constantly changing.

The tension speed curve in the wind resistance mode may be used as an example for explanation. As shown in FIG. 31A, the tension may gradually increase from 0 to a peak tension and then gradually decrease to 0. Correspondingly, a rotation speed of the power device may gradually increase from 0. When the tension reaches the peak tension, the rotation speed of the power device may continue to increase slowly for a period of time and then gradually decrease to 0.

In some embodiments, the tension speed curve corresponding to the training mode may be determined through experiments, simulations, etc., and set in the control system in advance.

In S5530, a resultant force curve corresponding to the current training mode may be generated based on a tension speed curve corresponding to the current training mode, a current tension, a peak tension, and a current training shift.

The resultant force curve corresponding to the current training mode may be a graphical representation of a relationship between the tension exerted on the output shaft of the power device and the rotation speed under the current training mode at different operation speeds obtained after adjustment.

In some embodiments, the control system may generate the resultant force curve by synchronously scaling the tension speed curve corresponding to the current training mode based on the tension speed curve corresponding to the current training mode, the current tension, the peak tension, and the current training shift. A scaling coefficient may be determined by a shift coefficient of the current training shift. Different training shifts may correspond to different shift coefficients. The shift coefficient of the training shift may be determined based on past experience, experiments, etc., and set in the control system in advance. The peak tension after scaling transformation=peak tension before scaling transformation×shift coefficient of the current training shift.

In S5540, a second output may be determined based on the resultant force curve corresponding to the current training mode.

In some embodiments, the control system may determine a rotation speed in the resultant force curve as the second output based on the resultant force curve corresponding to the current training mode.

In S5600, the power device may be regulated based on the second rotation direction and the second output.

In some embodiments, the control system may control the torque driver to work based on the second rotation direction and the second output to adjust a phase current of the power device, thereby controlling an electromagnetic torque of the power device, and regulating the power device to operate based on the second output and the second rotation direction.

In some embodiments of the present disclosure, the control system can provide the real-time load to the power device according to the exercise of the user, and accurately control the output of the power device, thereby meeting the precise motion control requirements of the fitness device.

It should be noted that the above descriptions of the process 3000, the process 4000, and the process 5000 are only for example and explanation, and do not limit the scope of application of the present disclosure. For those skilled in the art, various modifications and changes can be made to the process 3000, the process 4000, and the process 5000 under the guidance of the present disclosure. However, such modifications and changes are still within the scope of the present disclosure.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements and amendments to the present disclosure. These alterations, improvements, and modifications are intended to be suggested by this disclosure, and are within the spirit and scope of the exemplary embodiments of this disclosure.

What is claimed is:

1. A switching device, comprising:

a first rotating shaft, a second rotating shaft, and a switching member, wherein the second rotating shaft sleeves outside the first rotating shaft, and the first rotating shaft and the second rotating shaft are detachably connected through a first connecting assembly of the switching device;

the first rotating shaft and the second rotating shaft are drivingly connected through a second connecting assembly, are configured to rotate synchronously in a first rotation direction through the second connecting assembly; and the first rotating shaft and the second rotating shaft are configured to rotate synchronously in the first rotation direction or a second rotation direction through the first connecting assembly, the first rotation direction being opposite to the second rotation direction; and the switching member is configured to switch between a first state and a second state by driving the first rotating shaft to connect or separate from the second rotating shaft through a movement of the first connecting assembly.

2. The switching device of claim 1, wherein the first connecting assembly includes a first matching member and a second matching member;

the first matching member is disposed at an end of the first rotating shaft, the second matching member is disposed at an end of the second rotating shaft, the first matching member and the second matching member are detachably connected; and the switching member is connected with at least one of the first matching member or the second matching member.

3. The switching device of claim 2, wherein the switching member includes a switching member housing and a switching button, and the switching button is at least partially disposed in the switching member housing;

the first matching member and the second matching member are disposed in the switching member housing, and the first matching member is connected with the switching button through a connecting component.

4. The switching device of claim 3, wherein the switching button comprises a button cover and a button rod, and the button cover is disposed at one end of the button rod.

5. The switching device of claim 4, wherein the connecting component includes a connecting sleeve and a connecting rod, the connecting sleeve is rotatably connected with the first matching member, and the connecting rod is connected with the button rod.

6. The switching device of claim 5, wherein the switching member further includes a bushing and an elastic member, the bushing sleeves outside the button rod, and the elastic member sleeves outside the bushing.

7. The switching device of claim 3, wherein a positioning hole is disposed in the switching member housing, a positioning member is disposed in the positioning hole, and the switching button is configured to drive the positioning member to move in the positioning hole.

8. The switching device of claim 2, wherein an end of the first matching member is provided with first meshing teeth, and an end of the second matching member is provided with second meshing teeth;

the switching device is configured to be in the first state by driving at least one of the first matching member or the second matching member to move to cause the first meshing teeth to be engaged with the second meshing teeth; and the switching device is configured to be in the second state by driving the first matching member and/or the second matching member to move to cause the first meshing teeth to be separated from the second meshing teeth.

9. The switching device of claim 1, wherein the second connecting assembly includes a one-way bearing; and the first rotating shaft sleeves on the second rotating shaft through the one-way bearing.

10. A fitness device, comprising a switching device, wherein the switching device includes a first rotating shaft, a second rotating shaft, and an switching member, wherein the second rotating shaft sleeves outside the first rotating shaft, and the first rotating shaft and the second rotating shaft are detachably connected through a first connecting assembly of the switching device;

the first rotating shaft and the second rotating shaft are drivingly connected through a second connecting assembly, are configured to rotate synchronously in a first rotation direction through the second connecting assembly; and the first rotating shaft and the second rotating shaft are configured to rotate synchronously in the first rotation direction or a second rotation direction through the first connecting assembly, the first rotation direction being opposite to the second rotation direction;

the switching member is configured to switch between a first state and a second state by driving the first rotating shaft to connect or separate from the second rotating shaft through a movement of the first connecting assembly; and the fitness device is configured to be in a first mode when the switching device is in the first state, or in a second mode when the switching device is in the second state.

11. The fitness device of claim 10, further comprising a resistance module and a pull wheel assembly; wherein the fitness device is configured to be in the first mode when the resistance module is drivingly connected with the pull wheel assembly through the first connecting assembly or in the second mode when the resistance module is drivingly connected with the pull wheel assembly through the second connecting assembly.

12. The fitness device of claim 11, wherein the resistance module includes a power device, and the power device is drivingly connected with the first rotating shaft and is configured to provide resistance for the fitness device.

13. A control method for a fitness device comprising: a resistance module including a power device and a switching device, the control method comprising:

in response to determining that the fitness device is in a first mode, controlling a first output and a first rotation direction of the power device;

in response to determining that the fitness device is in a second mode, controlling a second output and a second rotation direction of the power device.

14. The control method for the fitness device of claim 13, wherein the controlling a second output and a second rotation direction of the power device includes:

obtaining a torque current and a rotor deflection angle of the power device;

in response to determining that the rotor deflection angle is not zero, determining the second rotation direction based on the rotor deflection angle;

determining a current pulling force based on the torque current and the rotor deflection angle, and predicting a peak pulling force;

obtaining second shift data;

determining the second output based on the second shift data; and regulating the power device based on the second rotation direction and the second output.

15. The control method for the fitness device of claim 14, wherein the second shift data includes a training shift and a training mode;

the determining the second output based on the second shift data includes:

obtaining a current training shift and a current training mode;

determining a tension speed curve corresponding to the current training mode based on the current training mode;

generating a resultant force curve corresponding to the current training mode based on the pulling force speed curve, the current pulling force, the peak pulling force, and the current training shift; and determining the second output based on the resultant force curve.

16. The control method for the fitness device of claim 13, wherein the controlling a first output and a first rotation direction of the power device includes:

obtaining a rotor deflection angle of the power device;

in response to determining that the rotor deflection angle is not zero, determining the first rotation direction based on the rotor deflection angle;

obtaining first shift data;

determining the first output based on the first shift data; and regulating the power device based on the first rotation direction and the first output.

* * * * *